US005814426A

United States Patent [19]

Fuller et al.

[11] Patent Number: 5,814,426

[45] Date of Patent: Sep. 29, 1998

[54] IMAGING MEMBERS CONTAINING HIGH PERFORMANCE POLYMERS

[75] Inventors: Timothy J. Fuller, Pittsford; Leon A. Teuscher, Williamsville; John F. Yanus, Webster; Damodar M. Pai, Fairport; Kathleen M. Carmichael, Williamson; Edward F. Grabowski, Webster; Paul F. Zukoski, Henrietta, all of N.Y.

[73] Assignee: Xerox Corporation, Stamford, Conn.

[21] Appl. No.: 976,004

[22] Filed: Nov. 21, 1997

[51] Int. Cl.[6] ..... G03G 5/05

[52] U.S. Cl. ..... 430/96

[58] Field of Search ..... 430/96, 56

[56] References Cited

U.S. PATENT DOCUMENTS

| | | | |
|---|---|---|---|
| 4,801,517 | 1/1989 | Frechet et al. | 430/59 |
| 4,806,443 | 2/1989 | Yanus et al. | 430/56 |
| 4,806,444 | 2/1989 | Yanus et al. | 430/56 |
| 4,818,650 | 4/1989 | Limburg et al. | 430/56 |
| 4,935,487 | 6/1990 | Yanus et al. | 528/203 |
| 4,956,440 | 9/1990 | Limburg et al. | 528/99 |
| 5,030,532 | 7/1991 | Limburg et al. | 430/56 |
| 5,336,577 | 8/1994 | Spiewak et al. | 430/59 |
| 5,670,283 | 9/1997 | Kato et al. | 430/96 |
| 5,747,203 | 5/1998 | Nozomi et al. | 430/96 |

FOREIGN PATENT DOCUMENTS 63-247757-A2 11/1988 Japan .

*Primary Examiner*—John Goodrow
*Attorney, Agent, or Firm*—Judith L. Byorick

[57] ABSTRACT

Disclosed is an imaging member which comprises a conductive substrate, a photogenerating material, and a binder which comprises a polymer of the formulae I, II, III, IV, V, VI, VII, VIII, IX, or X as further defined herein.

17 Claims, 2 Drawing Sheets

IMAGING MEMBERS CONTAINING HIGH PERFORMANCE POLYMERS

BACKGROUND OF THE INVENTION

The present invention is directed to improved photosensitive imaging members. More specifically, the present invention is directed to photosensitive imaging members containing improved polymeric binders. One embodiment of the present invention is directed to an imaging member which comprises a conductive substrate, a photogenerating material, and a binder comprising a polymer selected from (a) those of the formulae wherein x is an integer of 0 or 1, A is

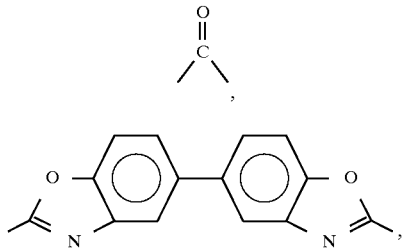

I

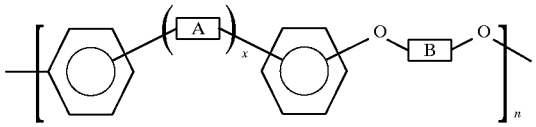

III

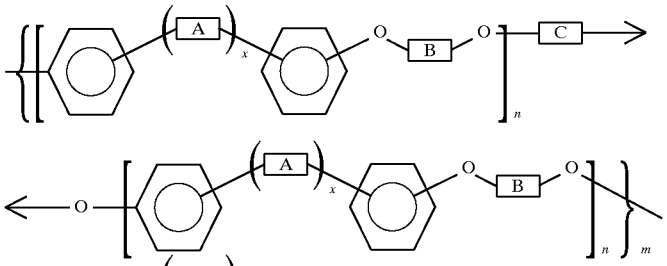

IV

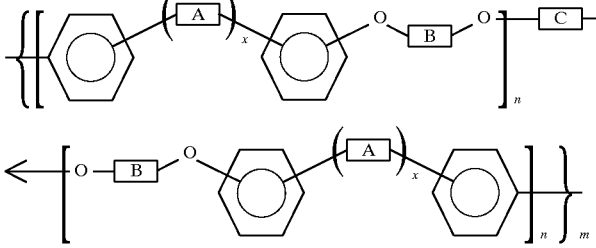

VII

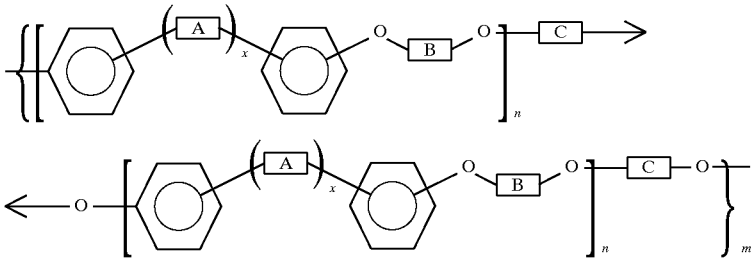

or

VIII

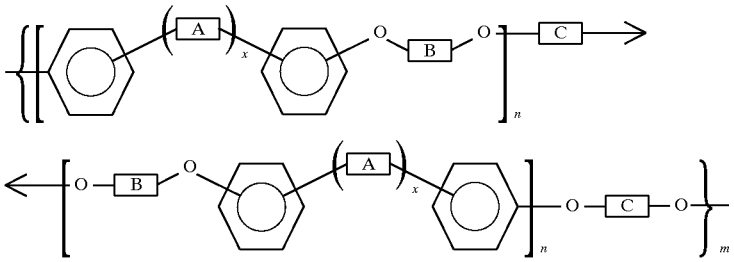

-continued
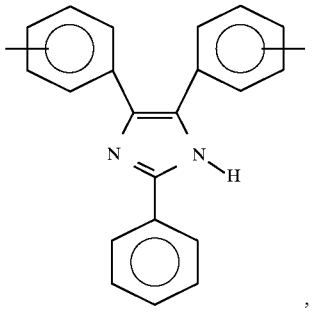
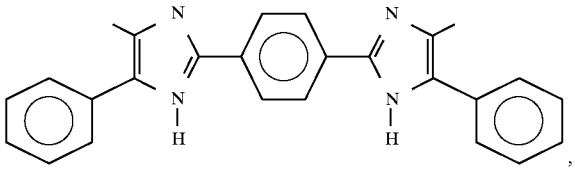
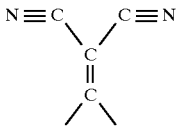
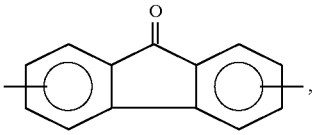
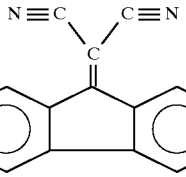
or mixtures thereof, B is
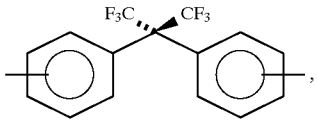
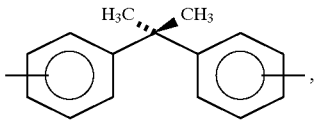
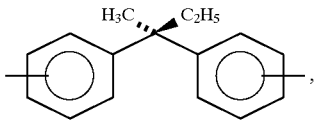
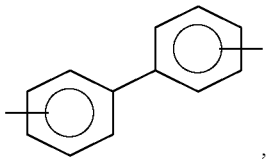
-continued
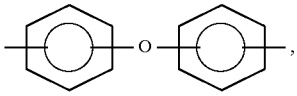
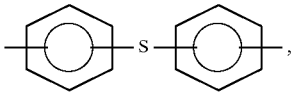
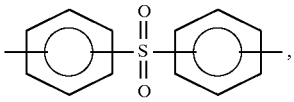
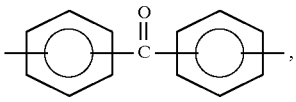
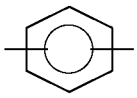
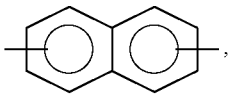
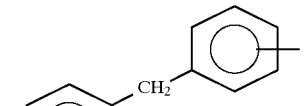
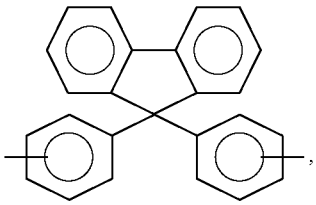
$-(CH_2)_v-$,
wherein v is an integer of from 1 to about 20,
$-(CH_2O)_t-$
wherein t is an integer of from 1 to about 20,
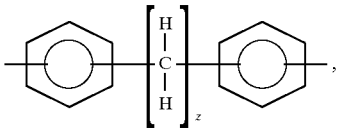
wherein z is an integer of from 2 to about 20,
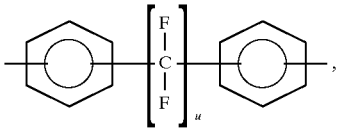

wherein u is an integer of from 1 to about 20,
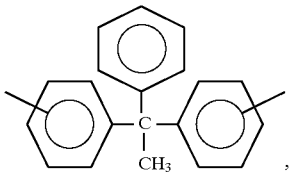
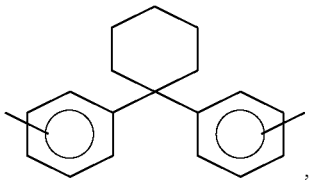
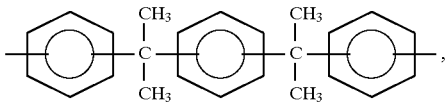
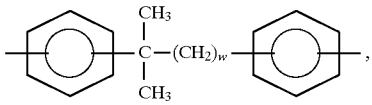
wherein w is an integer of from 1 to about 20,
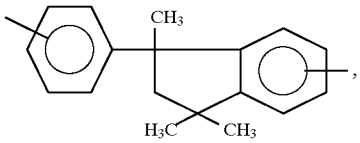
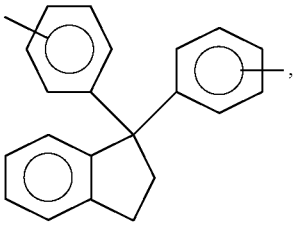
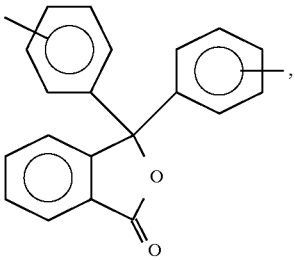
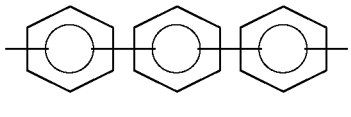
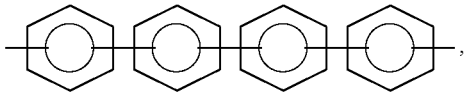
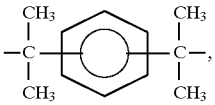
-continued
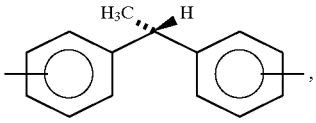
or mixtures thereof, C is
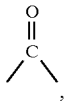
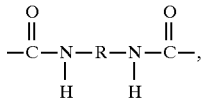
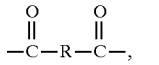
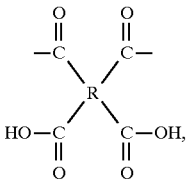
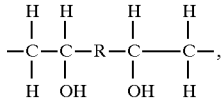
or mixtures thereof, wherein R is an alkyl group, an aryl group, an arylalkyl group, or mixtures thereof, and m and n are integers representing the number of repeating units; (b) those of the formulae
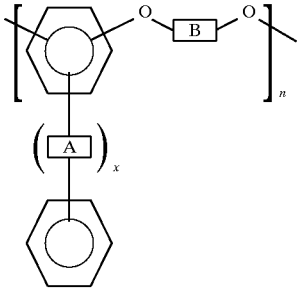
II
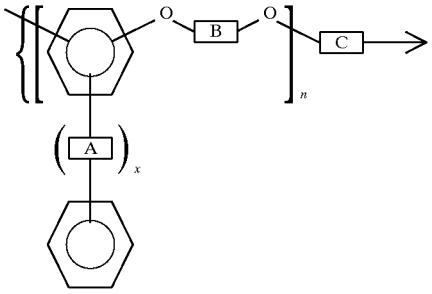
V -continued
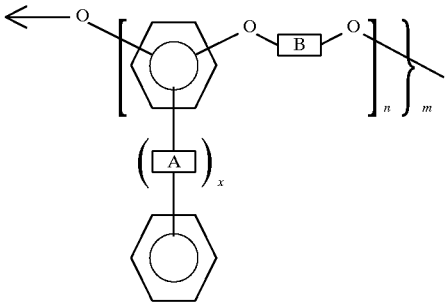
VI
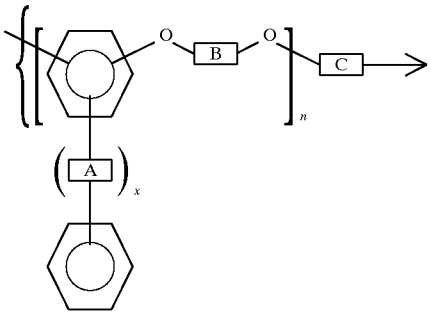
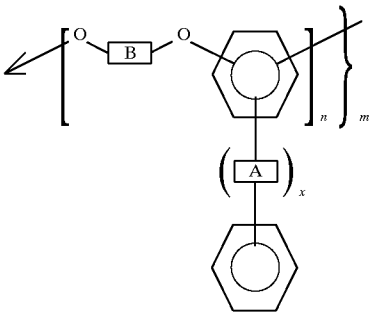
IX
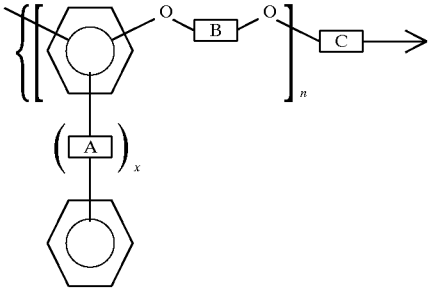
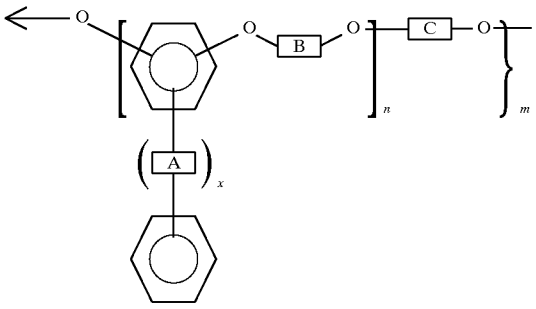
or
-continued
X
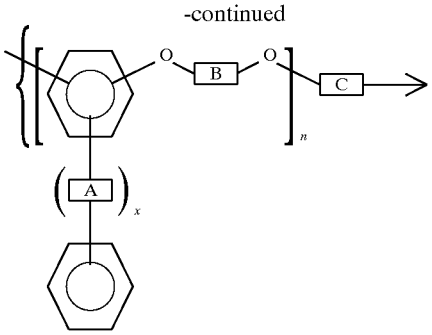
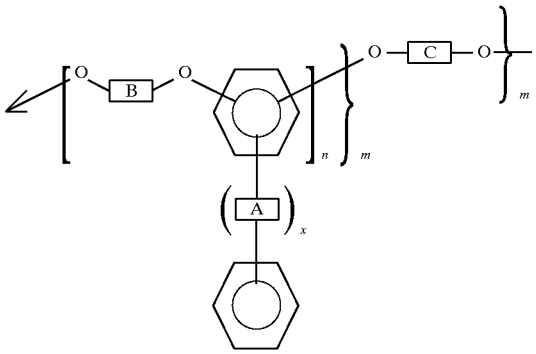
wherein x is an integer of 0 or 1, A is
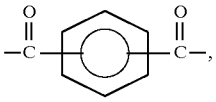
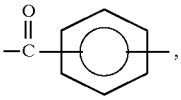
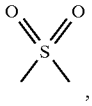
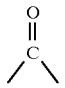
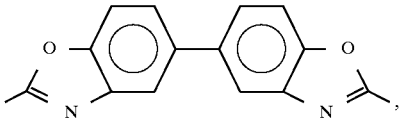
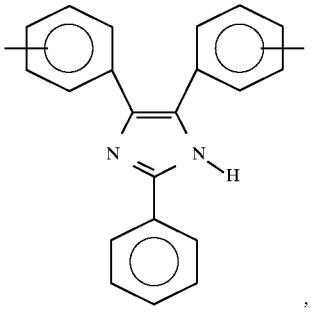
, -continued
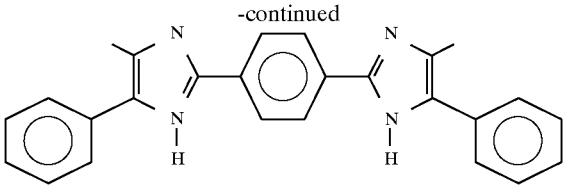
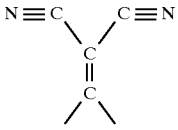
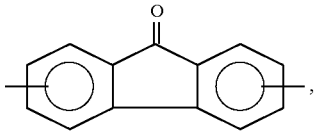
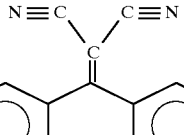
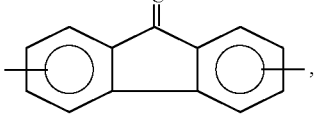
or mixtures thereof, B is
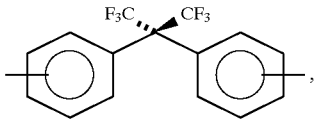
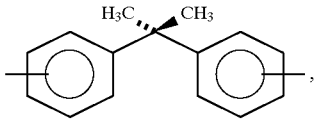
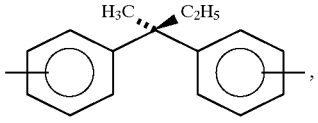
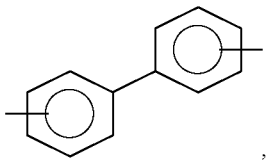
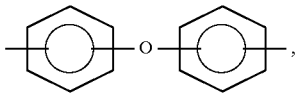
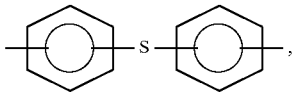
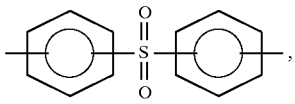
-continued
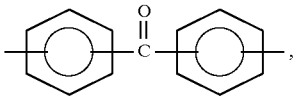
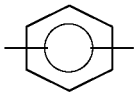
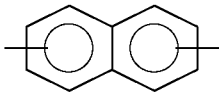
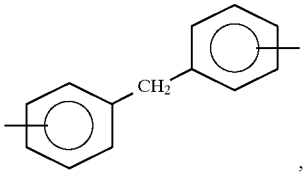
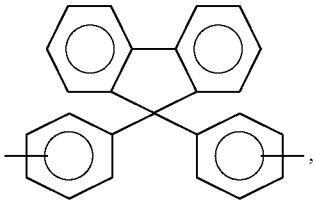
$-(CH_2)_v-$,
wherein v is an integer of from 1 to about 20,
$-(CH_2O)_t-$
wherein t is an integer of from 1 to about 20,
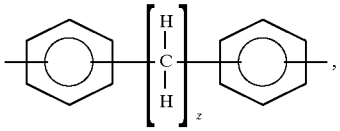
wherein z is an integer of from 2 to about 20,
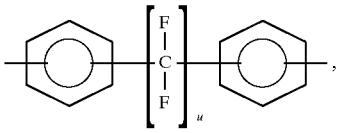
wherein u is an integer of from 1 to about 20,
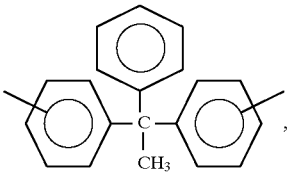
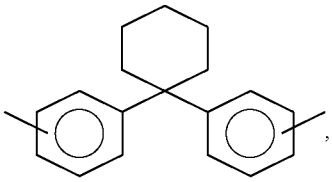

-continued
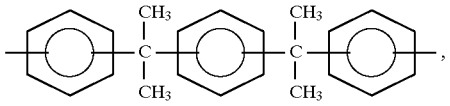
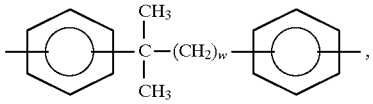
wherein w is an integer of from 1 to about 20,
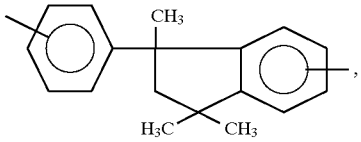
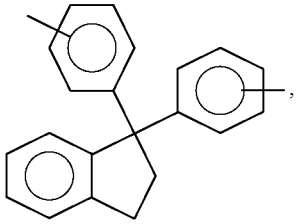
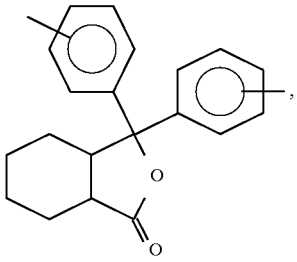
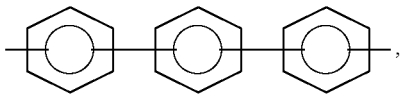
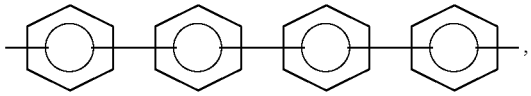
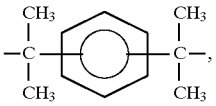
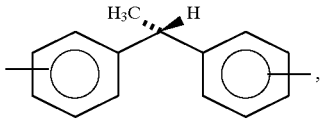
or mixtures thereof, C is
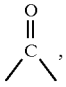
-continued
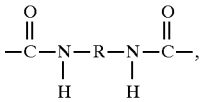
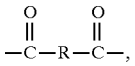
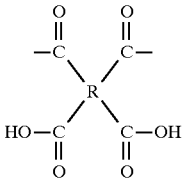
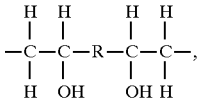
or mixtures thereof, wherein R is an alkyl group, an aryl group, an arylalkyl group, or mixtures thereof, and m and n are integers representing the number of repeating units; (c) those of formulae I, III, IV, VII, or VIII wherein x is an integer of 0 or 1, A is
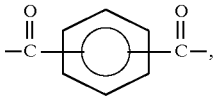
B is
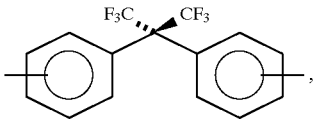
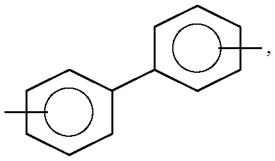
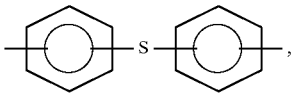
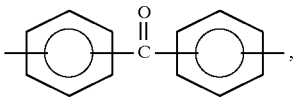
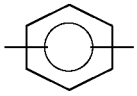
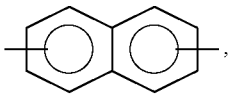

-continued

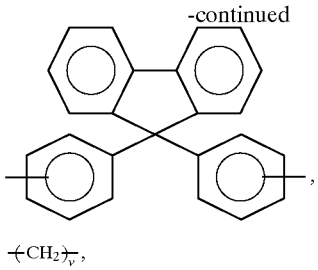

wherein v is an integer of from 1 to about 20, $—(CH_2O)_t—$ wherein t is an integer of from 1 to about 20,

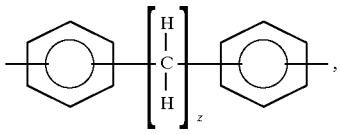

wherein z is an integer of from 2 to about 20,

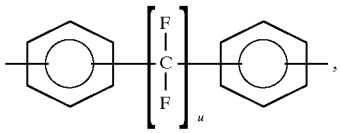

wherein u is an integer of from 1 to about 20,

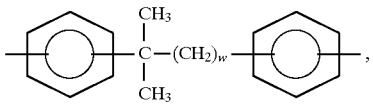

wherein w is an integer of from 1 to about 20,

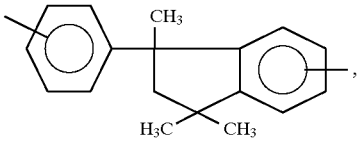

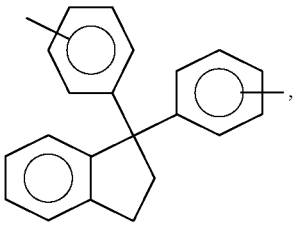

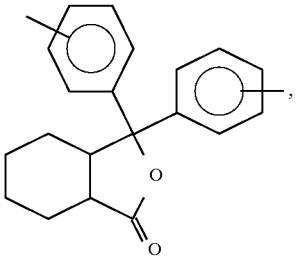

-continued

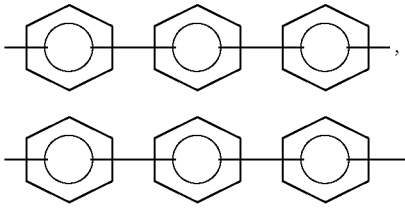

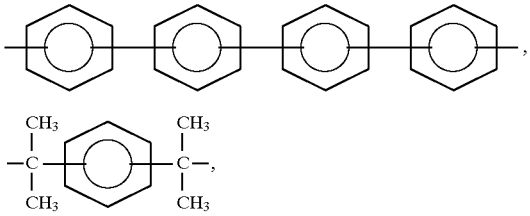

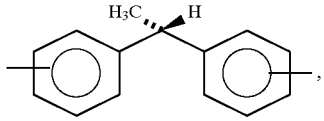

or mixtures thereof, C is

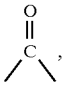

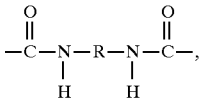

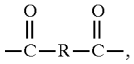

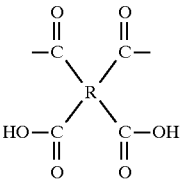

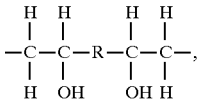

or mixtures thereof, wherein R is an alkyl group, an aryl group, an arylalkyl group, or mixtures thereof, and m and n are integers representing the number of repeating units; (d) those of formulae I, III, IV, VII, and VIII wherein x is an integer of 0 or 1, A is

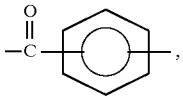

B is

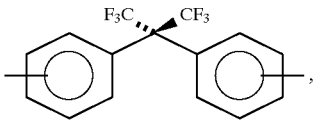

-continued
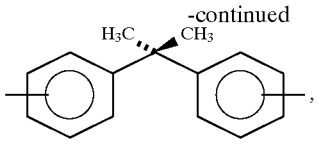
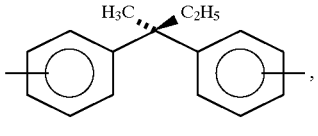
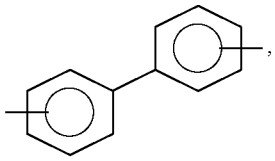
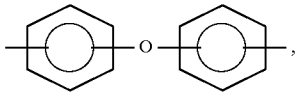
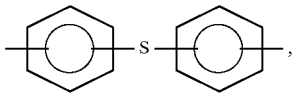
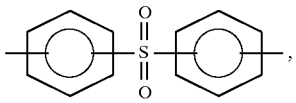
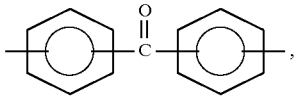
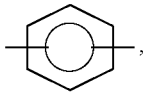
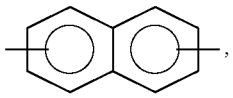
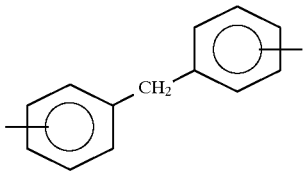
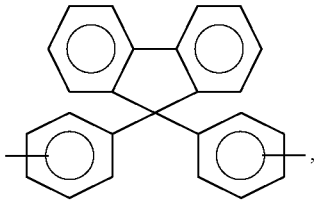
$\text{—}(CH_2)_v\text{—}$,
wherein v is an integer of from 1 to about 20,
$\text{—}(CH_2O)_t\text{—}$
wherein t is an integer of from 1 to about 20,
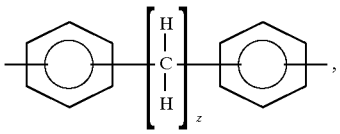
wherein z is an integer of from 2 to about 20,
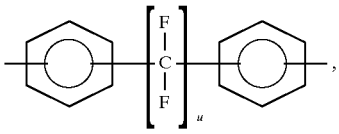
wherein u is an integer of from 1 to about 20,
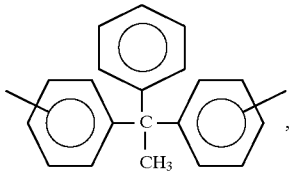
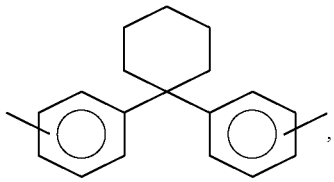
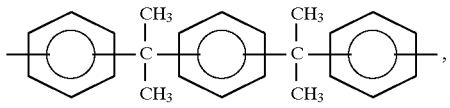
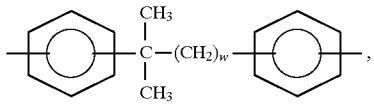
wherein w is an integer of from 1 to about 20,
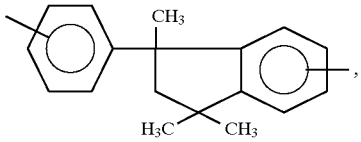
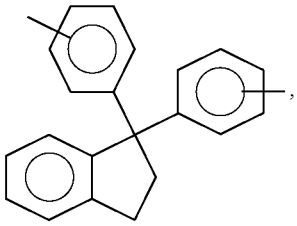

-continued
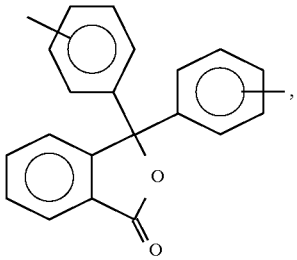
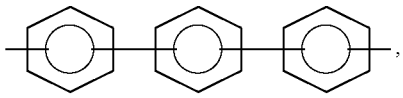
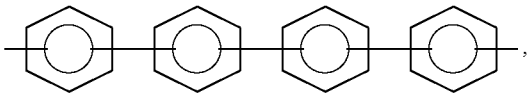
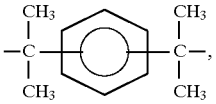
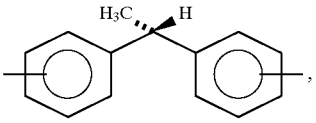
or mixtures thereof, C is
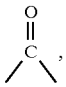
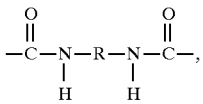
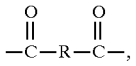
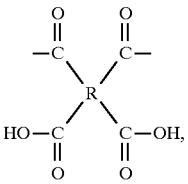
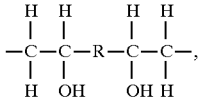
or mixtures thereof, wherein R is an alkyl group, an aryl group, an arylalkyl group, or mixtures thereof, and m and n are integers representing the number of repeating units; or (e) those of formulae I, III, IV, VII, and VIII wherein x is an integer of 0 or 1, A is
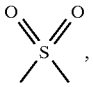
B is
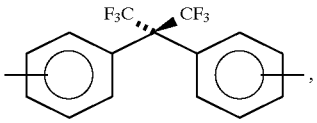
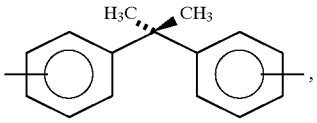
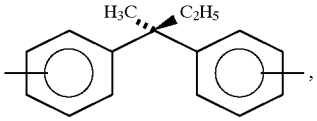
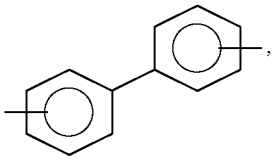
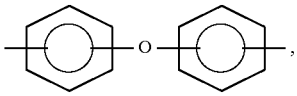
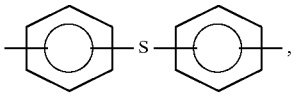
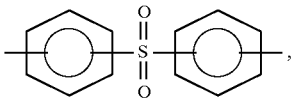
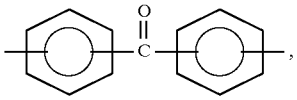
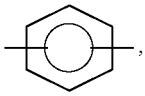
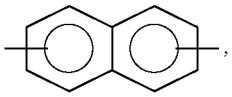
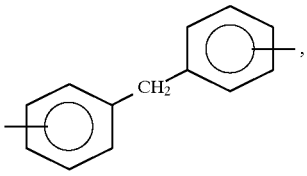

-continued
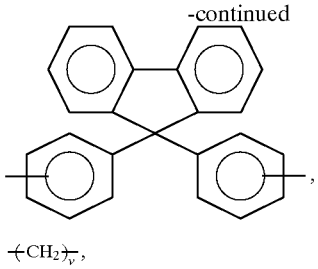
wherein v is an integer of from 1 to about 20,
$—(CH_2O)_t—$
wherein t is an integer of from 1 to about 20,
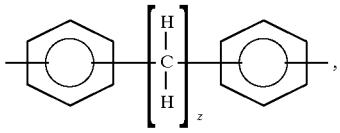
wherein z is an integer of from 2 to about 20,
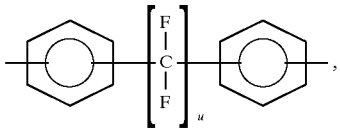
wherein u is an integer of from 1 to about 20,
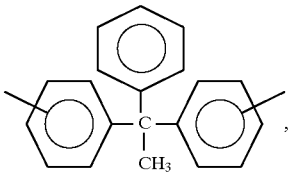
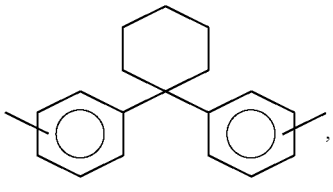
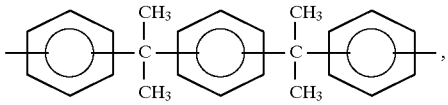
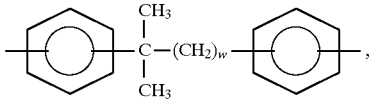
wherein w is an integer of from 1 to about 20,
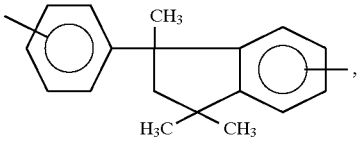
-continued
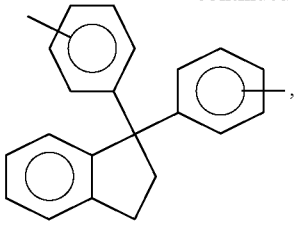
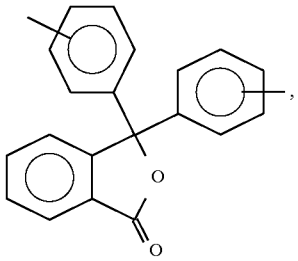
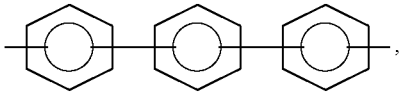
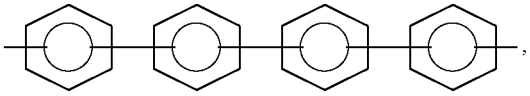
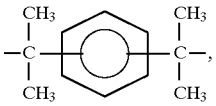
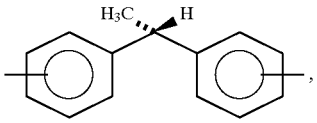
or mixtures thereof, C is
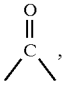
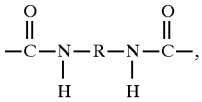
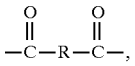
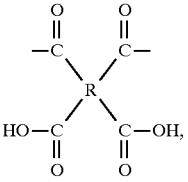
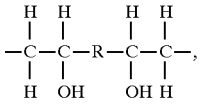

or mixtures thereof, wherein R is an alkyl group, an aryl group, an arylalkyl group, or mixtures thereof, and m and n are integers representing the number of repeating units.

The formation and development of images on the surface of photoconductive materials by electrostatic means is well known. The basic electrophotographic imaging process, as taught by C. F. Carlson in U.S. Pat. No. 2,297,691, entails placing a uniform electrostatic charge on a photoconductive imaging member, exposing the imaging member to a light and shadow image to dissipate the charge on the areas of the imaging member exposed to the light, and developing the resulting electrostatic latent image by depositing on the image a finely divided electroscopic material known as toner. In the Charge Area Development (CAD) scheme, the toner will normally be attracted to those areas of the imaging member which retain a charge, thereby forming a toner image corresponding to the electrostatic latent image. This developed image may then be transferred to a substrate such as paper. The transferred image may subsequently be permanently affixed to the substrate by heat, pressure, a combination of heat and pressure, or other suitable fixing means such as solvent or overcoating treatment.

Imaging members for electrophotographic imaging systems comprising selenium alloys vacuum deposited on substrates are known. Imaging members have also been prepared by coating substrates with photoconductive particles dispersed in an organic film forming binder. Coating of rigid drum substrates has been effected by various techniques such as spraying, dip coating, vacuum evaporation, and the like. Flexible imaging members can also be manufactured by processes that entail coating a flexible substrate with the desired photoconducting material.

Some photoresponsive imaging members consist of a homogeneous layer of a single material such as vitreous selenium, and others comprise composite layered devices containing a dispersion of a photoconductive composition. An example of a composite xerographic photoconductive member is described in U.S. Pat. No. 3,121,006, which discloses finely divided particles of a photoconductive inorganic compound dispersed in an electrically insulating organic resin binder. Imaging members prepared according to the teachings of this patent contain a binder layer with particles of zinc oxide uniformly dispersed therein coated on a paper backing. The binders disclosed in this patent include materials such as polycarbonate resins, polyester resins, polyamide resins, and the like.

Photoreceptor materials comprising inorganic or organic materials wherein the charge generating and charge transport functions are performed by discrete contiguous layers are also known. Additionally, layered photoreceptor members are disclosed in the prior art, including photoreceptors having an overcoat layer of an electrically insulating polymeric material. Other layered photoresponsive devices have been disclosed, including those comprising separate photogenerating layers and charge transport layers as described in U.S. Pat. No. 4,265,990, the disclosure of which is totally incorporated herein by reference. Photoresponsive materials containing a hole injecting layer overcoated with a hole transport layer, followed by an overcoating of a photogenerating layer, and a top coating of an insulating organic resin, are disclosed in U.S. Pat. No. 4,251,612, the disclosure of which is totally incorporated herein by reference. Examples of photogenerating layers disclosed in these patents include trigonal selenium and phthalocyanines, while examples of transport layers include certain aryl diamines as illustrated therein.

In addition, U.S. Pat. No. 3,041,167 discloses an overcoated imaging member containing a conductive substrate, a photoconductive layer, and an overcoating layer of an electrically insulating polymeric material. This member can be employed in electrophotographic imaging processes by initially charging the member with an electrostatic charge of a first polarity, followed by exposing it to form an electrostatic latent image that can subsequently be developed to form a visible image.

Japanese Patent Publication 63-247757 A2, the disclosure of which is totally incorporated herein by reference, discloses an electrophotographic photosensitive body consisting of a body in which a photoconductive layer laminated on a conductive support contains a charge generating substance and/or a charge transporting substance, and at least one polyether ketone polymer consisting of structural units which can be expressed by the following general formulae (I) and (II)

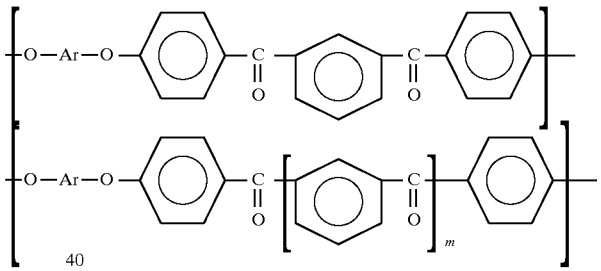

(I)

(II)

wherein m is 0 or 1 and Ar indicates

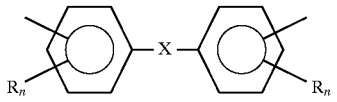

wherein R is an alkyl group, n is 0, 1, or 2, and X indicates

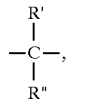

—O—, $-SO_2-$,

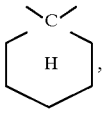

-continued

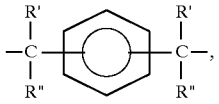

with R' and R" each independently indicating —H, —$CH_3$, —$C_2H_5$,

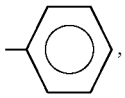

wherein the proportion of structural units in the polymer expressed by the general formula (I) is from 0.1 to 1.0 and the proportion of structural units in the polymer expressed by the general formula (II) is 0 to 0.9.

U.S. Pat. No. 5,336,577 (Spiewak et al.), the disclosure of which is totally incorporated herein by reference, discloses a thick organic ambipolar layer on a photoresponsive device which is simultaneously capable of charge generation and charge transport. In particular, the organic photoresponsive layer contains an electron transport material such as a fluorenylidene malonitrile derivative and a hole transport material such as a dihydroxy tetraphenyl benzadine containing polymer. These may be complexed to provide photoresponsivity, and/or a photoresponsive pigment or dye may also be included.

U.S. Pat. No. 4,801,517 (Frechet et al.), the disclosure of which is totally incorporated herein by reference, discloses an electrostatographic imaging member and an electrophotographic imaging process for using the imaging member in which the imaging member comprises a substrate and at least one electroconductive layer, the imaging member comprising a polymeric arylamine compound represented by the formula

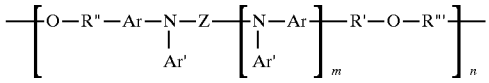

n is between about 5 and 5,000, m is 0 or 1, Z is selected from certain specified aromatic and fused ring groups, Ar is selected from certain specified aromatic groups, R is selected from certain specified alkyl groups, Ar' is selected from certain specified aromatic groups, and R' and R" are independently selected from certain specified alkylene groups.

U.S. Pat. No. 4,806,443 (Yanus et al.), the disclosure of which is totally incorporated herein by reference, discloses an electrostatographic imaging member and an electrophotographic imaging process for using the imaging member in which the imaging member comprises a substrate and an electroconductive layer, the imaging member comprising a polymeric acrylamine compound represented by the formula

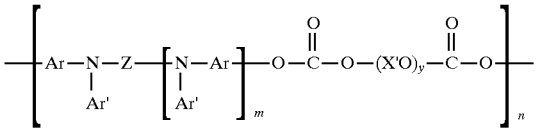

wherein n is between 5 and about 5,000, m is 0 or 1, y is 1, 2, or 3, Z is selected from certain specified aromatic and fused ring groups, Ar is selected from certain specified aromatic groups, Ar' is selected from certain specified aromatic groups, and X' is an alkylene radical selected from the group consisting of alkylene and isoalkylene groups containing 2 to 10 carbon atoms. The imaging member may comprise a substrate, charge generation layer, and a charge transport layer.

U.S. Pat. No. 4,806,444 (Yanus et al.) and U.S. Pat. No. 4,935,487 (Yanus et al.), the disclosures of each of which are totally incorporated herein by reference, disclose an electrostatographic imaging member and an electrophotographic imaging process for using the imaging member in which the imaging member comprises a substrate and an electroconductive layer, the imaging member comprising a polymeric arylamine compound represented by the formula

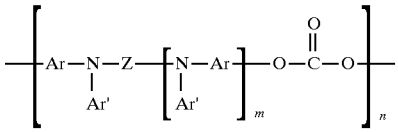

wherein n is between about 5 and about 5,000, m is 0 or 1, Z is selected from certain specified aromatic and fused ring groups, Ar is selected from certain specified aromatic groups, and Ar' is selected from certain specified aromatic groups. The imaging member may comprise a substrate, charge generation layer, and a charge transport layer.

U.S. Pat. No. 4,818,650 (Limburg et al.) and U.S. Pat. No. 4,956,440 (Limburg et al.), the disclosures of each of which are totally incorporated herein by reference, disclose an electrostatographic imaging member and an electrophotographic imaging process for using the imaging member in which the imaging member comprises a substrate and at least one electroconductive layer, the imaging member comprising a polymeric arylamine compound represented by the formula

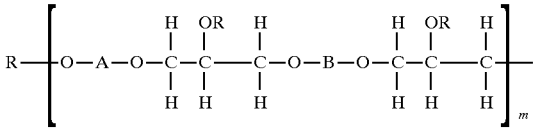

wherein R is selected from the group consisting of —H, —$CH_3$, and —$C_2H_5$, m is between about 4 and about 1,000, A is selected from the group consisting of an arylamine group represented by the formula

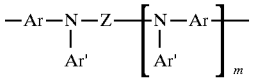

wherein m is 0 or 1, Z is selected from certain specified aromatic and fused ring groups that also contain an oxygen or sulfur atom, certain linear or cyclic hydrocarbon groups, and certain amine groups, Ar is selected from certain specified aromatic groups, Ar' is selected from certain specified aromatic groups, and B is selected from the group consisting of the arylamine group as defined for A and —Ar—V)$_n$Ar— wherein Ar is as defined above and V is selected from an oxygen or sulfur atom, certain linear or cyclic hydrocarbon groups, or a phenylene group, and at least A or B contains the arylamine group. The imaging member may comprise a substrate, charge generation layer, and a charge transport layer.

U.S. Pat. No. 5,030,532 (Limburg et al.), the disclosure of which is totally incorporated herein by reference, discloses an electrostatographic imaging member comprising a support layer and at least one electrophotoconductive layer, said imaging member comprising a polyarylamine polymer represented by the formula

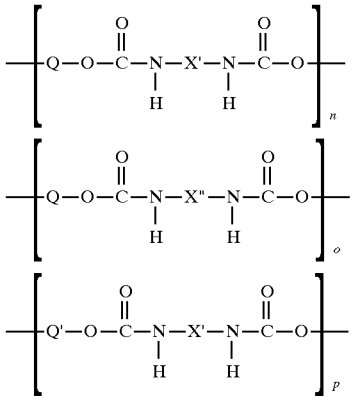

wherein n is between about 5 and about 5,000, or 0 if p>0, o is between about 9 and about 5,000, or is 0 if p>0 or n=0, p is between about 2 and about 100, or is 0 if n>0, X' and X" are independently selected from a group having bifunctional linkages, Q is a divalent group derived from certain hydroxy terminated arylamine reactants, Q' is a divalent group derived from a hydroxy terminated polyarylamine containing the group defined for Q and having a weight average molecular weight between about 1,000 and about 80,000, and the weight average molecular weight of the polyarylamine polymer is between about 10,000 and about 1,000,000.

Copending application U.S. Ser. No. (not yet assigned; Attorney Docket No. D/96194Q1, filed concurrently herewith, with the named inventors Timothy J. Fuller, Leon A. Teuscher, Damodar M. Pai, and John F. Yanus, the disclosure of which is totally incorporated herein by reference, discloses an imaging member which comprises a conductive substrate, a photogenerating material, and a polymer of the formula

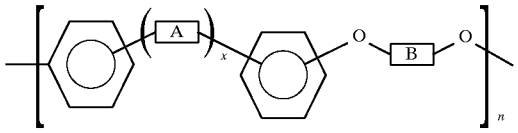

I

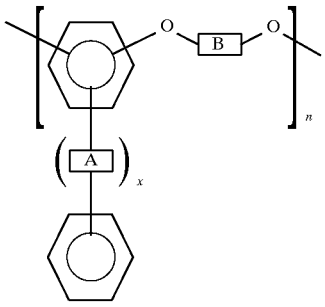

II

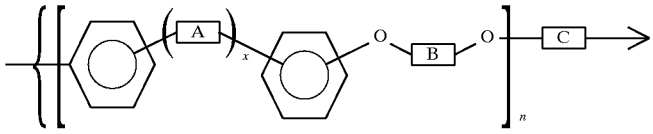

III

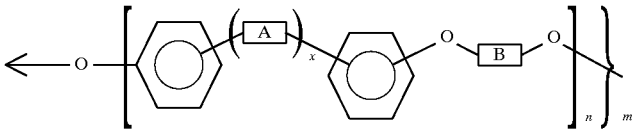

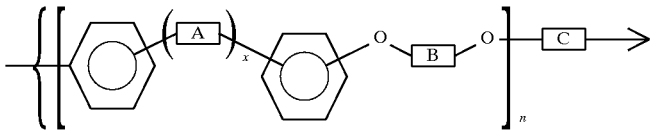

IV

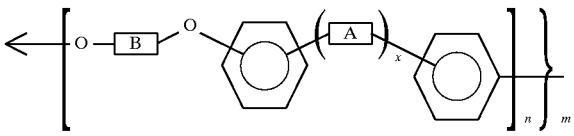

-continued
V
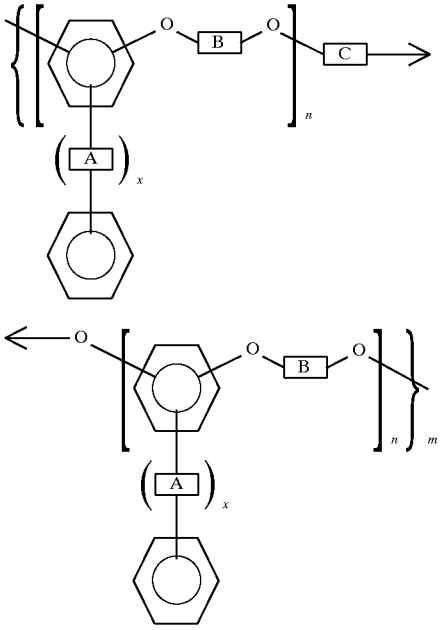
VI
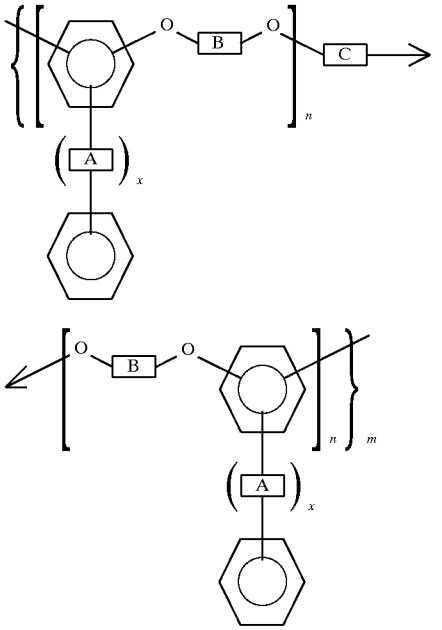
VII
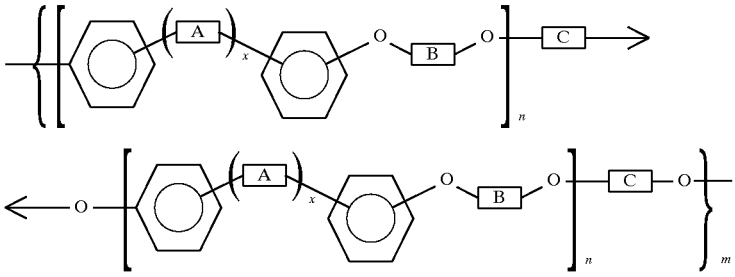
VIII
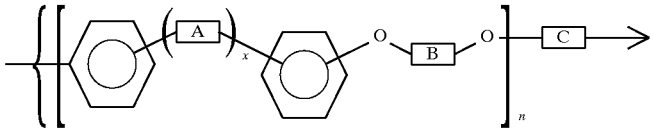

-continued
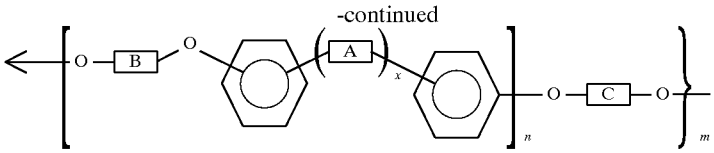
IX
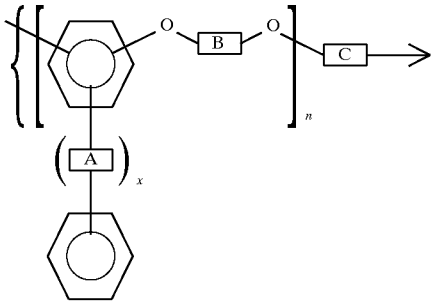
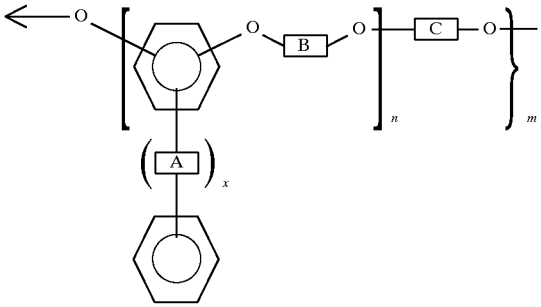
or
X
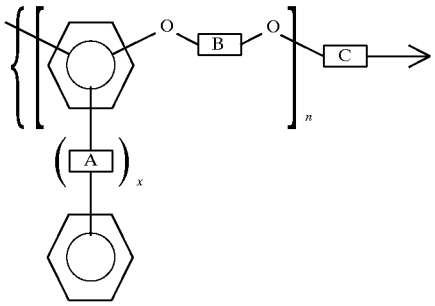
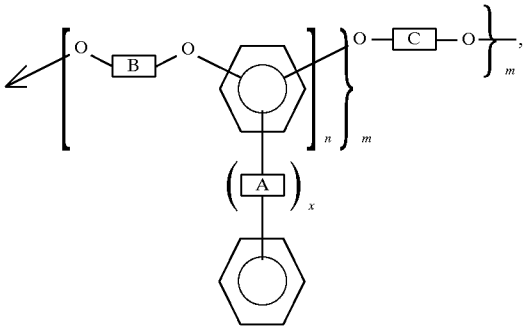
wherein x is an integer of 0 or 1, A is
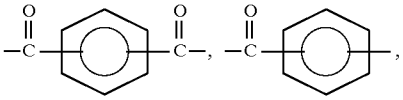
-continued
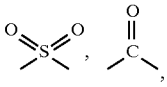

-continued
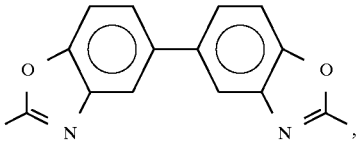
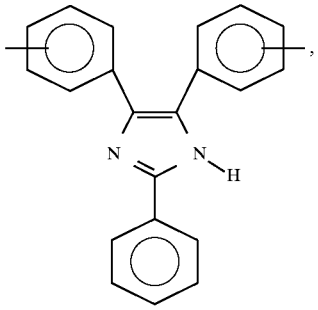
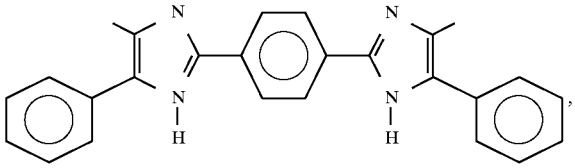
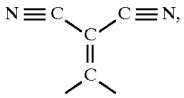
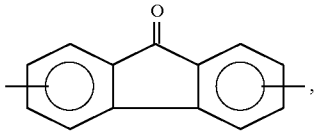
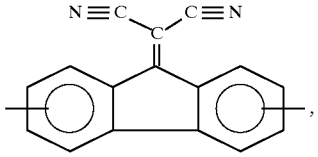
or mixtures thereof, B is
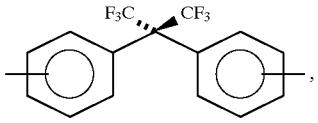
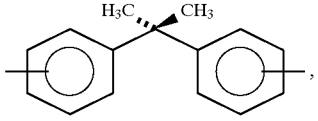
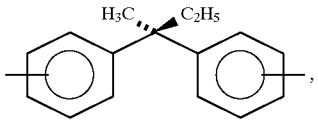
-continued
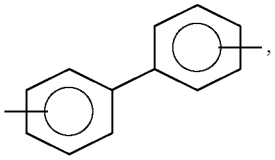
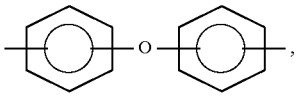
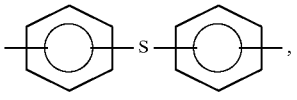
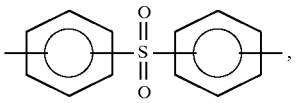
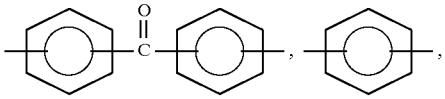
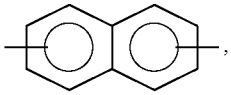
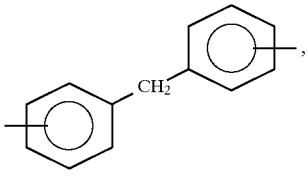
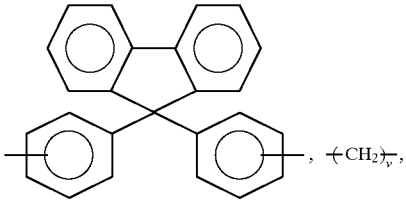
wherein v is an integer of from 1 to about 20,
$$—(CH_2O)_t—$$
wherein t is an integer of from 1 to about 20,
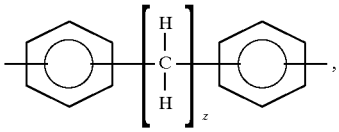
wherein z is an integer of from 2 to about 20,
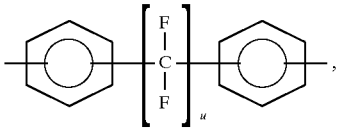

wherein u is an integer of from 1 to about 20,
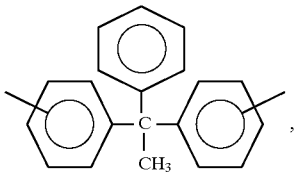
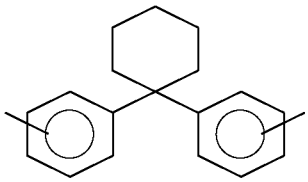
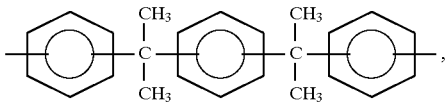
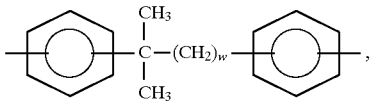
wherein w is an integer of from 1 to about 20,
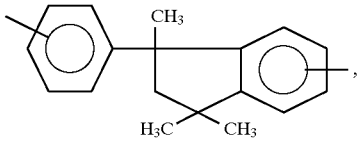
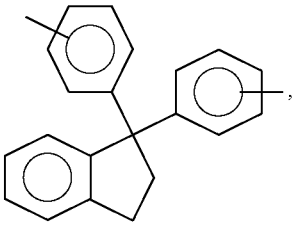
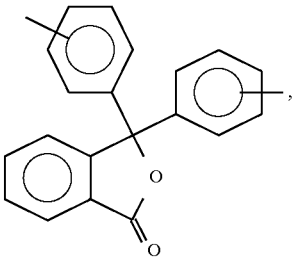
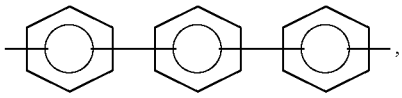
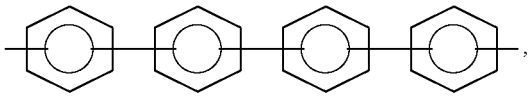
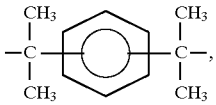
-continued
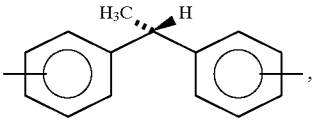
or
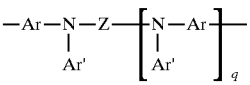
wherein (1) Z is
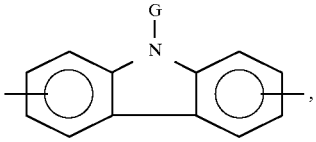
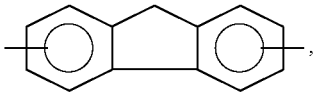
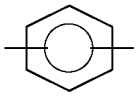
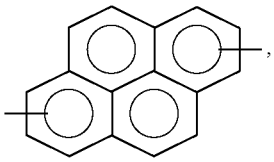
or
$-Ar-(X)_p-Ar-$
wherein p is 0 or 1; (2) Ar is
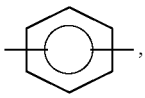
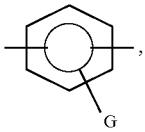
or
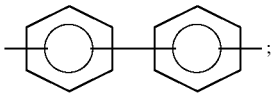
(3) G is an alkyl group selected from alkyl or isoalkyl groups containing from about 2 to about 10 carbon atoms; (4) Ar' is
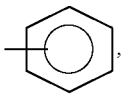

-continued

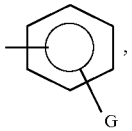

or

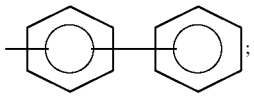

(5) X is

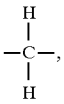

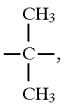

$-O-$, $-S-$,

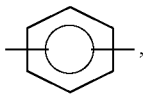

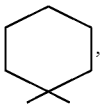

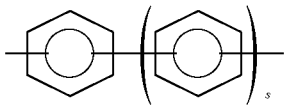

wherein s is 0, 1, or 2,

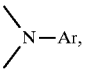

or

-continued

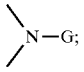

and (6) q is 0 or 1; or mixtures thereof, wherein at least some of the "B" groups are of the formula

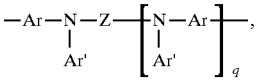

C is

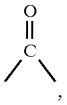

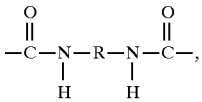

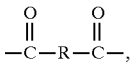

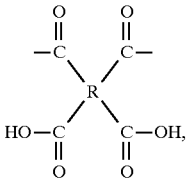

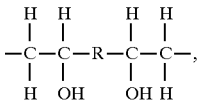

or mixtures thereof, wherein R is an alkyl group, an aryl group, an arylalkyl group, or mixtures thereof, and m and n are integers representing the number of repeating units.

Copending application U.S. Ser. No. (not yet assigned; Attorney Docket No. D/96194Q2, filed concurrently herewith, with the named inventors Timothy J. Fuller, Leon A. Teuscher, Damodar M. Pai, John F. Yanus, Kathleen M. Carmichael, Edward F. Grabowski, and Paul F. Zukoski, the disclosure of which is totally incorporated herein by reference, discloses an imaging member which comprises a conductive substrate, a photogenerating material, a charge transport material, and a polymeric binder comprising (a) a first polymer comprising a polycarbonate, and (b) a second polymer of the formula

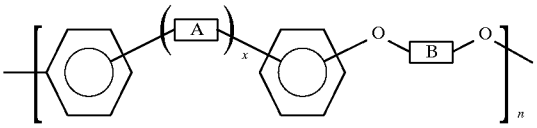

I

-continued
II
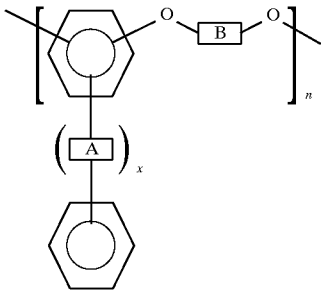
III
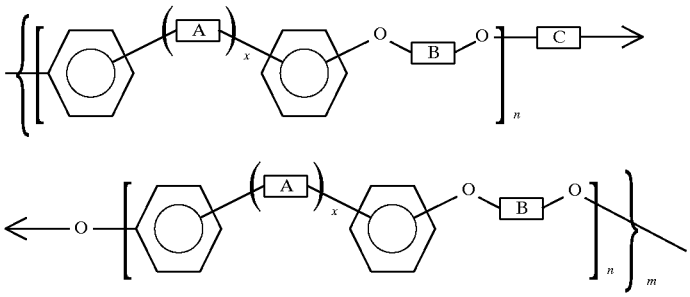
IV
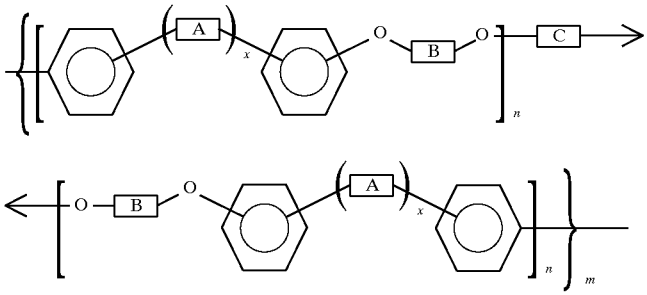
V
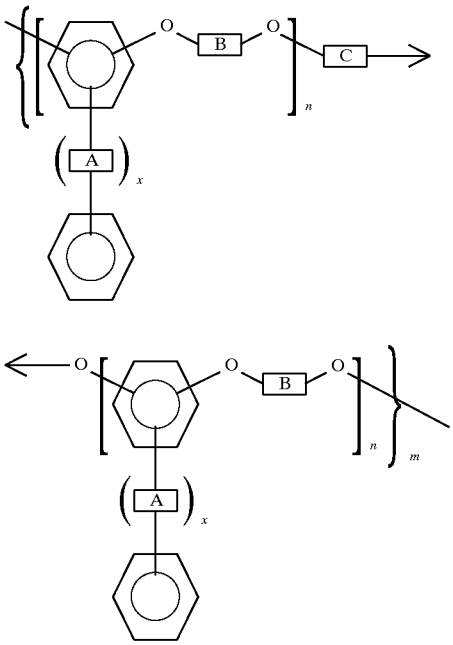

-continued
VI
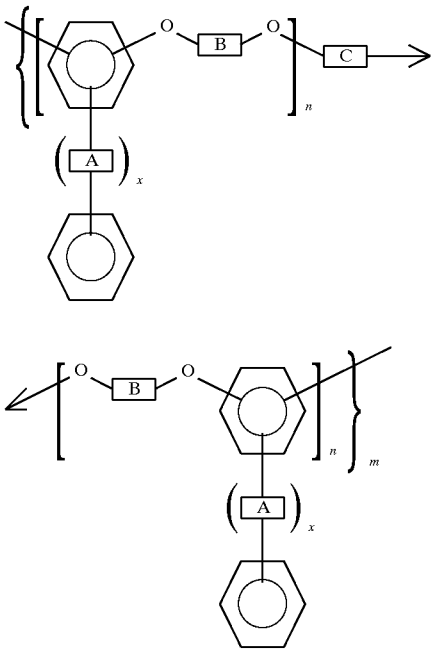
VII
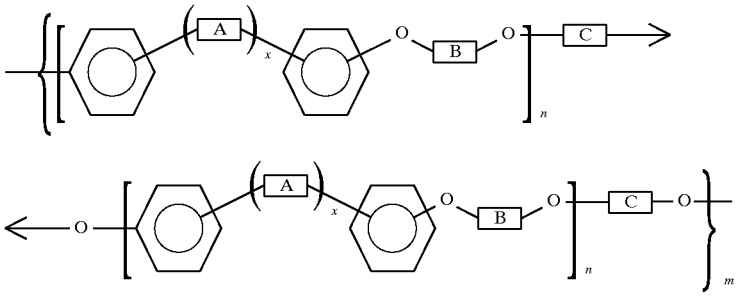
VIII
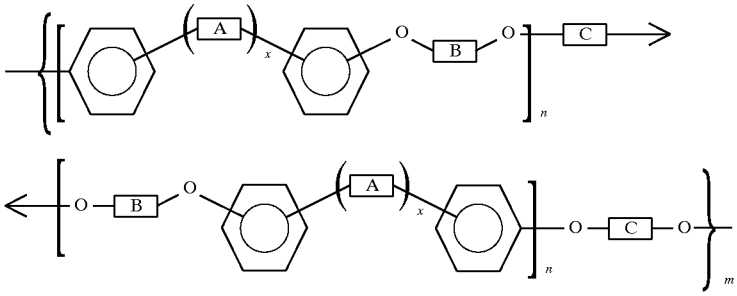
IX
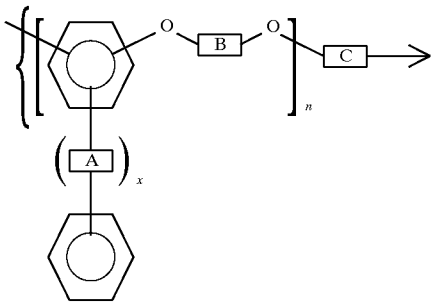

-continued
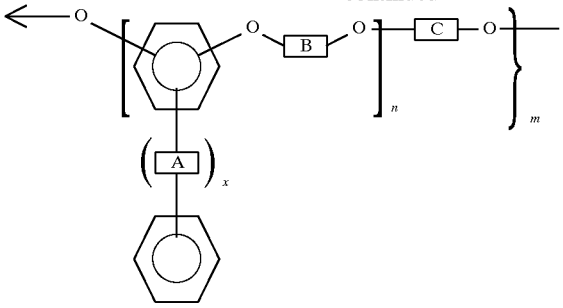
or
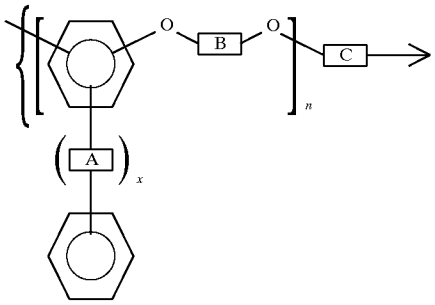
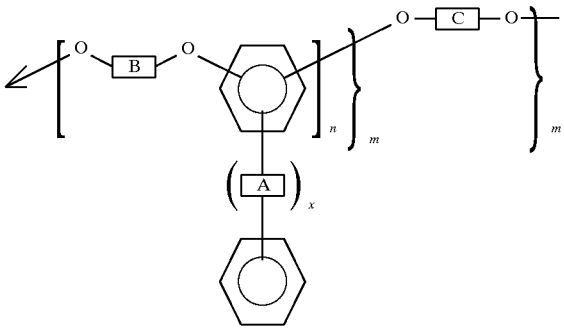
wherein x is an integer of 0 or 1, A is
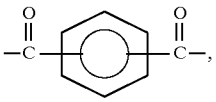
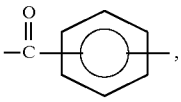
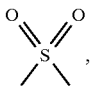
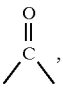
X
-continued
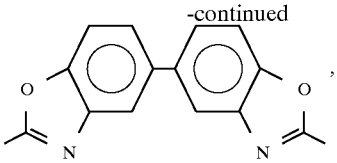
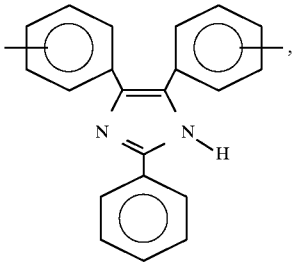
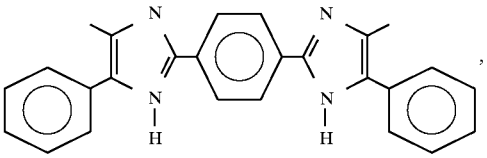

-continued
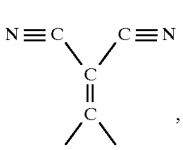
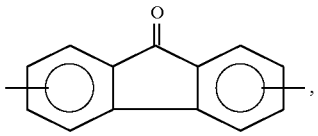
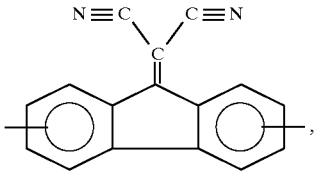
or mixtures thereof, B is
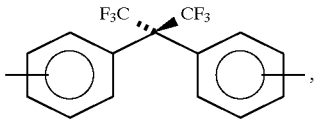
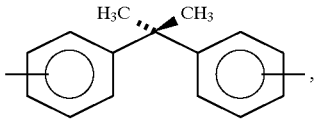
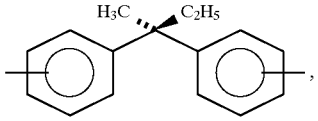
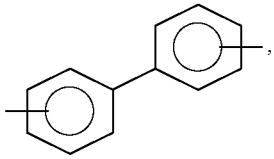
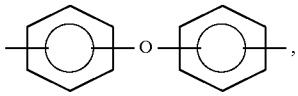
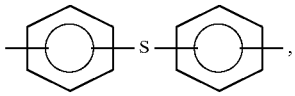
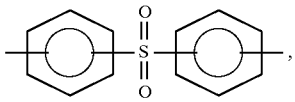
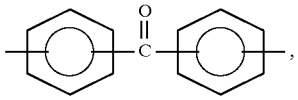
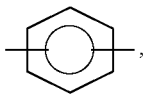
-continued
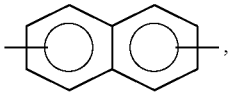
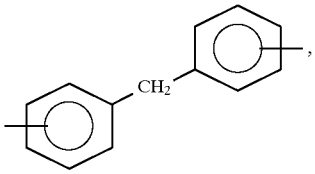
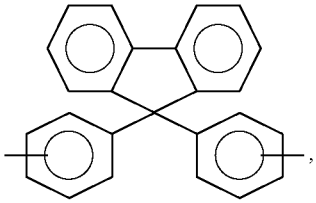
$\leftarrow CH_2 \rightarrow_v$,
wherein v is an integer of from 1 to about 20,
$—(CH_2O)_t—$
wherein t is an integer of from 1 to about 20,
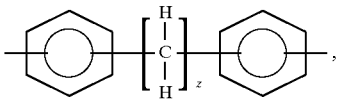
wherein z is an integer of from 2 to about 20,
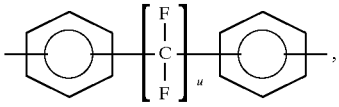
wherein u is an integer of from 1 to about 20,
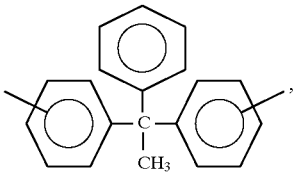
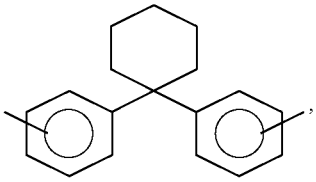
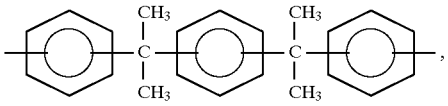
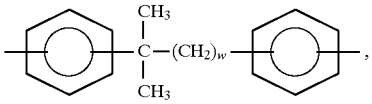

wherein w is an integer of from 1 to about 20,

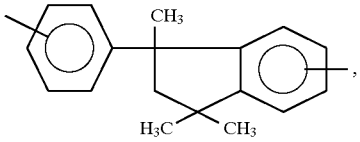

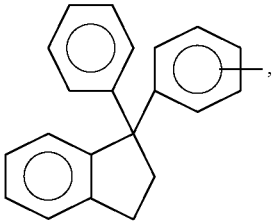

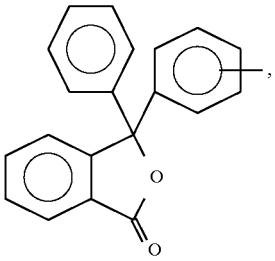

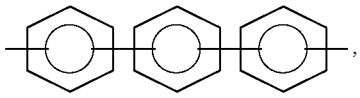

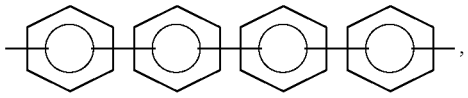

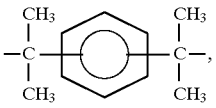

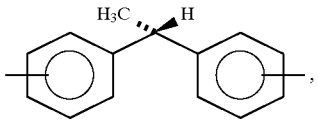

or mixtures thereof, C is

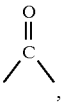

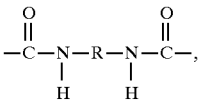

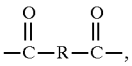

-continued

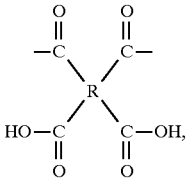

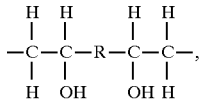

or mixtures thereof, wherein R is an alkyl group, an aryl group, an arylalkyl group, or mixtures thereof, and m and n are integers representing the numbers of repeating units.

While known compositions and processes are suitable for their intended purposes, a need remains for improved photosensitive imaging members. A need also remains for improved binders for photosensitive imaging members. In addition, there is a need for polymeric binders suitable for use in photogenerating layers in imaging members. Further, a need remains for polymeric binders suitable for use in charge transport layers in imaging members. Additionally, there is a need for polymeric binders with high glass transition temperatures. There is also a need for polymeric binders which enable the incorporation of high loadings of charge transport materials and/or plasticizers therein. In addition, a need remains for polymeric binders which exhibit good film properties and good adhesion to imaging member substrates. Further, a need remains for polymeric binders for imaging members which have high resistance to a wide variety of solvents. Additionally, a need remains for polymeric binders suitable for charge transport layers in imaging members which enable incorporation of charge transport materials such as N,N'-diphenyl-N,N'-bis(3"-methylphenyl)-(1,1'-biphenyl)-4,4'-diamine in the layer in amounts of 50 percent by weight and higher without resulting in severe plasticization. There is also a need for polymeric binders which can be coated onto photosensitive imaging members from a wide variety of solvents. Further, a need remains for polymeric binders in which charge transport molecules exhibit reduced or eliminated tendency to crystallize. In addition, there is a need for polymeric binders which have a reduced tendency to crystallize compared to widely used photoreceptor binder polymers. There is also a need for abrasion resistant and wear resistant photoconductive imaging members. Further, there is a need for photoconductive imaging members which are flat after oven drying. Additionally, there is a need for polymeric binders and transport polymers with improved wear and abrasion resistance compared to known polymers commonly used in photoconductive imaging members. A need also remains for photoconductive imaging members which are curl-free and stress-free after removal of coating solvents. In addition, a need remains for polymers suitable for use as adhesive layer materials in photoconductive imaging members. Further, a need remains for polymers suitable for use as protective overcoating layer materials in photoconductive imaging members.

SUMMARY OF THE INVENTION

It is an object of the present invention to provide improved photosensitive imaging members with the above noted advantages.

It is another object of the present invention to provide improved binders for photosensitive imaging members.

It is yet another object of the present invention to provide polymeric binders suitable for use in photogenerating layers in imaging members.

It is still another object of the present invention to provide polymeric binders suitable for use in charge transport layers in imaging members.

Another object of the present invention is to provide polymeric binders with high glass transition temperatures.

Yet another object of the present invention is to provide polymeric binders which enable the incorporation of high loadings of charge transport materials and/or plasticizers therein.

Still another object of the present invention is to provide polymeric binders which exhibit good film properties and good adhesion to imaging member substrates.

It is another object of the present invention to provide polymeric binders for imaging members which have high resistance to a wide variety of solvents.

It is yet another object of the present invention to provide polymeric binders suitable for charge transport layers in imaging members which enable incorporation of charge transport materials such as N,N'-diphenyl-N,N'-bis(3"-methylphenyl)-(1,1'-biphenyl)-4,4'-diamine in the layer in amounts of 50 percent by weight and higher without resulting in severe plasticization.

It is still another object of the present invention to provide polymeric binders which can be coated onto photosensitive imaging members from a wide variety of solvents.

Another object of the present invention is to provide polymeric binders in which charge transport molecules exhibit reduced or eliminated tendency to crystallize.

Yet another object of the present invention is to provide polymeric binders which have a reduced tendency to crystallize compared to widely used photoreceptor binder polymers.

Still another object of the present invention is to provide abrasion resistant and wear resistant photoconductive imaging members.

It is another object of the present invention to provide photoconductive imaging members which are flat after oven drying.

It is yet another object of the present invention to provide polymeric binders and transport polymers with improved wear and abrasion resistance compared to known polymers commonly used in photoconductive imaging members.

It is still another object of the present invention to provide photoconductive imaging members which are curl-free and stress-free after removal of coating solvents.

Another object of the present invention is to provide polymers suitable for use as adhesive layer materials in photoconductive imaging members.

Yet another object of the present invention is to provide polymers suitable for use as protective overcoating layer materials in photoconductive imaging members.

These and other objects of the present invention (or specific embodiments thereof) can be achieved by providing an imaging member which comprises a conductive substrate, a photogenerating material, and a binder comprising a polymer selected from (a) those of the formulae

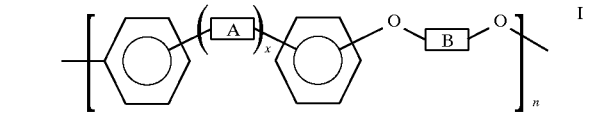

I

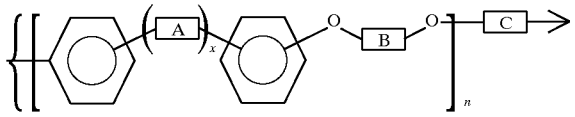

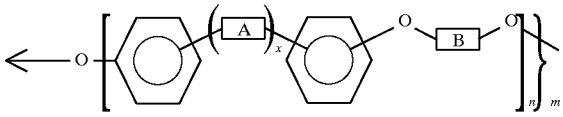

III

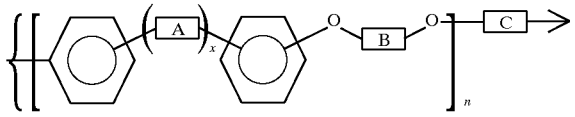

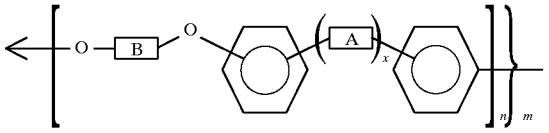

IV

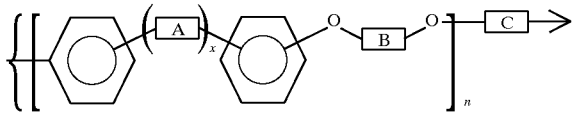

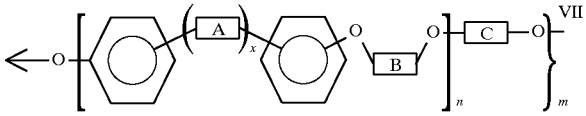

VII or

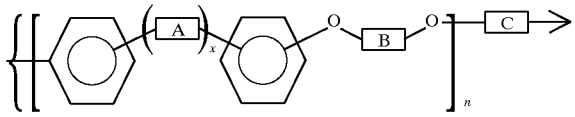

VIII

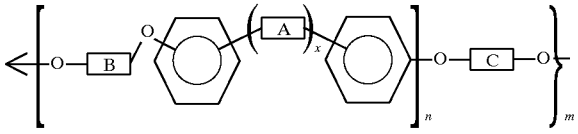

wherein x is an integer of 0 or 1, A is

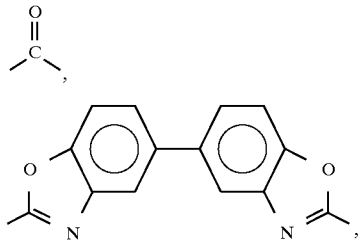

-continued
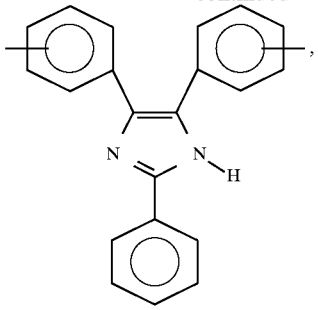
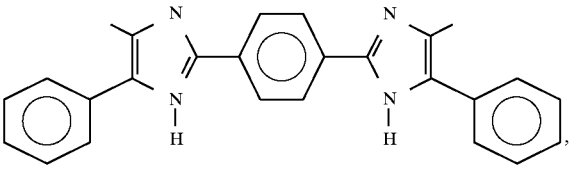
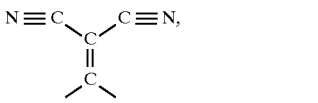
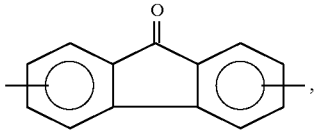
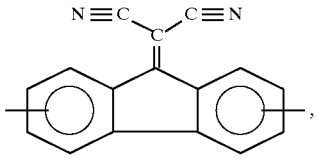
or mixtures thereof, B is
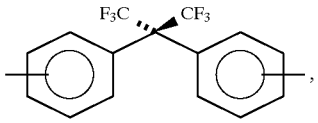
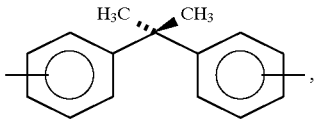
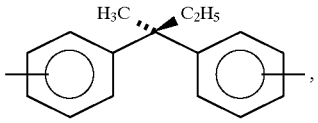
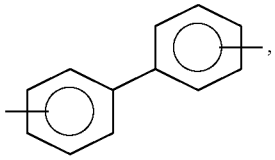
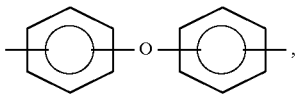
-continued
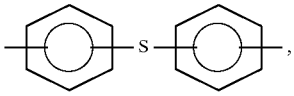
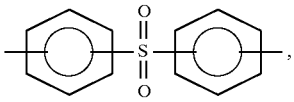
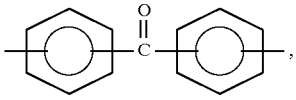
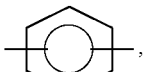
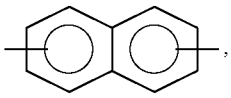
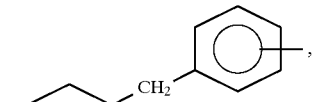
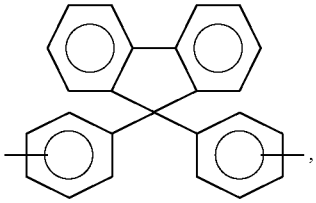
$\text{-}(CH_2)_v\text{-}$,
wherein v is an integer of from 1 to about 20,
$—(CH_2O)_t—$
wherein t is an integer of from 1 to about 20,
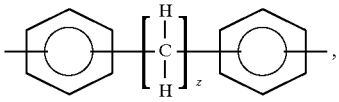
wherein z is an integer of from 2 to about 20,
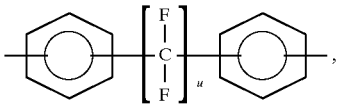
wherein u is an integer of from 1 to about 20,
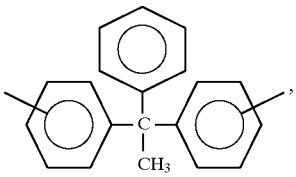

-continued
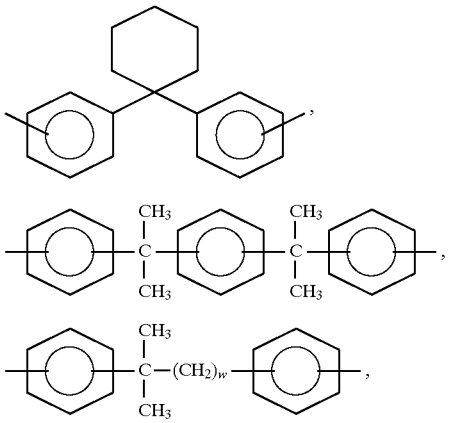
wherein w is an integer of from 1 to about 20,
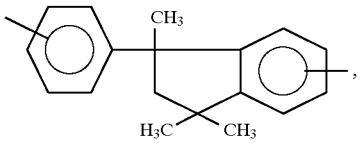
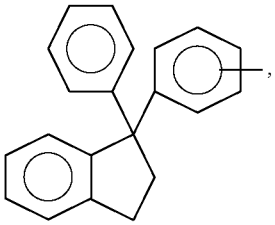
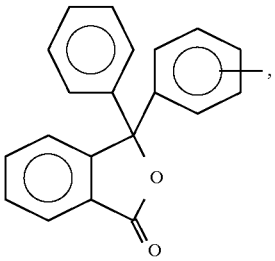
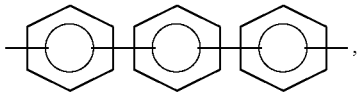
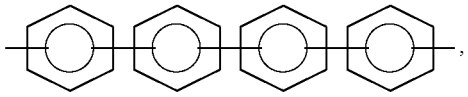
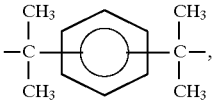
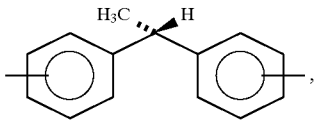
or mixtures thereof, C is
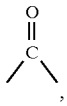
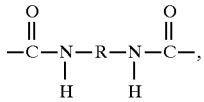
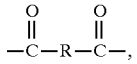
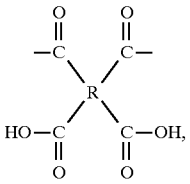
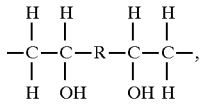
or mixtures thereof, wherein R is an alkyl group, an aryl group, an arylalkyl group, or mixtures thereof, and m and n are integers representing the number of repeating units; (b) those of the formulae
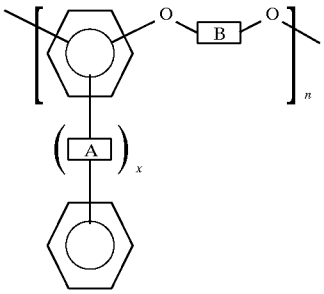
II
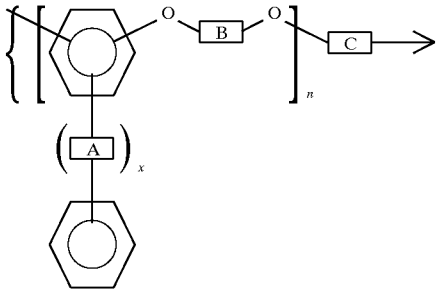
V -continued
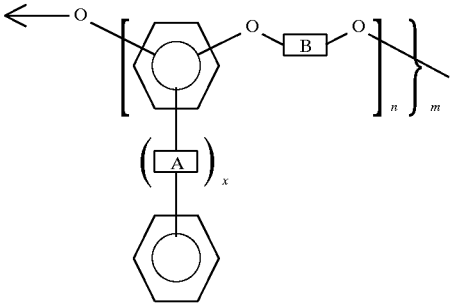
VI
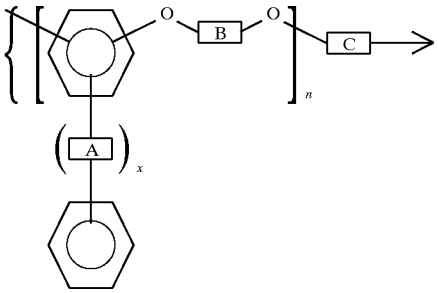
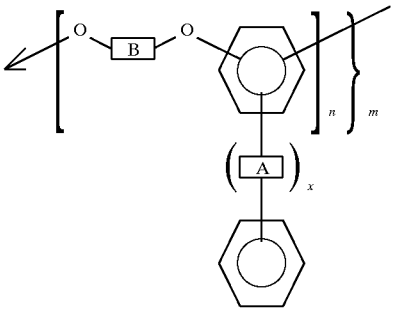
IX
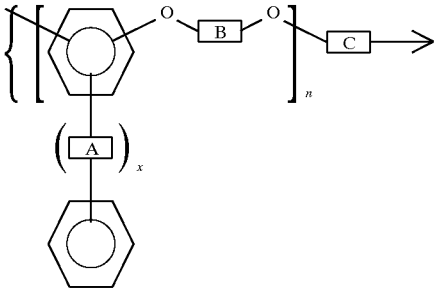
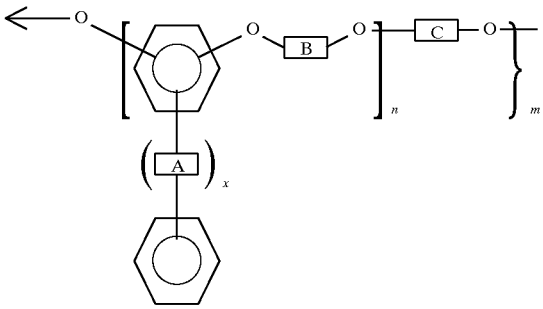
or
-continued
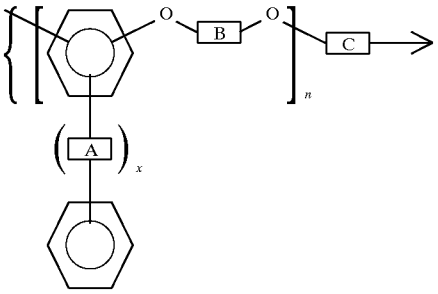
X
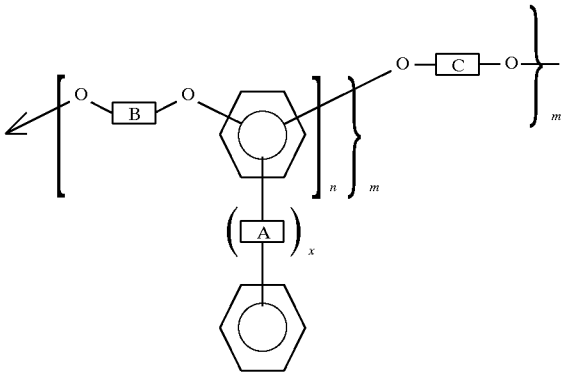
wherein x is an integer of 0 or 1, A is
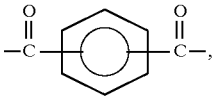
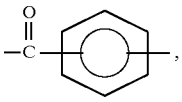
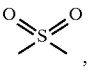
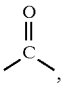
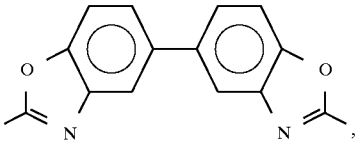
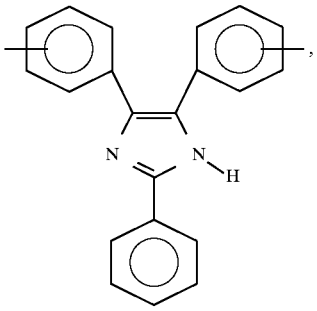

-continued
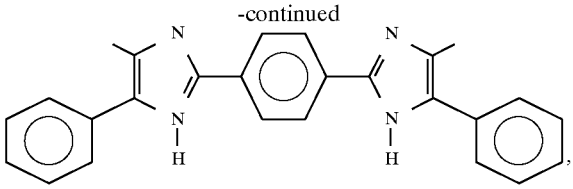
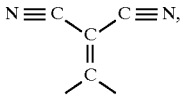
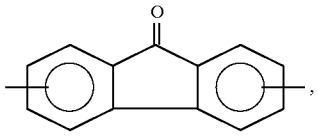
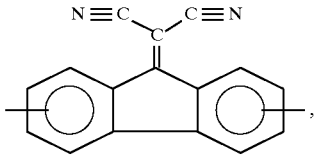
or mixtures thereof, B is
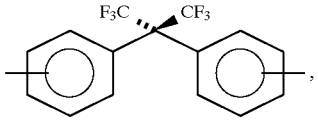
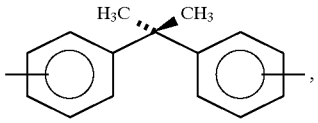
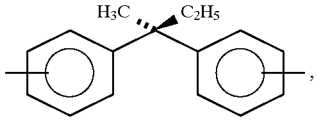
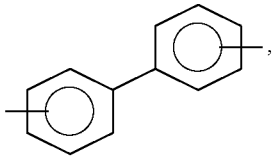
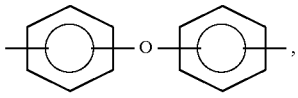
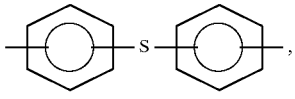
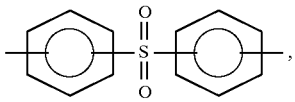
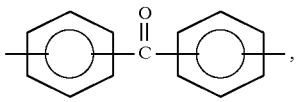
-continued
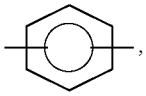
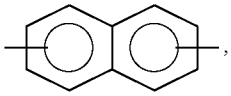
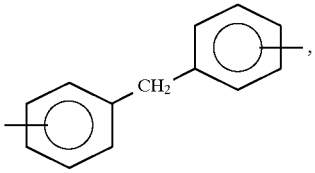
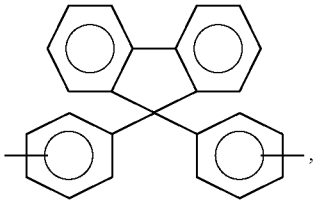
$\text{-}(CH_2)_v\text{-}$,
wherein v is an integer of from 1 to about 20,
$\text{—}(CH_2O)_t\text{—}$
wherein t is an integer of from 1 to about 20,
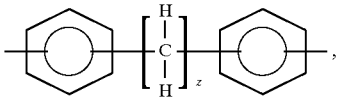
wherein z is an integer of from 2 to about 20,
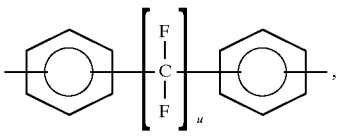
wherein u is an integer of from 1 to about 20,
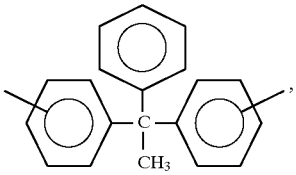
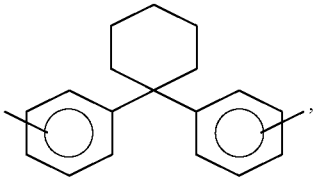
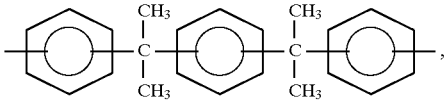

-continued
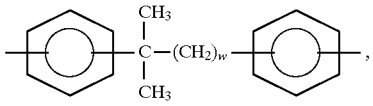
wherein w is an integer of from 1 to about 20,
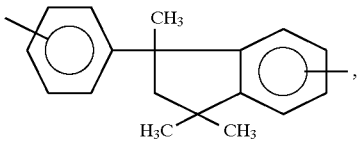
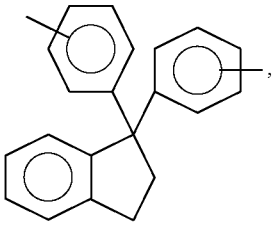
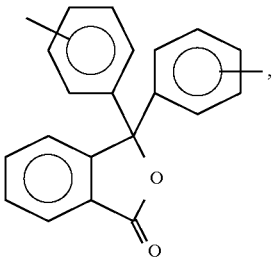
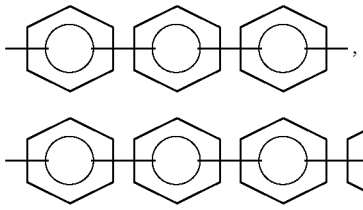
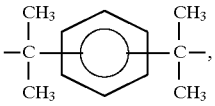
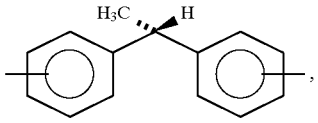
or mixtures thereof, C is
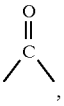
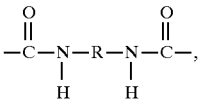
-continued
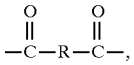
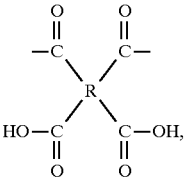
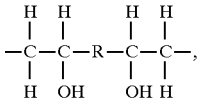
or mixtures thereof, wherein R is an alkyl group, an aryl group, an arylalkyl group, or mixtures thereof, and m and n are integers representing the number of repeating units; (c) those of formulae I, III, IV, VII, or VIII wherein x is an integer of 0 or 1, A is
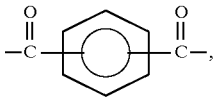
B is
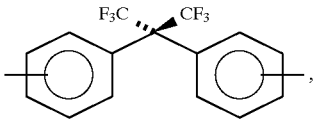
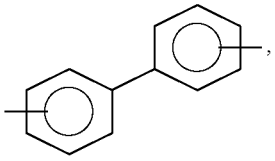
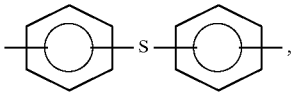
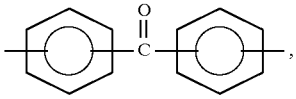
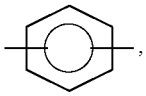
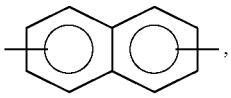

-continued

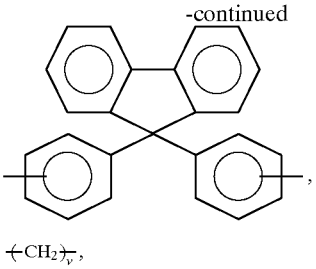

wherein v is an integer of from 1 to about 20, $-(CH_2O)_t-$ wherein t is an integer of from 1 to about 20,

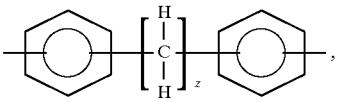

wherein z is an integer of from 2 to about 20,

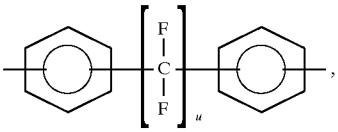

wherein u is an integer of from 1 to about 20,

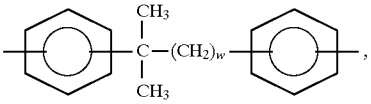

wherein w is an integer of from 1 to about 20,

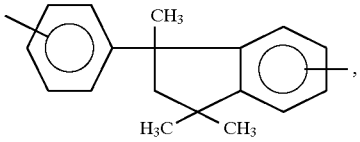

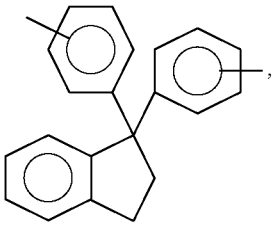

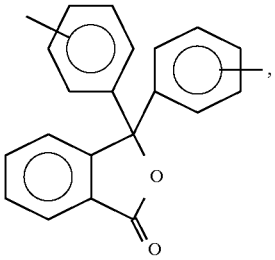

-continued

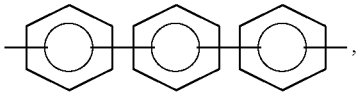

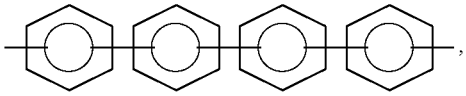

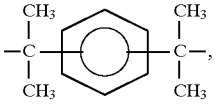

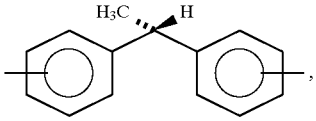

or mixtures thereof, C is

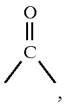

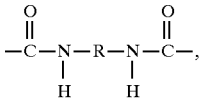

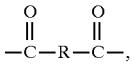

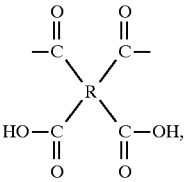

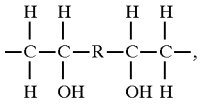

or mixtures thereof, wherein R is an alkyl group, an aryl group, an arylalkyl group, or mixtures thereof, and m and n are integers representing the number of repeating units; (d) those of formulae I, III, IV, VII, and VIII wherein x is an integer of 0 or 1, A is

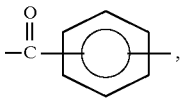

B is

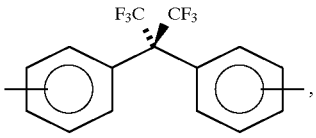

-continued
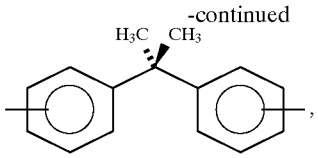
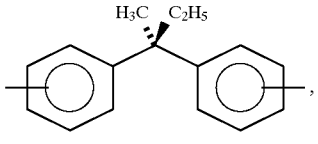
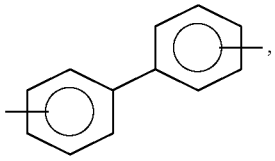
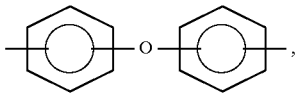
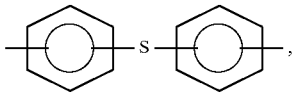
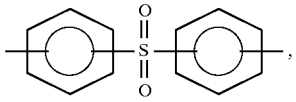
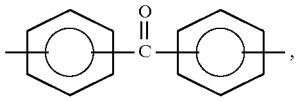
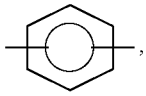
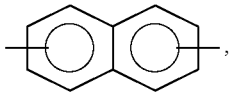
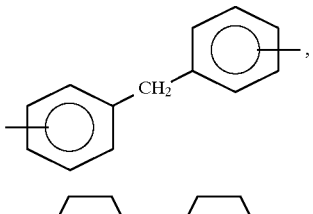
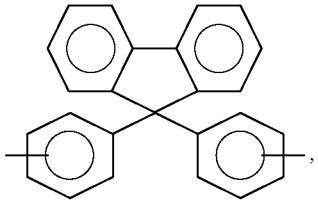
$\leftarrow CH_2 \rightarrow_v$,
wherein v is an integer of from 1 to about 20,
$—(CH_2O)_t—$
wherein t is an integer of from 1 to about 20,
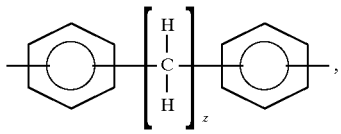
wherein z is an integer of from 2 to about 20,
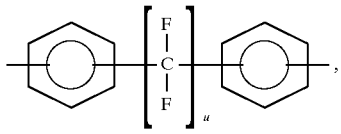
wherein u is an integer of from 1 to about 20,
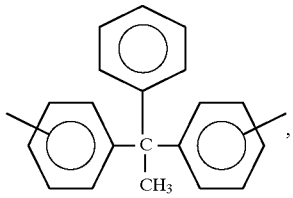
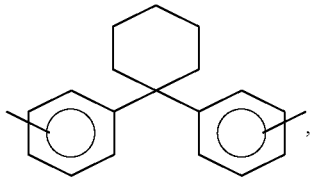
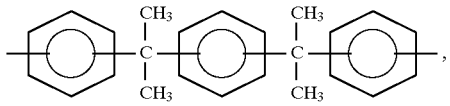
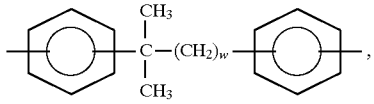
wherein w is an integer of from 1 to about 20,
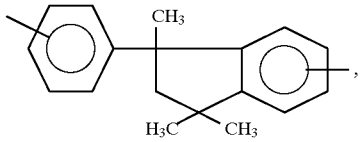
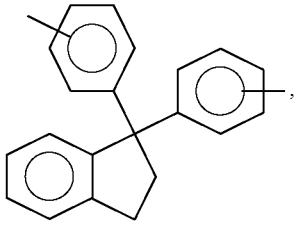

-continued
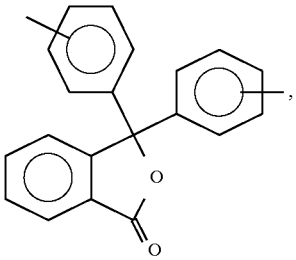
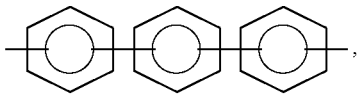
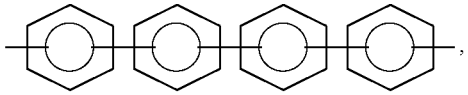
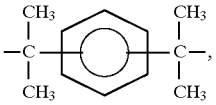
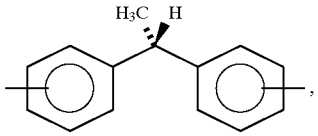
or mixtures thereof, C is
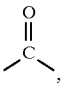
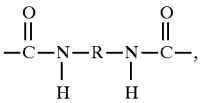
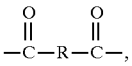
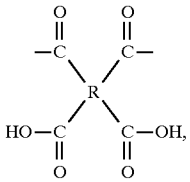
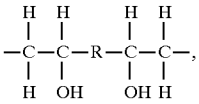
or mixtures thereof, wherein R is an alkyl group, an aryl group, an arylalkyl group, or mixtures thereof, and m and n are integers representing the number of repeating units; or (e) those of formulae I, III, IV, VII, and VIII wherein x is an integer of 0 or 1, A is
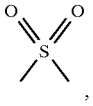
B is
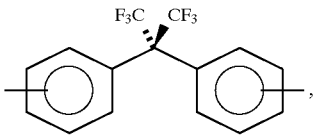
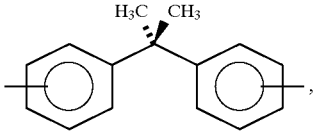
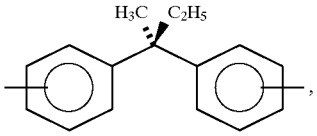
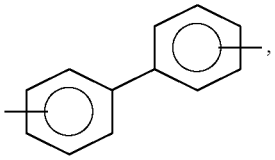
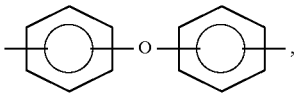
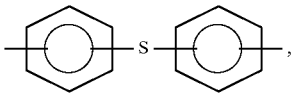
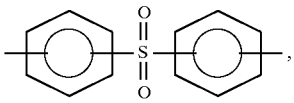
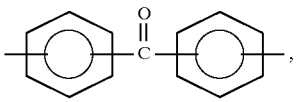
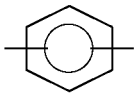
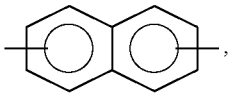
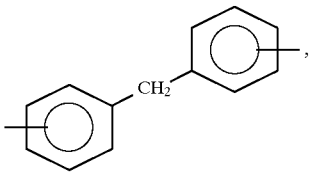

-continued
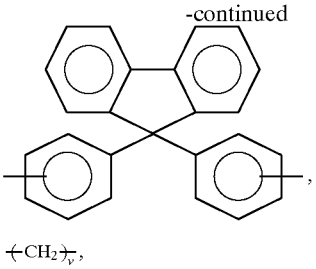
wherein v is an integer of from 1 to about 20,
$—(CH_2O)_t—$
wherein t is an integer of from 1 to about 20,
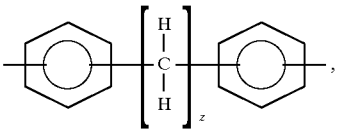
wherein z is an integer of from 2 to about 20,
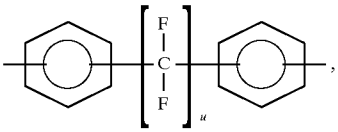
wherein u is an integer of from 1 to about 20,
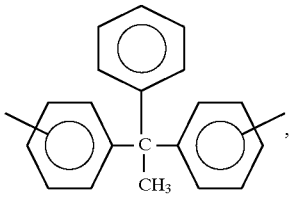
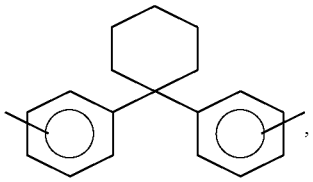
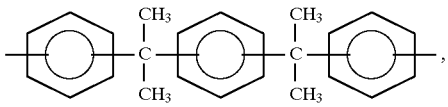
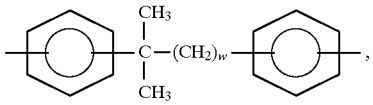
wherein w is an integer of from 1 to about 20,
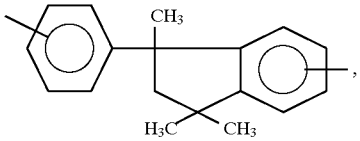
-continued
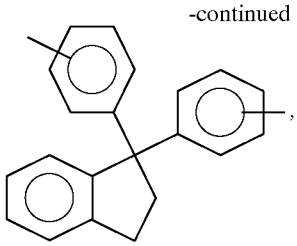
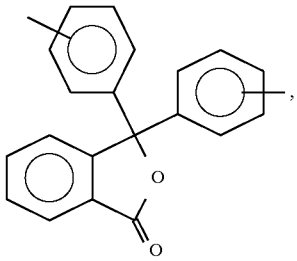
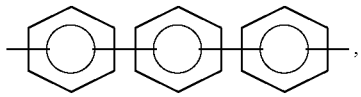
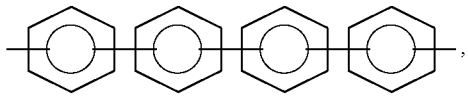
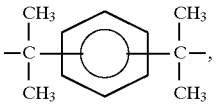
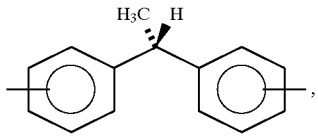
or mixtures thereof, C is
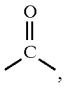
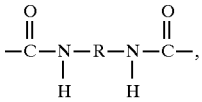
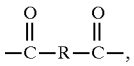
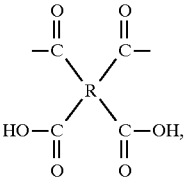
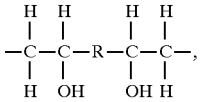

or mixtures thereof, wherein R is an alkyl group, an aryl group, an arylalkyl group, or mixtures thereof, and m and n are integers representing the number of repeating units.

DETAILED DESCRIPTION OF THE INVENTION

Figure 1:
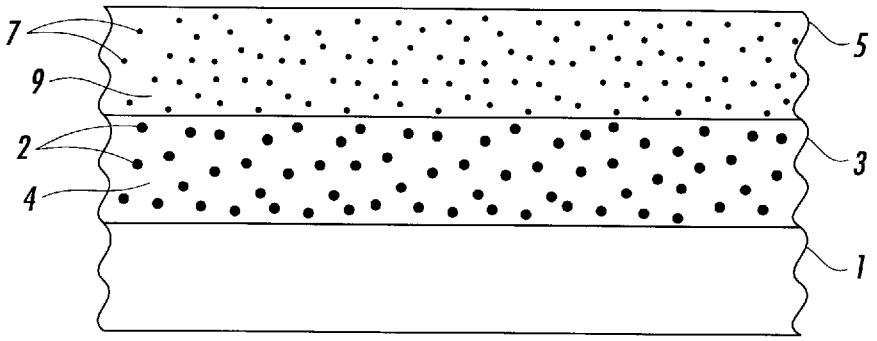
FIGS. 1, 2, 3, and 4 are schematic cross-sectional views of examples of photoconductive imaging members of the present invention.

FIG. 1 illustrates schematically one embodiment of the imaging members of the present invention. Specifically, FIG. 1 shows a photoconductive imaging member comprising a conductive substrate 1, a photogenerating layer 3 comprising a photogenerating compound 2 dispersed in a resinous binder composition 4, and a charge transport layer 5, which comprises a charge transporting molecule 7 dispersed in a resinous binder composition 9. At least one of the resinous binder compositions 4 and 9 comprises a polymer of the specific formulae indicated herein.

Figure 2:
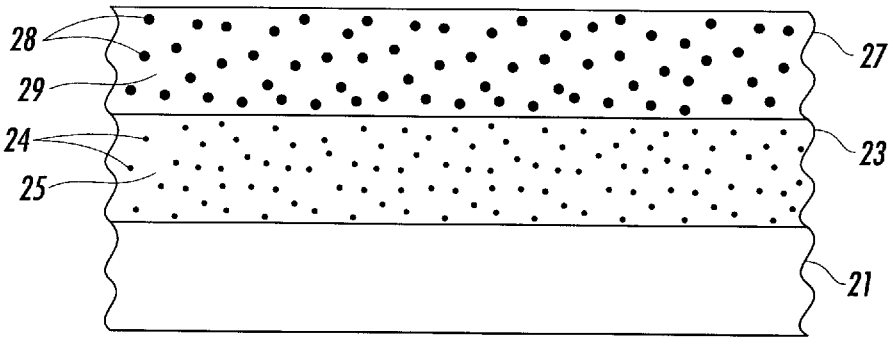

FIG. 2 illustrates schematically essentially the same member as that shown in FIG. 1 with the exception that the charge transport layer is situated between the conductive substrate and the photogenerating layer. More specifically, FIG. 2 illustrates a photoconductive imaging member comprising a conductive substrate 21, a charge transport layer 23 comprising a charge transport composition 24 dispersed in a resinous binder composition 25, and a photogenerating layer 27 comprising a photogenerating compound 28 dispersed in a resinous binder composition 29. At least one of the resinous binder compositions 25 and 29 comprises a polymer of the specific formulae indicated herein.

Figure 3:
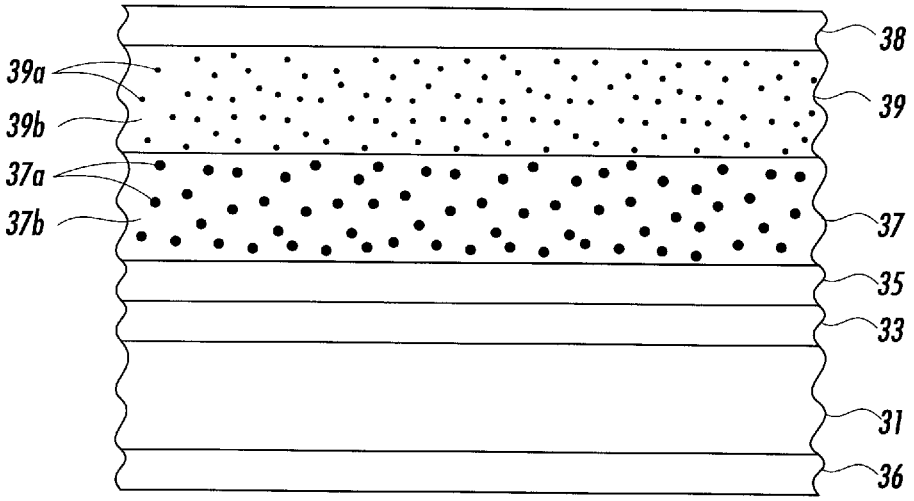

FIG. 3 illustrates schematically a photoconductive imaging member of the present invention comprising a conductive substrate 31, an optional charge blocking metal oxide layer 33, an optional adhesive layer 35, a photogenerating layer 37 comprising a photogenerating compound 37*a* dispersed in a resinous binder composition 37*b*, a charge transport layer 39 comprising a charge transport compound 39*a* dispersed in a resinous binder 39*b*, an optional anticurl backing layer 36, and an optional protective overcoating layer 38. At least one of the layers 35, 36, 37, 38, and 39 comprises a polymer of the specific formulae indicated herein.

Figure 4:
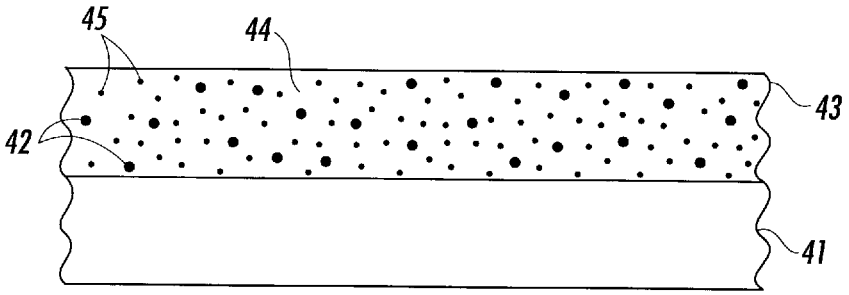

FIG. 4 illustrates schematically a photoconductive imaging member of the present invention comprising a conductive substrate 41 and a photogenerating layer 43 comprising a photogenerating compound 42 dispersed in a resinous binder composition 44. Resinous binder composition 44 comprises a polymer of the specific formulae indicated herein. Optionally, a charge transport material 45 can also be dispersed in binder 44.

The substrate can be formulated entirely of an electrically conductive material, or it can be an insulating material having an electrically conductive surface. The substrate is of an effective thickness, generally up to about 100 mils, and preferably from about 1 to about 50 mils, although the thickness can be outside of this range. The thickness of the substrate layer depends on many factors, including economic and mechanical considerations. Thus, this layer may be of substantial thickness, for example over 100 mils, or of minimal thickness provided that there are no adverse effects on the system. Similarly, the substrate can be either rigid or flexible. In a particularly preferred embodiment, the thickness of this layer is from about 3 mils to about 10 mils. For flexible belt imaging members, preferred substrate thicknesses are from about 65 to about 150 microns, and more preferably from about 75 to about 100 microns for optimum flexibility and minimum stretch when cycled around small diameter rollers of, for example, 19 millimeter diameter.

The substrate can be opaque or substantially transparent and can comprise numerous suitable materials having the desired mechanical properties. The entire substrate can comprise the same material as that in the electrically conductive surface or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, halfnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The conductive layer can vary in thickness over substantially wide ranges depending on the desired use of the electrophotoconductive member. Generally, the conductive layer ranges in thickness from about 50 Angstroms to many centimeters, although the thickness can be outside of this range. When a flexible electrophotographic imaging member is desired, the thickness of the conductive layer typically is from about 20 Angstroms to about 750 Angstroms, and preferably from about 100 to about 200 Angstroms for an optimum combination of electrical conductivity, flexibility, and light transmission. When the selected substrate comprises a nonconductive base and an electrically conductive layer coated thereon, the substrate can be of any other conventional material, including organic and inorganic materials. Typical substrate materials include insulating non-conducting materials such as various resins known for this purpose including polycarbonates, polyamides, polyurethanes, paper, glass, plastic, polyesters such as Mylar (available from Du Pont) or Melinex 447 (available from ICI Americas, Inc.), and the like. The conductive layer can be coated onto the base layer by any suitable coating technique, such as vacuum deposition or the like. If desired, the substrate can comprise a metallized plastic, such as titanized or aluminized Mylar, wherein the metallized surface is in contact with the photogenerating layer or any other layer situated between the substrate and the photogenerating layer. The coated or uncoated substrate can be flexible or rigid, and can have any number of configurations, such as a plate, a cylindrical drum, a scroll, an endless flexible belt, or the like. The outer surface of the substrate may comprise a metal oxide such as aluminum oxide, nickel oxide, titanium oxide, or the like.

The photoconductive imaging member may optionally contain a charge blocking layer situated between the conductive substrate and the photogenerating layer. Generally, electron blocking layers for positively charged photoreceptors allow holes from the imaging surface of the photoreceptor to migrate toward the conductive layer, while hole blocking layers for negatively charged photoreceptors allow electrons from the imaging surface of the photoreceptor to migrate toward the conductive layer. This layer may comprise metal oxides, such as aluminum oxide and the like, or materials such as silanes and nylons, nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino) titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl)methyl diethoxysilane, and $[H_2N(CH_2)_3]CH_3Si(OCH_3)_2$ (gamma-aminopropyl)methyl diethoxysilane, as disclosed in U.S. Pat. Nos. 4,291,110, 4,338,387, 4,286,033 and 4,291,110, the disclosures of each of which are totally incorporated herein by reference, or the like. Additional examples of suitable materials include gelatin (e.g. Gelatin 225, available from Knox Gelatine Inc.), and/or Carboset 515 (B. F. Goodrich Chemical Company) dissolved in water and methanol, polyvinyl alcohol, polyamides, gamma-aminopropyl triethoxysilane, polyisobutyl methacrylate, copolymers of styrene and acrylates such as styrene/n-butyl methacrylate, copolymers of styrene and vinyl toluene, polycarbonates, alkyl substituted polystyrenes, styrene-olefin copolymers, polyesters, polyurethanes, polyterpenes, silicone elastomers, mixtures or blends thereof, copolymers thereof, and the like. A preferred blocking layer comprises a reaction product between a hydrolyzed silane and the oxidized surface of a metal ground plane layer. The oxidized surface inherently forms on the outer surface of most metal ground plane layers when exposed to air after deposition. The primary purpose of this layer is to prevent charge injection from the substrate during and after charging. This layer is typically of a thickness of less than 50 Angstroms to about 10 microns, preferably being no more than about 2 microns, and more preferably being no more than about 0.2 microns, although the thickness can be outside this range.

The blocking layer may be applied by any suitable conventional technique such as spraying, dip coating, draw bar coating, gravure coating, silk screening, air knife coating, reverse roll coating, vacuum deposition, chemical treatment or the like. For convenience in obtaining thin layers, the blocking layers are preferably applied in the form of a dilute solution, with the solvent being removed after deposition of the coating by conventional techniques such as by vacuum, heating and the like.

In some cases, intermediate adhesive layers between the substrate and subsequently applied layers may be desirable to improve adhesion. If such adhesive layers are utilized, they preferably have a dry thickness of from about 0.1 micron to about 5 microns, although the thickness can be outside of this range. Typical adhesive layers include film-forming polymers such as polyesters, polyvinylbutyrals, polyvinylpyrrolidones, polycarbonates, polyurethanes, polymethylmethacrylates, duPont 49,000 (available from E. I. duPont de Nemours and Company), Vitel PE100 (available from Goodyear Tire & Rubber), and the like as well as mixtures thereof. The high performance polymers of the present invention can also be employed in the adhesive layer of the imaging member, either alone or in combination with other materials. Since the surface of the substrate can be a charge blocking layer or an adhesive layer, the expression "substrate" as employed herein is intended to include a charge blocking layer with or without an adhesive layer on a charge blocking layer. Typical adhesive layer thicknesses are from about 0.05 micron (500 angstroms) to about 0.3 micron (3,000 angstroms), although the thickness can be outside this range. Conventional techniques for applying an adhesive layer coating mixture to the substrate include spraying, dip coating, roll coating, wire wound rod coating, gravure coating, Bird bar applicator coating, or the like. Drying of the deposited coating may be effected by any suitable conventional technique, such as oven drying, infra red radiation drying, air drying, or the like.

Optionally improve resistance to a also be utilized to improve resistance to abrasion. In some cases an anticurl back coating may be applied to the surface of the substrate opposite to that bearing the photoconductive layer to provide flatness and/or abrasion resistance where a web configuration photoreceptor is fabricated. These overcoating and anticurl back coating layers are well known in the art, and can comprise thermoplastic organic polymers or inorganic polymers that are electrically insulating or slightly semiconductive. Overcoatings are continuous and typically have a thickness of less than about 10 microns, although the thickness can be outside this range. The thickness of anticurl backing layers generally is sufficient to balance substantially the total forces of the layer or layers on the opposite side of the substrate layer. An example of an anticurl backing layer is described in U.S. Pat. No. 4,654,284, the disclosure of which is totally incorporated herein by reference. A thickness of from about 70 to about 160 microns is a typical range for flexible photoreceptors, although the thickness can be outside this range. Polymers of the formulae indicated hereinbelow are also suitable for use as overcoat layers and anticurl back coating layers.

The photogenerating layer may comprise single or multiple layers comprising inorganic or organic compositions and the like. One example of a generator layer is described in U.S. Pat. No. 3,121,006, the disclosure of which is totally incorporated herein by reference, wherein finely divided particles of a photoconductive inorganic compound are dispersed in an electrically insulating organic resin binder. Multi-photogenerating layer compositions may be utilized where a photoconductive layer enhances or reduces the properties of the photogenerating layer. Examples of this type of configuration are described in U.S. Pat. No. 4,415,639, the disclosure of which is totally incorporated herein by reference. Further examples of photosensitive members having at least two electrically operative layers include the charge generator layer and diamine containing transport layer members disclosed in U.S. Pat. No. 4,265,990, U.S. Pat. No. 4,233,384, U.S. Pat. No. 4,306,008, and U.S. Pat. No. 4,299,897, the disclosures of each of which are totally incorporated herein by reference; dyestuff generator layer and oxadiazole, pyrazalone, imidazole, bromopyrene, nitrofluorene and nitronaphthalimide derivative containing charge transport layers members, as disclosed in U.S. Pat. No. 3,895,944, the disclosure of which is totally incorporated herein by reference; generator layer and hydrazone containing charge transport layers members, disclosed in U.S. Pat. No. 4,150,987, the disclosure of which is totally incorporated herein by reference; generator layer and a tri-aryl pyrazoline compound containing charge transport layer members, as disclosed in U.S. Pat. No. 3,837,851, the disclosure of which is totally incorporated herein by reference; and the like.

The photogenerating or photoconductive layer contains any desired or suitable photoconductive material. The photoconductive layer or layers may contain inorganic or organic photoconductive materials. Typical inorganic photoconductive materials include amorphous selenium, trigonal selenium, alloys of selenium with elements such as tellurium, arsenic, and the like, amorphous silicon, cadmium sulfoselenide, cadmium selenide, cadmium sulfide, zinc oxide, titanium dioxide and the like. Inorganic photoconductive materials can, if desired, be dispersed in a film forming polymer binder.

Typical organic photoconductors include various phthalocyanine pigments, such as the X-form of metal free phthalocyanine described in U.S. Pat. No. 3,357,989, the disclosure of which is totally incorporated herein by reference, metal phthalocyanines such as vanadyl phthalocyanine, copper phthalocyanine, and the like, quinacridones, including those available from DuPont as Monastral Red, Monastral Violet and Monastral Red Y, substituted 2,4-diamino-triazines as disclosed in U.S. Pat. No. 3,442,781, the disclosure of which is totally incorporated herein by reference, polynuclear aromatic quinones, Indofast Violet Lake B, Indofast Brilliant Scarlet, Indofast Orange, dibromoanthanthrones such as those available from DuPont as Vat orange 1 and Vat orange 3, squarylium, pyrazolones, polyvinylcarbazole-2,4,7-trinitrofluorenone, anthracene, benzimidazole perylene, polynuclear aromatic quinones available from Allied Chemical Corporation under the tradename Indofast Double Scarlet, Indofast Violet Lake B, Indofast Brilliant Scarlet and Indofast Orange, and the like. Many organic photoconductor materials may also be used as particles dispersed in a resin binder.

Examples of suitable binders for the photoconductive materials include thermoplastic and thermosetting resins such as polycarbonates, polyesters, including polyethylene terephthalate, polyurethanes, polystyrenes, polybutadienes, polysulfones, polyarylethers, polyarylsulfones, polyethersulfones, polyethylenes, polypropylenes, polymethylpentenes, polyphenylene sulfides, polyvinyl acetates, polyvinylbutyrals, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchlorides, polyvinyl alcohols, poly(N-vinylpyrrolidinone)s, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like. These polymers may be block, random or alternating copolymers. The high performance polymers of the present invention can also be employed in the photoconductive layer of the imaging member, either alone or in combination with other materials.

When the photogenerating material is present in a binder material, the photogenerating composition or pigment may be present in the film forming polymer binder compositions in any suitable or desired amounts. For example, from about 10 percent by volume to about 60 percent by volume of the photogenerating pigment may be dispersed in about 40 percent by volume to about 90 percent by volume of the film forming polymer binder composition, and preferably from about 20 percent by volume to about 30 percent by volume of the photogenerating pigment may be dispersed in about 70 percent by volume to about 80 percent by volume of the film forming polymer binder composition. Typically, the photoconductive material is present in the photogenerating layer in an amount of from about 5 to about 80 percent by weight, and preferably from about 25 to about 75 percent by weight, and the binder is present in an amount of from about 20 to about 95 percent by weight, and preferably from about 25 to about 75 percent by weight, although the relative amounts can be outside these ranges.

The particle size of the photoconductive compositions and/or pigments preferably is less than the thickness of the deposited solidified layer, and more preferably is between about 0.01 micron and about 0.5 micron to facilitate better coating uniformity.

The photogenerating layer containing photoconductive compositions and the resinous binder material generally ranges in thickness from about 0.05 micron to about 10 microns or more, preferably being from about 0.1 micron to about 5 microns, and more preferably having a thickness of from about 0.3 micron to about 3 microns, although the thickness can be outside these ranges. The photogenerating layer thickness is related to the relative amounts of photogenerating compound and binder, with the photogenerating material often being present in amounts of from about 5 to about 100 percent by weight. Higher binder content compositions generally require thicker layers for photogeneration. Generally, it is desirable to provide this layer in a thickness sufficient to absorb about 90 percent or more of the incident radiation which is directed upon it in the imagewise or printing exposure step. The maximum thickness of this layer is dependent primarily upon factors such as mechanical considerations, specific photogenerating compound selected, the thicknesses of the other layers, and whether a flexible photoconductive imaging member is desired.

The photogenerating layer can be applied to underlying layers by any desired or suitable method. Any suitable technique may be utilized to mix and thereafter apply the photogenerating layer coating mixture. Typical application techniques include spraying, dip coating, roll coating, wire wound rod coating, and the like. Drying of the deposited coating may be effected by any suitable technique, such as oven drying, infra red radiation drying, air drying and the like.

Any other suitable multilayer photoconductors may also be employed in the imaging member of this invention. Some multilayer photoconductors comprise at least two electrically operative layers, a photogenerating or charge generating layer and a charge transport layer. The charge generating layer and charge transport layer as well as the other layers may be applied in any suitable order to produce either positive or negative charging photoreceptors. For example, the charge generating layer may be applied prior to the charge transport layer, as illustrated in U.S. Pat. No. 4,265,990, or the charge transport layer may be applied prior to the charge generating layer, as illustrated in U.S. Pat. No. 4,346,158, the entire disclosures of these patents being incorporated herein by reference.

When present, the optional charge transport layer can comprise any suitable charge transport material. The active charge transport layer may consist entirely of the desired charge transport material, or may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough, thereby converting the electrically inactive polymeric material to a material capable of supporting the injection of photogenerated holes from the generation material and capable of allowing the transport of these holes through the active layer in order to discharge the surface charge on the active layer. An especially preferred transport layer comprises from about 25 percent to about 75 percent by weight of at least one charge transporting compound, and from about 75 percent to about 25 percent by weight of a polymeric film forming resin in which the aromatic amine is soluble.

Examples of charge transport materials include pure selenium, selenium-arsenic alloys, selenium-arsenic-halogen alloys, selenium-halogen, and the like. Generally, from about 10 parts by weight per million to about 200 parts by weight per million of halogen are present in a halogen doped selenium charge transport layer, although the amount can be outside of this range. If a halogen doped transport layer free of arsenic is utilized, the halogen content preferably is less than about 20 parts by weight per million. Transport layers are well known in the art. Typical transport layers are described, for example, in U.S. Pat. No. 4,609,605 and in U.S. Pat. No. 4,297,424, the disclosures of each of these patents being totally incorporated herein by reference.

Organic charge transport materials can also be employed. Typical charge transporting materials include the following:

Diamine transport molecules of the type described in U.S. Pat. No. 4,306,008, U.S. Pat. No. 4,304,829, U.S. Pat. No. 4,233,384, U.S. Pat. No. 4,115,116, U.S. Pat. No. 4,299,897, U.S. Pat. No. 4,265,990, and U.S. Pat. No. 4,081,274, the disclosures of each of which are totally incorporated herein by reference. Typical diamine transport molecules include N,N'-diphenyl-N,N'-bis(3"-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-(1,1'-biphenyl)-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. No. 4,315,982, U.S. Pat. No. 4,278,746, and U.S. Pat. No. 3,837,851, the disclosures of each of which are totally incorporated herein by reference. Typical pyrazoline transport molecules include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl)pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)pyrazoline, and the like.

Substituted fluorene charge transport molecules as described in U.S. Pat. No. 4,245,021, the disclosure of which is totally incorporated herein by reference. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene, 2-nitro-9-(4'-diethylaminobenzylidene)fluorene, and the like.

Oxadiazole transport molecules such as 2,5-bis(4-diethylaminophenyl)-1,3,4-oxadiazole, pyrazoline, imidazole, triazole, and the like. Other typical oxadiazole transport molecules are described, for example, in German Patent 1,058,836, German Patent 1,060,260, and German Patent 1,120,875, the disclosures of each of which are totally incorporated herein by reference.

Hydrazone transport molecules, such as p-diethylamino benzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), 1-naphthalenecarbaldehyde 1-methyl-1-phenylhydrazone, 1-naphthalenecarbaldehyde 1,1-phenylhydrazone, 4-methoxynaphthlene-1-carbaldeyde 1-methyl-1-phenylhydrazone, and the like. Other typical hydrazone transport molecules are described, for example in U.S. Pat. No. 4,150,987, U.S. Pat. No. 4,385,106, U.S. Pat. No. 4,338,388, and U.S. Pat. No. 4,387,147, the disclosures of each of which are totally incorporated herein by reference.

Carbazole phenyl hydrazone transport molecules such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and the like. Other typical carbazole phenyl hydrazone transport molecules are described, for example, in U.S. Pat. No. 4,256,821 and U.S. Pat. No. 4,297,426, the disclosures of each of which are totally incorporated herein by reference.

Vinyl-aromatic polymers such as polyvinyl anthracene, polyacenaphthylene; formaldehyde condensation products with various aromatics such as condensates of formaldehyde and 3-bromopyrene; 2,4,7-trinitrofluorenone, and 3,6-dinitro-N-t-butylnaphthalimide as described, for example, in U.S. Pat. No. 3,972,717, the disclosure of which is totally incorporated herein by reference.

Oxadiazole derivatives such as 2,5-bis-(p-diethylaminophenyl)-oxadiazole-1,3,4 described in U.S. Pat. No. 3,895,944, the disclosure of which is totally incorporated herein by reference.

Tri-substituted methanes such as alkyl-bis(N,N-dialkylaminoaryl)methane, cycloalkyl-bis(N,N-dialkylaminoaryl)methane, and cycloalkenyl-bis(N,N-dialkylaminoaryl)methane as described in U.S. Pat. No. 3,820,989, the disclosure of which is totally incorporated herein by reference.

9-Fluorenylidene methylene derivatives having the formula

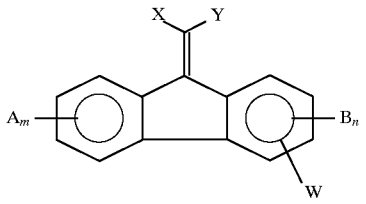

wherein X and Y are cyano groups or alkoxycarbonyl groups; A, B, and W are electron withdrawing groups independently selected from the group consisting of acyl, alkoxycarbonyl, nitro, alkylaminocarbonyl, and derivatives thereof; m is a number of from 0 to 2; and n is the number 0 or 1 as described in U.S. Pat. No. 4,474,865, the disclosure of which is totally incorporated herein by reference. Typical 9-fluorenylidene methylene derivatives encompassed by the above formula include (4-n-butoxycarbonyl-9-fluorenylidene)malononitrile, (4-phenethoxycarbonyl-9-fluorenylidene)malononitrile, (4-carbitoxy-9-fluorenylidene)malononitrile, (4-n-butoxycarbonyl-2,7-dinitro-9-fluorenylidene)malonate, and the like.

Other charge transport materials include poly-1-vinylpyrene, poly-9-vinylanthracene, poly-9-(4-pentenyl)-carbazole, poly-9-(5-hexyl)-carbazole, polymethylene pyrene, poly-1-(pyrenyl)butadiene, polymers such as alkyl, nitro, amino, halogen, and hydroxy substitute polymers such as poly-3-amino carbazole, 1,3-dibromo-poly-N-vinyl carbazole, 3,6-dibromo-poly-N-vinyl carbazole, and numerous other transparent organic polymeric or non-polymeric transport materials as described in U.S. Pat. No. 3,870,516, the disclosure of which is totally incorporated herein by reference. Also suitable as charge transport materials are phthalic anhydride, tetrachlorophthalic anhydride, benzil, mellitic anhydride, S-tricyanobenzene, picryl chloride, 2,4-dinitrochlorobenzene, 2,4-dinitrobromobenzene, 4-nitrobiphenyl, 4,4-dinitrophenyl, 2,4,6-trinitroanisole, trichlorotrinitrobenzene, trinitro-o-toluene, 4,6-dichloro-1,3-dinitrobenzene, 4,6-dibromo-1,3-dinitrobenzene, p-dinitrobenzene, chloranil, bromanil, and mixtures thereof, 2,4,7-trinitro-9-fluorenone, 2,4,5,7-tetranitrofluorenone, trinitroanthracene, dinitroacridene, tetracyanopyrene, dinitroanthraquinone, polymers having aromatic or heterocyclic groups with more than one strongly electron withdrawing substituent such as nitro, sulfonate, sulfonyl, carboxyl, cyano, or the like, including polyesters, polysiloxanes, polyamides, polyurethanes, and epoxies, as well as block, graft, or random copolymers containing the aromatic moiety, and the like, as well as mixtures thereof, as described in U.S. Pat. No. 4,081,274, the disclosure of which is totally incorporated herein by reference.

Also suitable are charge transport materials such as triarylamines, including tritolyl amine, of the formula

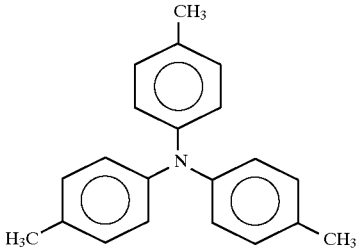

and the like, as disclosed in, for example, U.S. Pat. No. 3,240,597 and U.S. Pat. No. 3,180,730, the disclosures of each of which are totally incorporated herein by reference, and substituted diarylmethane and triarylmethane compounds, including bis-(4-diethylamino-2-methylphenyl)-phenylmethane, of the formula

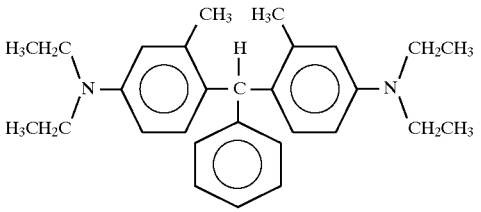

and the like, as disclosed in, for example, U.S. Pat. No. 4,082,551, U.S. Pat. No. 3,755,310, U.S. Pat. No. 3,647,431, British Patent 984,965, British Patent 980,879, and British Patent 1,141,666, the disclosures of each of which are totally incorporated herein by reference.

A particularly preferred charge transport molecule is one having the general formula

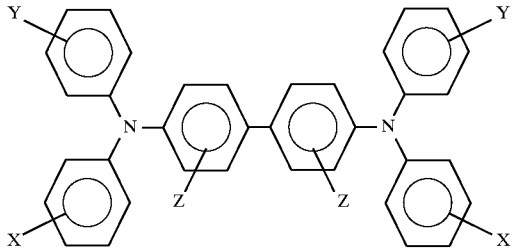

wherein X, Y and Z are each, independently of the others, hydrogen, alkyl groups having from 1 to about 20 carbon atoms, or chlorine, and wherein at least one of X, Y and Z is independently selected to be an alkyl group having from 1 to about 20 carbon atoms or chlorine. If Y and Z are hydrogen, the compound can be named N,N'-diphenyl-N,N'-bis(alkylphenyl)-(1,1'-biphenyl)-4,4'-diamine wherein the alkyl is, for example, methyl, ethyl, propyl, n-butyl, or the like, or the compound can be N,N'-diphenyl-N,N'-bis(chlorophenyl)-[1,1'-biphenyl]-4,4'-diamine. A particularly preferred member of this class is N,N'-diphenyl-N,N'-bis(3"-methylphenyl)-(1,1'-biphenyl)-4,4'-diamine (prepared as disclosed in U.S. Pat. No. 4,265,990, the disclosure of which is totally incorporated herein by reference).

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

The charge transport material is present in the charge transport layer in any effective amount, generally from about 5 to about 90 percent by weight, preferably from about 20 to about 75 percent by weight, and more preferably from about 30 to about 60 percent by weight, although the amount can be outside of these ranges.

Examples of the highly insulating and transparent resinous components or inactive binder resinous material for the transport layers include materials such as those described in U.S. Pat. No. 3,121,006, the disclosure of which is totally incorporated herein by reference. Specific examples of suitable organic resinous materials include polycarbonates, acrylate polymers, vinyl polymers, cellulose polymers, polyesters, polysiloxanes, polyamides, polyurethanes, polystyrenes, polyarylates, polyethers, polysulfones, and epoxies, as well as block, random or alternating copolymers thereof. Preferred electrically inactive binder materials include polycarbonate resins having a number average molecular weight of from about 20,000 to about 100,000 with a molecular weight in the range of from about 50,000 to about 100,000 being particularly preferred. The high performance polymers of the present invention can also be employed in the charge transport layer of the imaging member, either alone or in combination with other materials. Generally, the charge transport layer contains the charge transport material in an amount of from about 5 to about 90 percent by weight, and preferably from about 20 percent to about 75 percent by weight, although the relative amounts of binder and transport material can be outside these ranges.

Generally, the thickness of the charge transport layer is from about 10 to about 50 microns, although thicknesses outside this range can also be used. Preferably, the ratio of the thickness of the charge transport layer to the charge generator layer is maintained from about 2:1 to 200:1, and in some instances as great as 400:1.

In the photosensitive imaging members of the present invention, at least one layer, such as the adhesive layer, the protective overcoat layer, the photogenerating layer, the charge transport layer, or the like, includes a polymer of the specific formulae indicated herein. Specific examples of suitable polymer materials include (a) those of the formulae wherein x is an integer of 0 or 1, A is

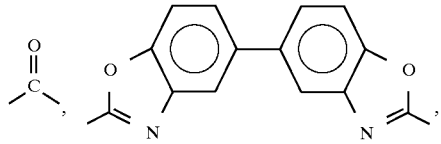

I

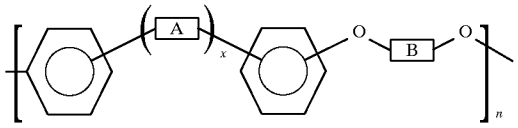

III

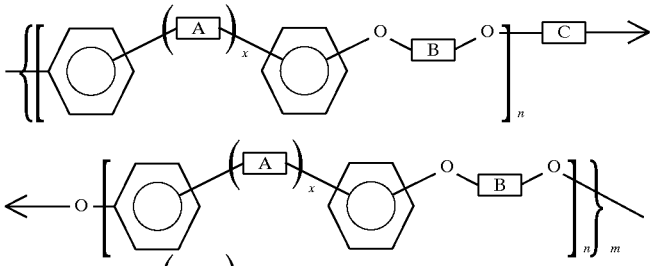

IV

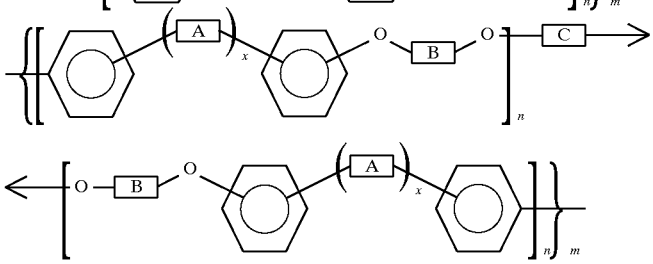

VII

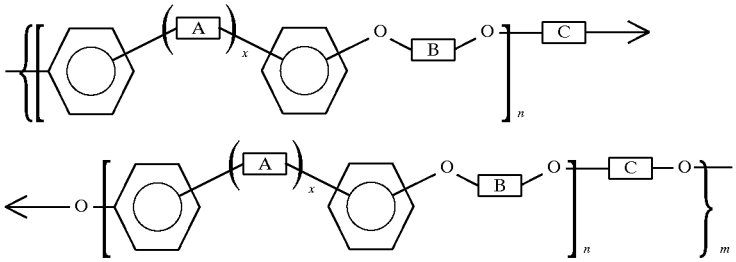

or

VIII

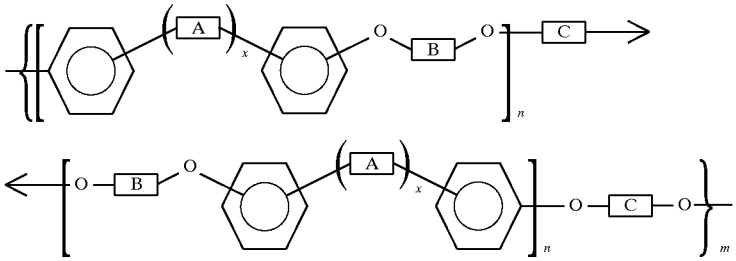

-continued
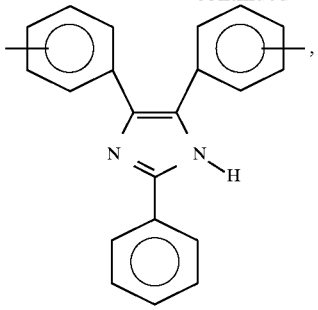
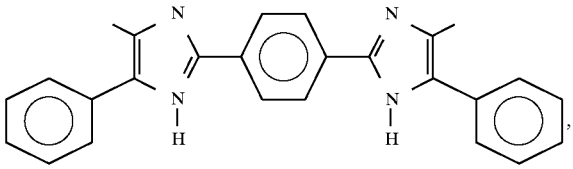
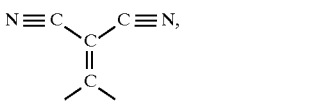
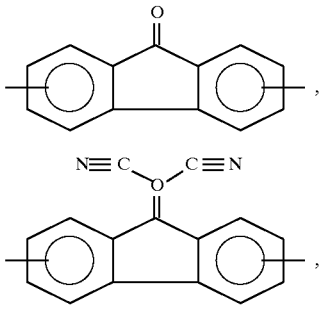
or mixtures thereof, B is
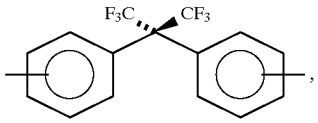
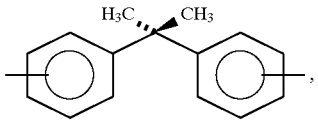
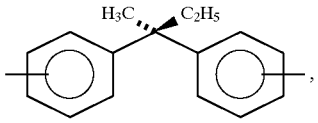
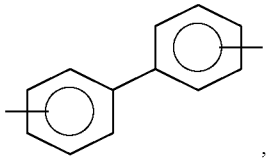
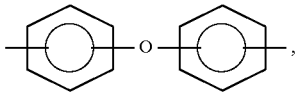
-continued
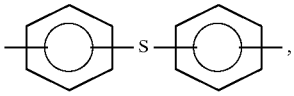
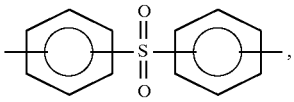
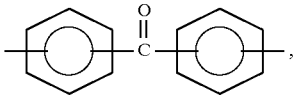
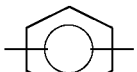
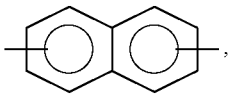
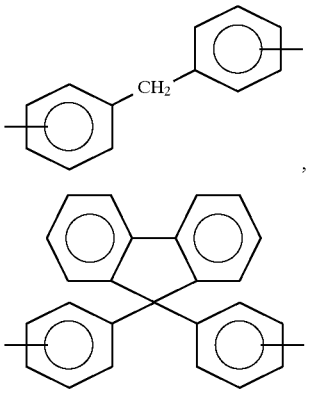
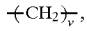
wherein v is an integer of from 1 to about 20, and preferably from 1 to about 10,
$$—(CH_2O)_t—$$
wherein t is an integer of from 1 to about 20, and preferably from 1 to about 10,
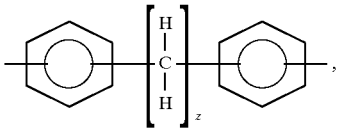
wherein z is an integer of from 2 to about 20, and preferably from 2 to about 10,
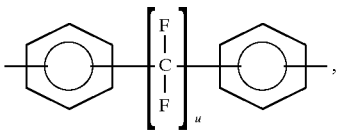
wherein u is an integer of from 1 to about 20, and preferably from 1 to about 10,

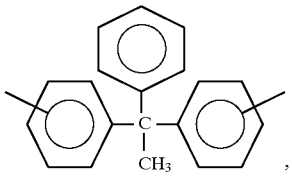

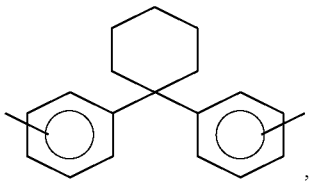

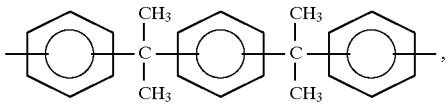

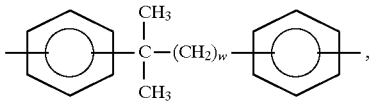

wherein w is an integer of from 1 to about 20, and preferably from 1 to about 10,

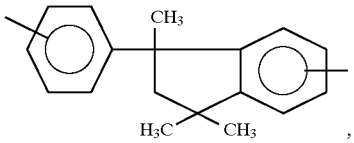

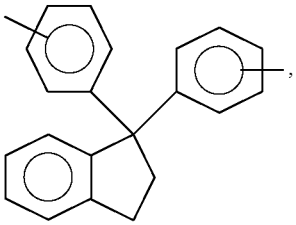

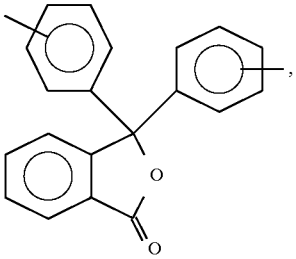

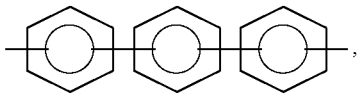

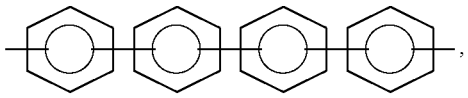

-continued

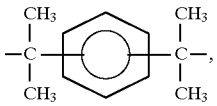

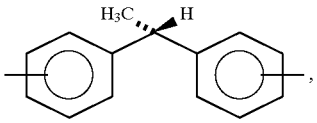

other similar bisphenol derivatives, or mixtures thereof, C is

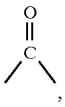

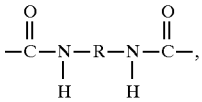

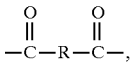

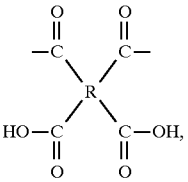

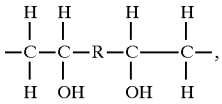

or mixtures thereof, wherein alkyl group, including cyclic and substituted alkyl groups, preferably with from 1 to about 30 carbon atoms, an aryl group, including substituted aryl groups, preferably with from 6 to about 30 carbon atoms, or an arylalkyl group, including substituted arylalkyl groups, preferably with from 7 to about 30 carbon atoms, or mixtures thereof, and m and n are integers representing the number of repeating units; and (b) those of the formulae

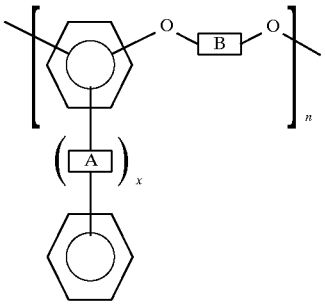

II

-continued
V
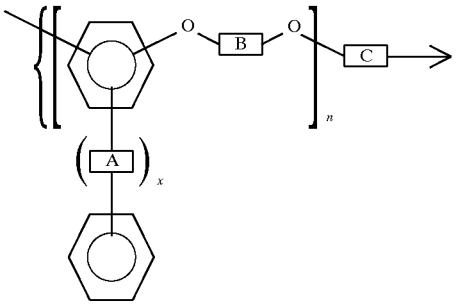
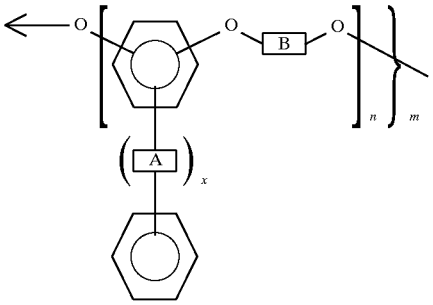
VI
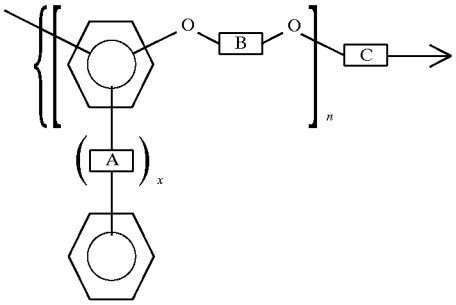
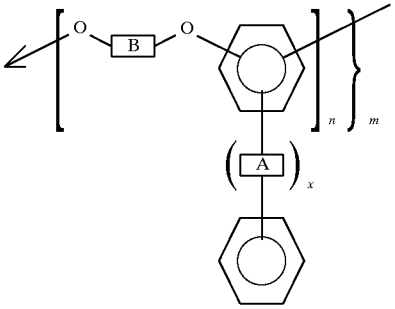
IX
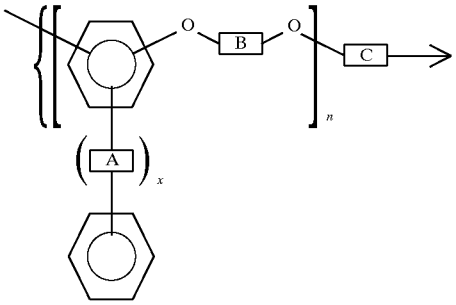
-continued
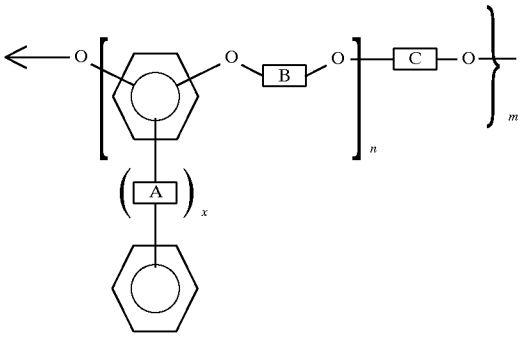
or
X
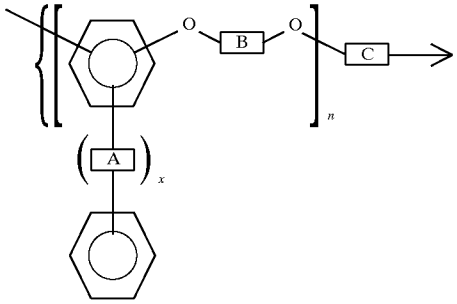
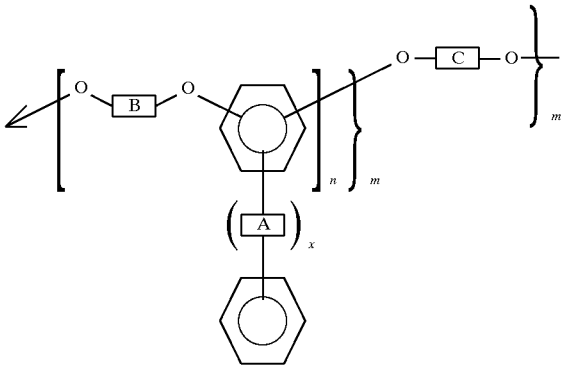
wherein x is an integer of 0 or 1, A is
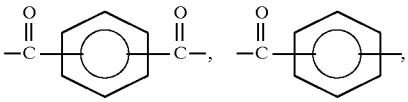
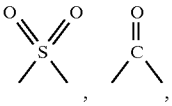
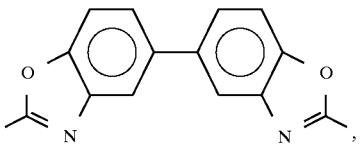

-continued
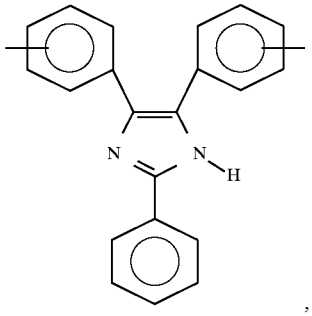
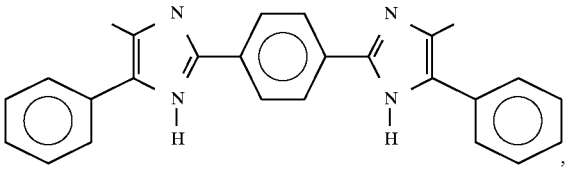
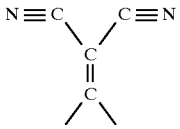
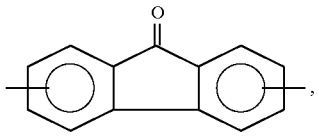
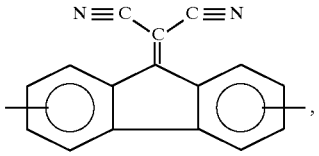
or mixtures thereof, B is
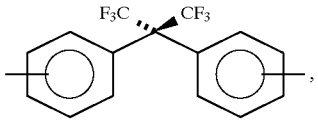
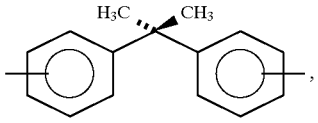
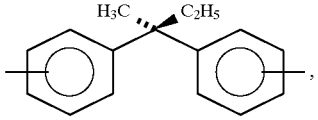
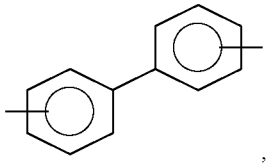
-continued
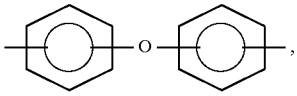
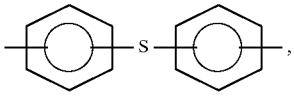
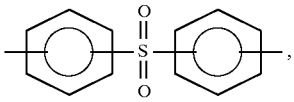
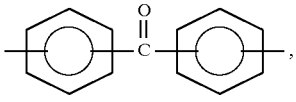
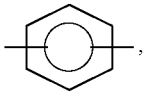
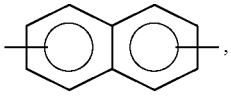
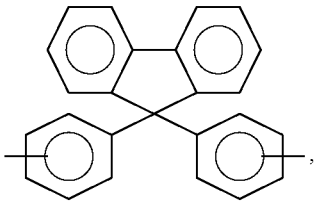
$\text{—}(CH_2)_v\text{—}$,
wherein v is an integer of from 1 to about 20, and preferably from 1 to about 10,
$\text{—}(CH_2O)_t\text{—}$
wherein t is an integer of from 1 to about 20, and preferably from 1 to about 10,
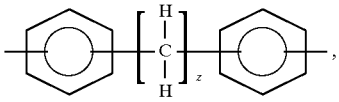
wherein z is an integer of from 2 to about 20, and preferably from 2 to about 10,
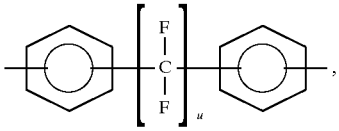
wherein u is an integer of from 1 to about 20, and preferably from 1 to about 10,

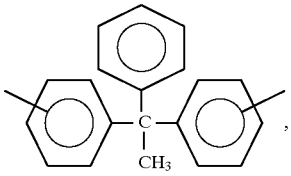

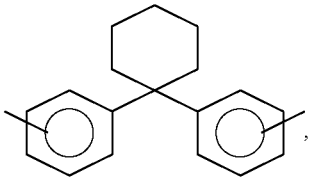

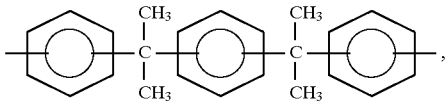

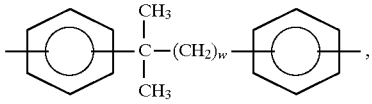

wherein w is an integer of from 1 to about 20, and preferably from 1 to about 10,

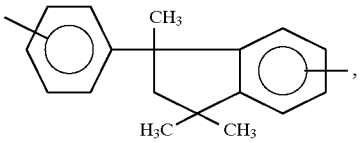

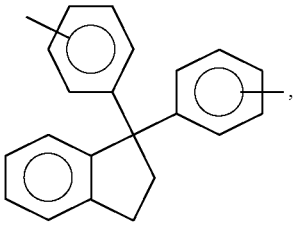

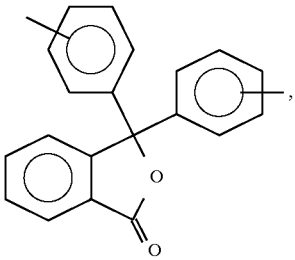

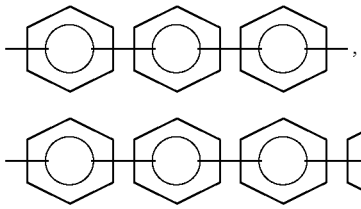

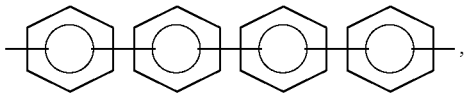

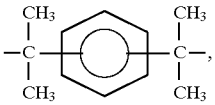

-continued

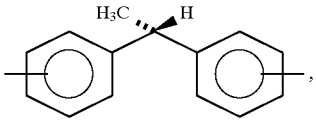

other similar bisphenol derivatives, or mixtures thereof, C is

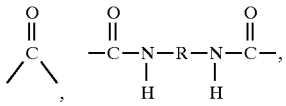

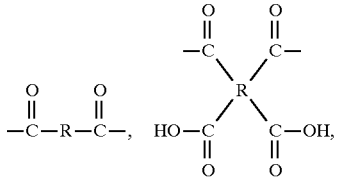

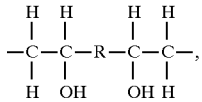

or mixtures thereof, wherein R is an alkyl group, including cyclic and substituted alkyl groups, preferably with from 1 to about 30 carbon atoms, an aryl group, including substituted aryl groups, preferably with from 6 to about 30 carbon atoms, or an arylalkyl group, including substituted arylalkyl groups, preferably with from 7 to about 30 carbon atoms, or mixtures thereof, and m and n are integers representing the number of repeating units.

In other embodiments of the present invention, for polymers of Formula I, III, IV, VII, and VIII, the A group is

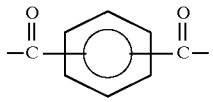

and the B group is

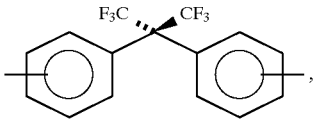

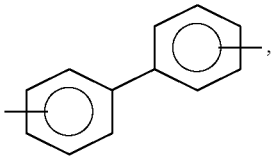

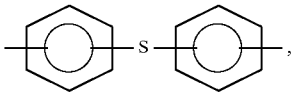

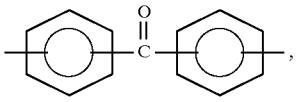

-continued

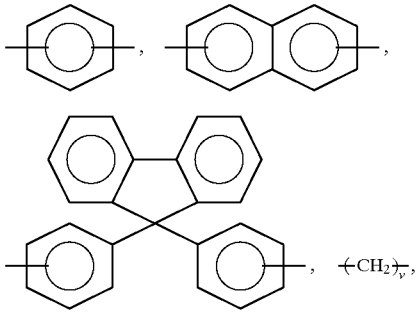

wherein v is an integer of from 1 to about 20, and preferably from 1 to about 10, $$—(CH_2O)_t—$$

wherein t is an integer of from 1 to about 20, and preferably from 1 to about 10,

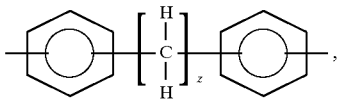

wherein z is an integer of from 2 to about 20, and preferably from 2 to about 10,

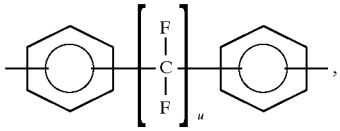

wherein u is an integer of from 1 to about 20, and preferably from 1 to about 10,

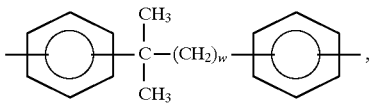

wherein w is an integer of from 1 to about 20, and preferably from 1 to about 10,

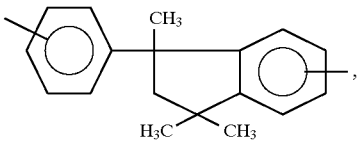

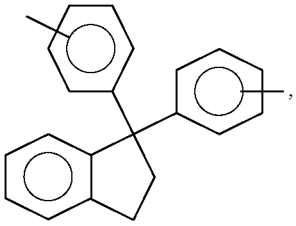

-continued

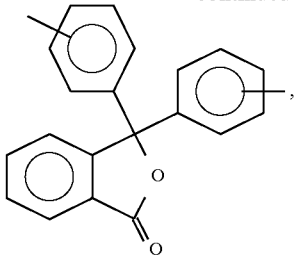

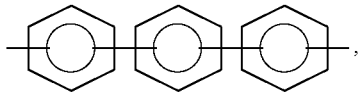

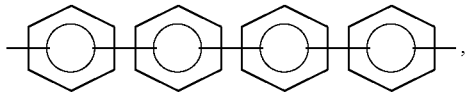

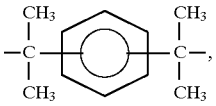

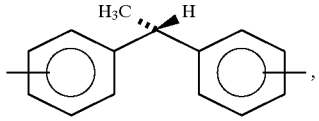

other similar bisphenol derivatives, or mixtures thereof.

In other embodiments of the present invention, for polymers of Formula I, III, IV, VII, and VIII, the A group is

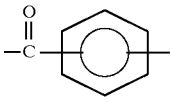

and the B group is

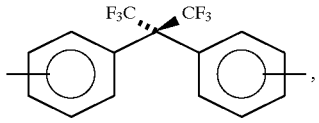

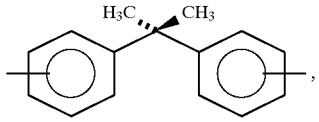

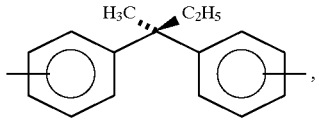

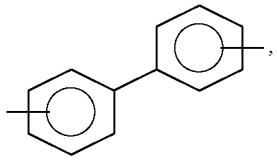

-continued
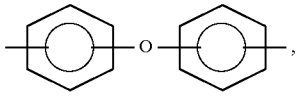
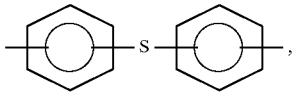
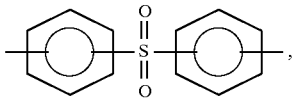
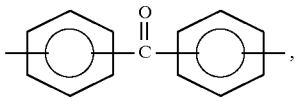
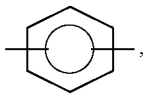
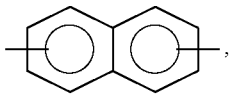
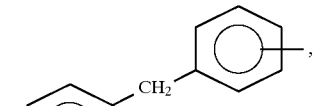
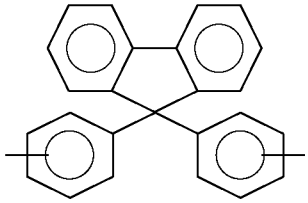
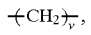
wherein v is an integer of from 1 to about 20, and preferably from 1 to about 10,
$—(CH_2O)_t—$
wherein t is an integer of from 1 to about 20, and preferably from 1 to about 10,
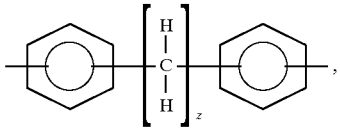
wherein z is an integer of from 2 to about 20, and preferably from 2 to about 10,
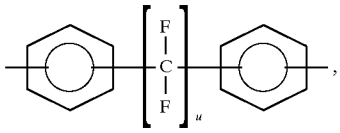
wherein u is an integer of from 1 to about 20, and preferably from 1 to about 10,
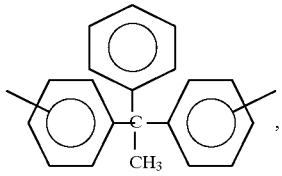
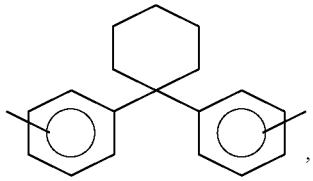
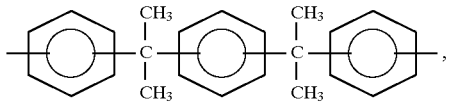
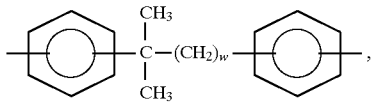
wherein w is an integer of from 1 to about 20, and preferably from 1 to about 10,
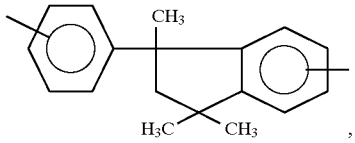
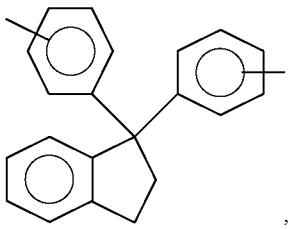
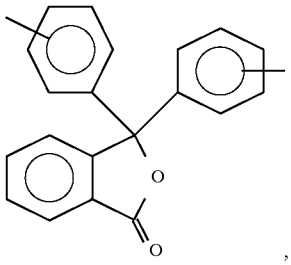
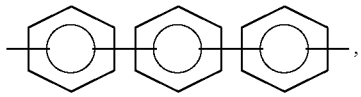
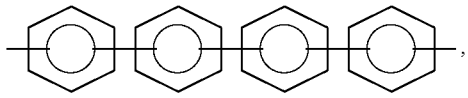
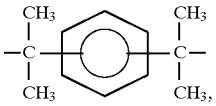

-continued

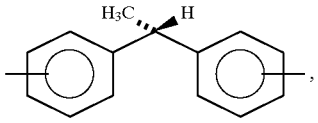

other similar bisphenol derivatives, or mixtures thereof.

In other embodiments of the present invention, for polymers of Formula I, III, IV, VII, and VIII, the A group is

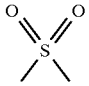

and the B group is

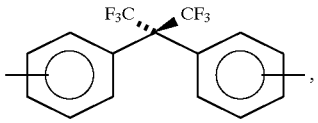

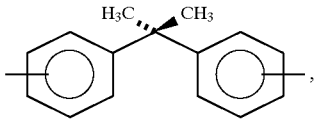

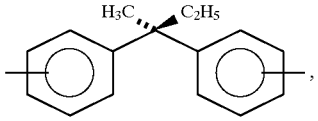

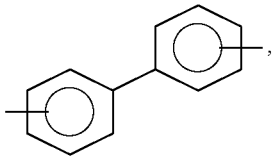

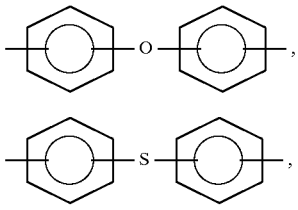

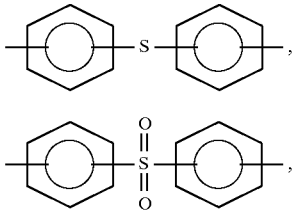

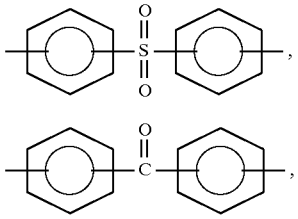

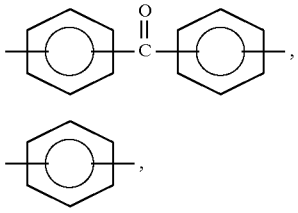

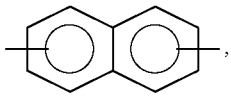

-continued

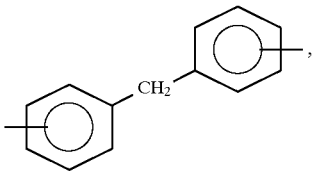

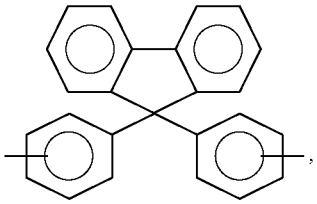

$-(CH_2)_v-$, wherein v is an integer of from 1 to about 20, and preferably from 1 to about 10, $-(CH_2O)_t-$ wherein t is an integer of from 1 to about 20, and preferably from 1 to about 10,

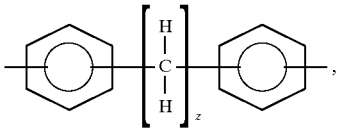

wherein z is an integer of from 2 to about 20, and preferably from 2 to about 10,

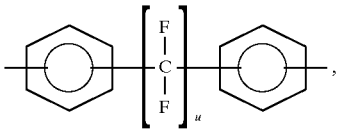

wherein u is an integer of from 1 to about 20, and preferably from 1 to about 10,

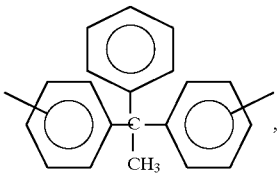

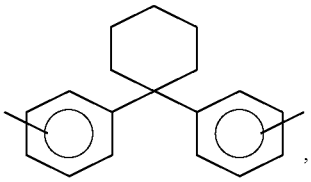

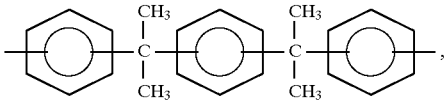

-continued
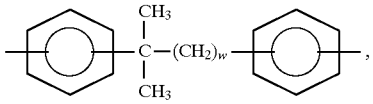
wherein w is an integer of from 1 to about 20, and preferably from 1 to about 10,
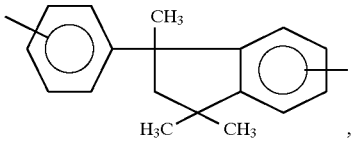
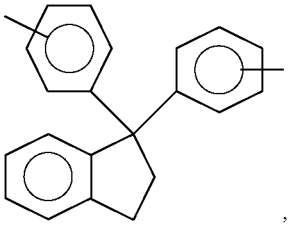
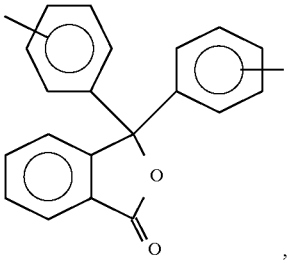
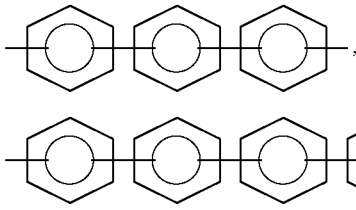
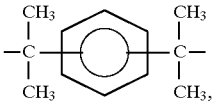
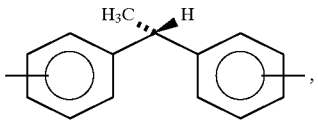
other similar bisphenol derivatives, or mixtures thereof.
In one preferred embodiment, the two phenyl groups around the "A" group are perfluorinated and x is 0, resulting in a polymer of the formula
I
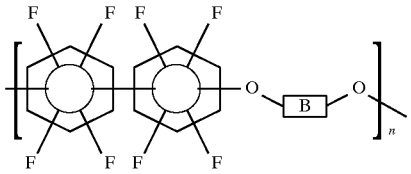
-continued
II
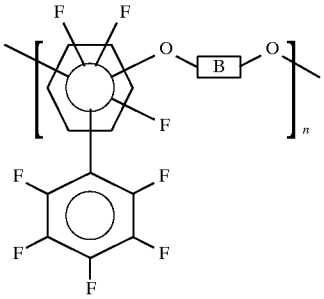
III
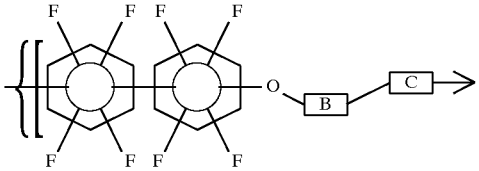
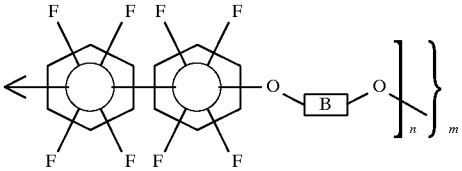
IV
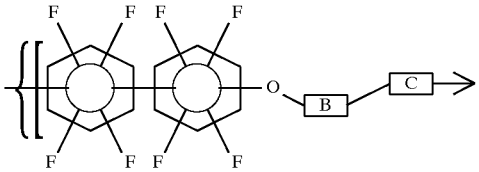
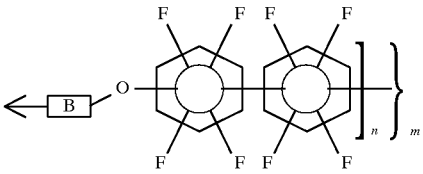
V
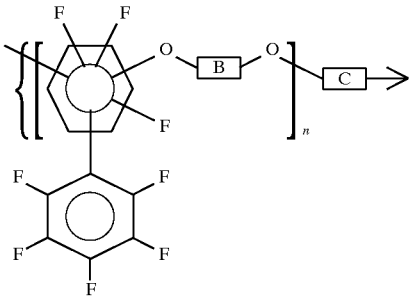
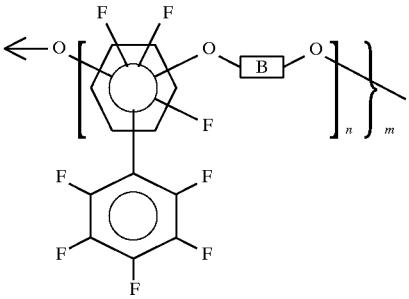

-continued
VI
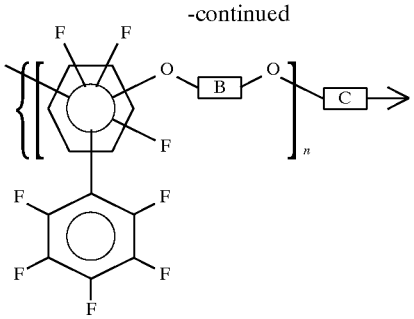
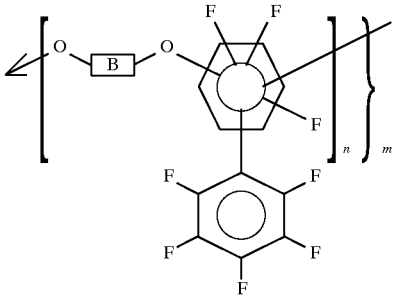
VII
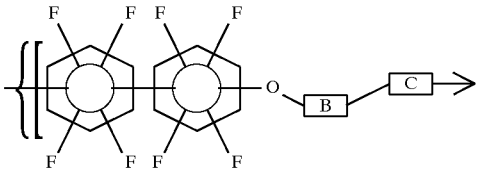
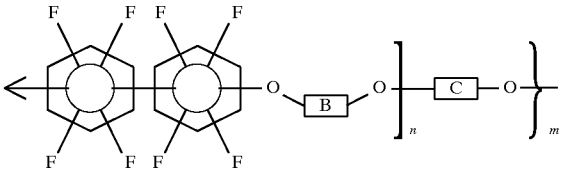
VIII
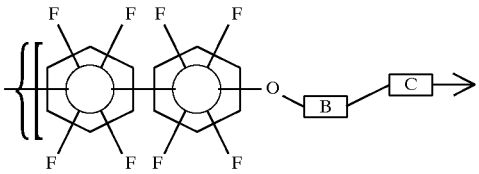
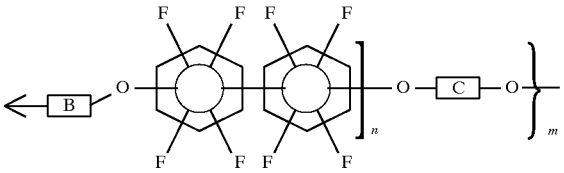
IX
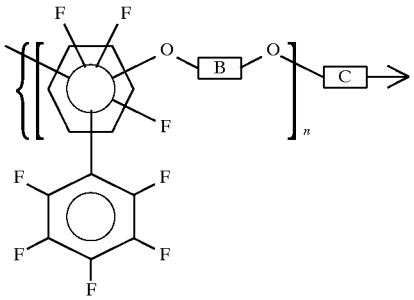
-continued
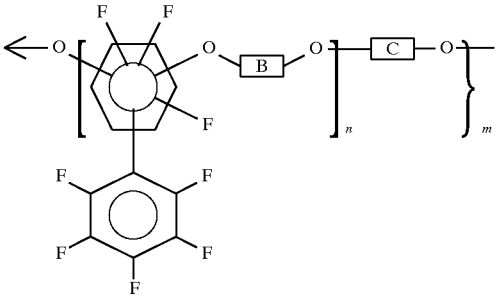
or
X
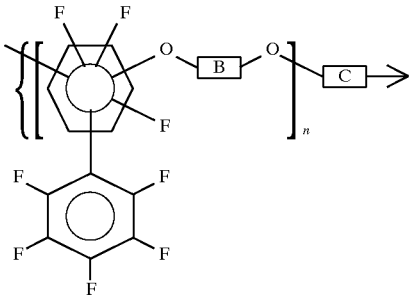
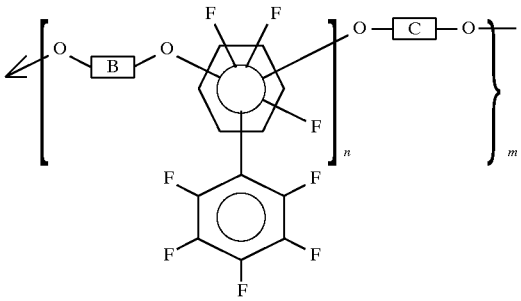
In another preferred embodiment, the two phenyl groups around the "A" group are perfluorinated, x is 1, and A is
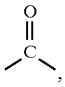
resulting in a polymer of the formula I
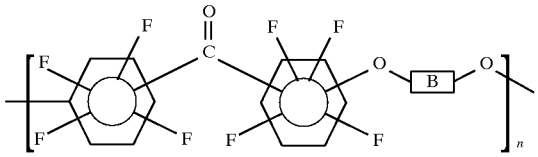
II
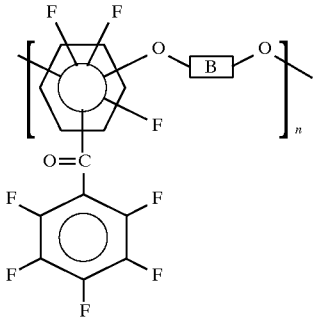
III
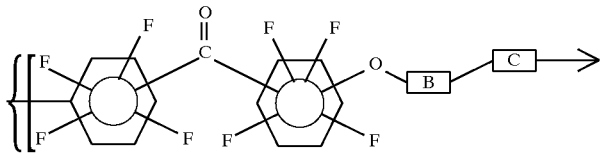
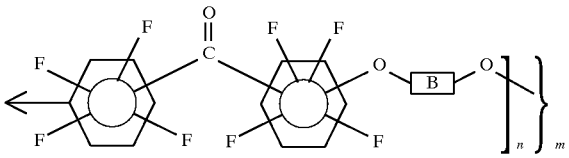
IV
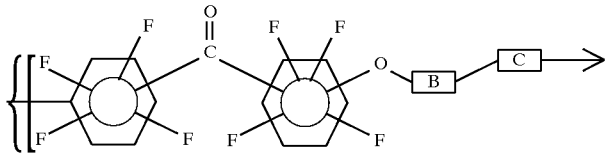
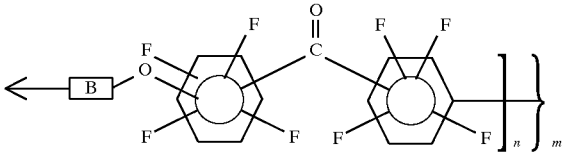
V
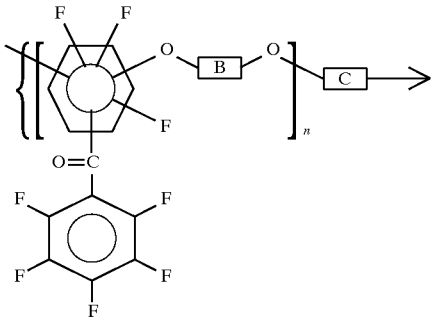

-continued
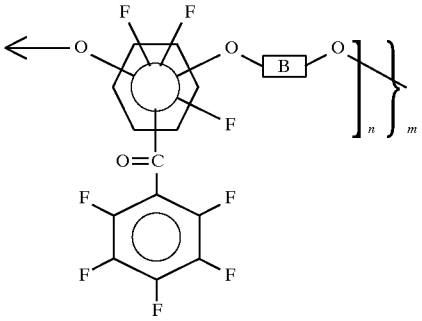
VI
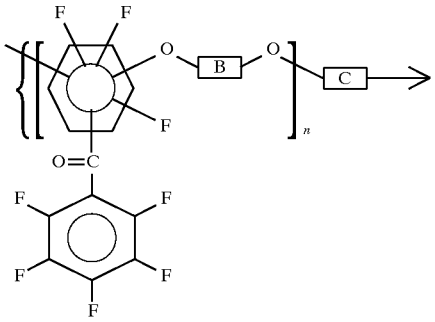
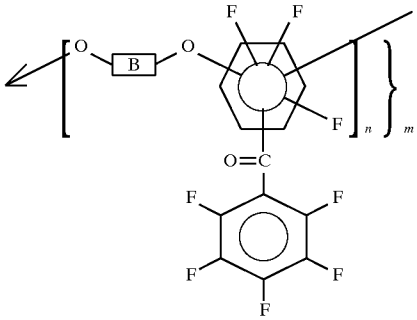
VII
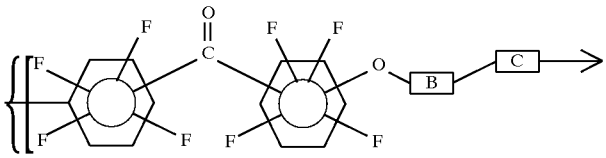
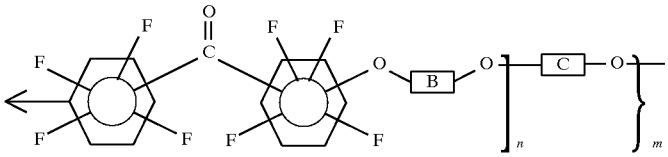
VIII
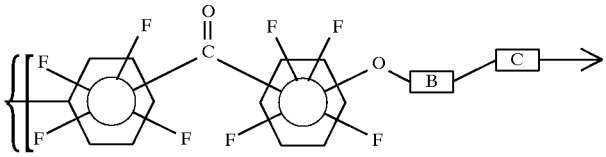
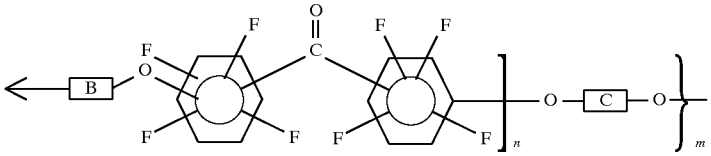

-continued

IX

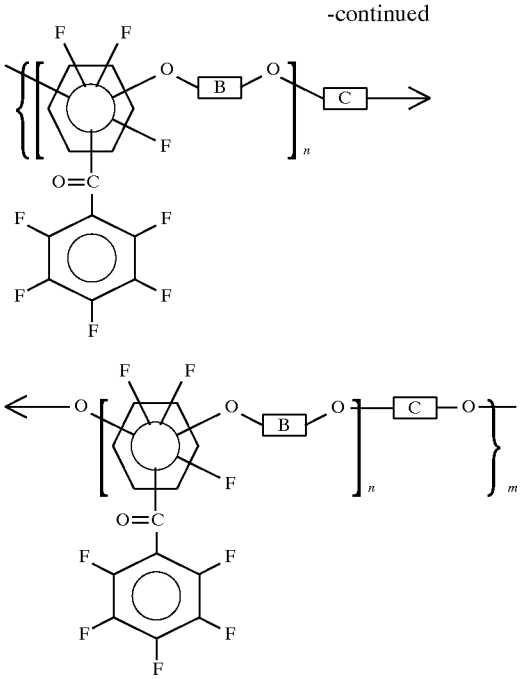

or

X

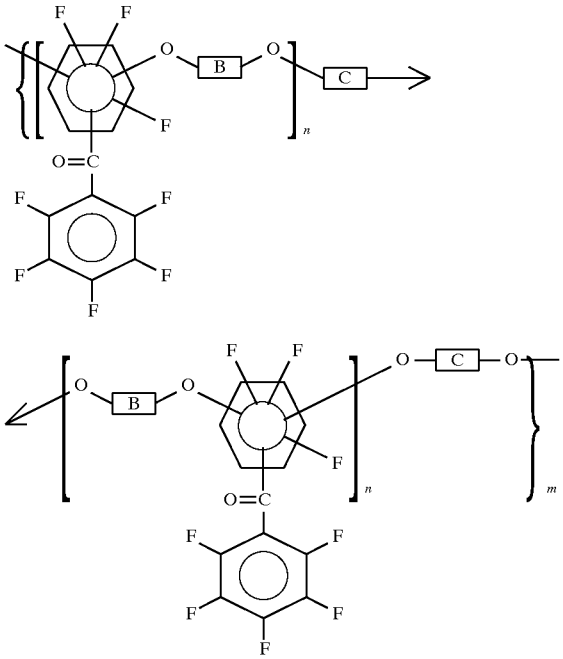

The value of m and n are preferably such that the number average molecular weight of the material is from about 10,000 to about 100,000, more preferably is from about 30,000 to about 100,000, and even more preferably is from about 30,000 to about 60,000, although the $M_n$ can be outside these ranges; the weight average molecular weight of the material preferably is from about 20,000 to about 350,000, and more preferably is from about 100,000 to about 250,000, although the $M_w$ can be outside these ranges. The polydispersity ($M_w/M_n$) typically is from about 2 to about 9, and preferably is about 3, although higher or lower polydispersity values may also be used. The phenyl groups and the A, B, and/or C groups may also be substituted. Examples of suitable substituents include (but are not limited to) alkyl groups, including saturated, unsaturated, and cyclic alkyl groups, preferably with from 1 to about 6 carbon atoms, substituted alkyl groups, including saturated, unsaturated, and cyclic substituted alkyl groups, preferably with from 1 to about 6 carbon atoms, aryl groups, preferably with from 6 to about 24 carbon atoms, substituted aryl groups, preferably with from 6 to about 24 carbon atoms, arylalkyl groups, preferably with from 7 to about 30 carbon atoms, substituted arylalkyl groups, preferably with from 7 to about 30 carbon atoms, alkoxy groups, preferably with from 1 to about 6 carbon atoms, substituted alkoxy groups, preferably with from 1 to about 6 carbon atoms, aryloxy groups, preferably with from 6 to about 24 carbon atoms, substituted aryloxy groups, preferably with from 6 to about 24 carbon atoms, arylalkyloxy groups, preferably with from 7 to about 30 carbon atoms, substituted arylalkyloxy groups, preferably with from 7 to about 30 carbon atoms, hydroxy groups, cyano groups, pyridine groups, pyridinium groups, ether groups, ester groups, amide groups, carbonyl groups, thiocarbonyl groups, sulfate groups, sulfonate groups, sulfide groups, sulfoxide groups, phosphate groups, sulfone groups, acyl groups, halogen atoms, and the like, wherein two or more substituents can be joined together to form a ring, wherein the substituents on the substituted alkyl groups, substituted aryl groups, substituted arylalkyl groups, substituted alkoxy groups, substituted aryloxy groups, and substituted arylalkyloxy groups can be (but are not limited to) hydroxy groups, ammonium groups, cyano groups, pyridine groups, pyridinium groups, ether groups, aldehyde groups, ketone groups, ester groups, amide groups, carboxylic acid groups, carbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, mixtures thereof, and the like, wherein two or more substituents can be joined together to form a ring. The polymers preferably have a glass transition temperature of from about 50° to about 350° C., and more preferably from about 150° to about 260° C., although the $T_g$ can be outside these ranges. When the polymers are admixed with other components of the photosensitive imaging member into which they will be incorporated, such as charge transport molecules to form a charge transport layer, the polymer-containing mixture preferably has a glass transition temperature of from about 50° to about 100° C., and more preferably about 70° C., although the $T_g$ of the mixture can be outside this range. Processes for the preparation of these materials are known, and disclosed in, for example, P. M. Hergenrother et al., "Poly(arylene ethers)", *Polymer*, Vol. 29, 358 (1988); S. J. Havens et al., "Ethynyl-Terminated Polyarylates: Synthesis and Characterization," *Journal of Polymer Science, Polymer Chemistry Edition*, Vol. 22, 3011 (1984); B. J. Jensen and P. M. Hergenrother, "High Performance Polymers," Vol. 1, No. 1) page 31 (1989); "Synthesis and characterization of New Fluorescent Poly(arylene ethers)," S. Matsuo, N. Yakoh, S. Chino, M. Mitani, and S. Tagami, *Journal of Polymer Science: Part A: Polymer Chemistry,* 32, 1071 (1994); "Synthesis of a Novel Naphthalene-Based Poly(arylene ether ketone) with High Solubility and Thermal Stability," Mami Ohno, Toshikazu Takata, and Takeshi Endo, *Macromolecules,* 27 3447 (1994); G. Hougham, G. Tesoro, and J. Shaw, *Polym. Mater. Sci. Eng.,* 61, 369 (1989); "Synthesis and Characterization of New Aromatic Poly (ether ketones)," F. W. Mercer, M. T. Mckenzie, G. Merlino, and M. M. Fone, J. of *Applied Polymer Science,* 56, 1397 (1995); K. E. Dukes, M. D. Forbes, A. S. Jeevarajan, A. M. Belu, J. M. DeDimone, R. W. Linton, and V. V. Sheares, *Macromolecules,* 29, 3081 (1996); H. C. Zhang, T. L. Chen, Y. G. Yuan, Chinese Patent CN 85108751 (1991); "Static and loser light scattering study of novel thermoplastics. 1. Phenolphthalein poly(aryl ether ketone)," C. Wu, S. Bo, M. Siddiq, G. Yang and T. Chen, *Macromolecules,* 29, 2989 (1996); the disclosures of each of which are totally incorporated herein by reference.

Three examples of preferred polymers for the present invention are those of the formulae

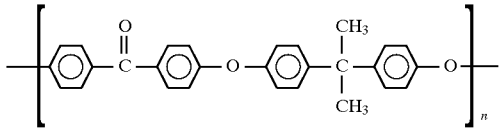

wherein n represents the number of repeating monomer units, and typically is from about 25 to about 620, and preferably from about 74 to about 150, although the value of n can be outside these ranges, in some specific embodiments with a glass transition temperature of about 155° C.,

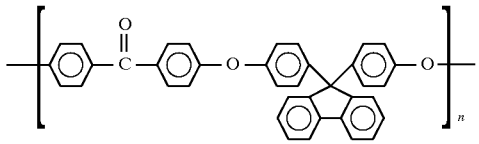

wherein n represents the number of repeating monomer units, and typically is from about 20 to about 475, and preferably from about 55 to about 114, although the value of n can be outside these ranges, in some specific embodiments with a glass transition temperature of about 240° C., and

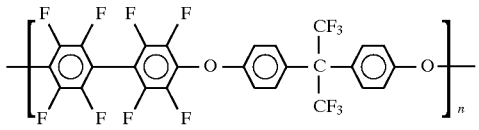

wherein n represents the number of repeating monomer units, and typically is from about 10 to about 620, and preferably from about 55 to about 114, although the value of n can be outside these ranges.

Polymers of the formula

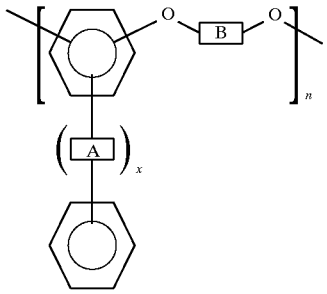

and oligomers containing this moiety are also preferred because of advantages such as the ability to dissolve relatively high concentrations of photoreceptor component materials such as charge transport molecules. These polymers also exhibit less likelihood of crystallizing. Further, materials such as charge transport molecules dissolved within these polymers are less likely to exhibit crystallization. Layers containing these polymers can be applied to an imaging member by a solvent coating process wherein the coating solution contains a relatively high concentration of the layer components. Layers containing these polymers can also contain relatively high concentrations of photoreceptor component materials such as charge transport molecules.

While not required, it may be advantageous with respect to the ultimate properties of the polymer if the polymer is end-functionalized with a specifically selected group. In some instances, the terminal groups on the polymer can be selected by the stoichiometry of the polymer synthesis. For example, when a polymer is prepared by the reaction of 4,4'-dichlorobenzophenone and bis-phenol A in the presence of potassium carbonate in N,N-dimethylacetamide, if the bis-phenol A is present in about 7.5 to 8 mole percent excess, the resulting polymer generally is bis-phenol A-terminated (wherein the bis-phenol A moiety may or may not have one or more hydroxy groups thereon). In contrast, if the 4,4'-dichlorobenzophenone is present in about 7.5 to 8 mole percent excess, the reaction time is approximately half that required for the bis-phenol A excess reaction, the resulting polymer generally is benzophenone-terminated (wherein the benzophenone moiety may or may not have one or more chlorine atoms thereon). Similarly, when a polymer is prepared by the reaction of 4,4'-difluorobenzophenone with either 9,9'-bis(4-hydroxyphenyl)fluorene or bis-phenol A in the presence of potassium carbonate in N,N-dimethylacetamide, if the 4,4'-difluorobenzophenone reactant is present in excess, the resulting polymer generally has benzophenone terminal groups (which may or may not have one or more fluorine atoms thereon). The well-known Carothers equation can be employed to calculate the stoichiometric offset required to obtain the desired molecular weight. (See, for example, William H. Carothers, "An Introduction to the General Theory of Condensation Polymers," *Chem. Rev.,* 8, 353 (1931) and *J. Amer. Chem. Soc.,* 51, 2548 (1929); see also P. J. Flory, *Principles of Polymer Chemistry*, Cornell University Press, Ithaca, N.Y. (1953); the disclosures of each of which are totally incorporated herein by reference.) More generally speaking, during the preparation of polymers such as those of the formula

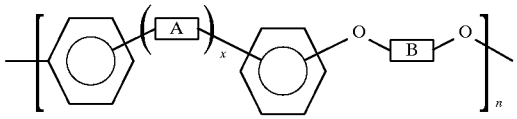

and the other formulae of the present invention, the stoichiometry of the polymer synthesis reaction can be adjusted so that the end groups of the polymer are derived from the "A" groups or derived from the "B" groups. Specific functional groups can also be present on these terminal "A" groups or "B" groups, such as hydroxy groups which are attached to the aromatic ring on an "A" or "B" group to form a phenolic moiety, halogen atoms which are attached to the "A" or "B" group, or the like.

Polymers with end groups derived from the "A" group, such as benzophenone groups or halogenated benzophenone groups, may be preferred for some applications because both the syntheses and some of the reactions of these materials to place substituents thereon may be easier to control and may yield better results with respect to, for example, cost, molecular weight, molecular weight range, and polydispersity ($M_w/M_n$) compared to polymers with end groups derived from the "B" group, such as bis-phenol A groups (having one or more hydroxy groups on the aromatic rings thereof) or other phenolic groups.

Terminal hydroxy or halide groups on the polymer can also be further reacted. For example, a polymer with halide terminal groups, such as the polymer obtained by reacting an excess of 4,4'-difluorobenzophenone with, for example, bis-phenol A or 9,9'-bis(4-hydroxyphenyl)fluorene, can be reacted in the presence of potassium carbonate with phenol to replace the -F terminal groups with -ϕ groups. Similarly, a polymer with hydroxy terminal groups can be reacted with a quaternary ammonium salt of the formula $NR_1R_2R_3R_4$, wherein $R_1$, $R_2$, $R_3$, and $R_4$ each, independently of the others, are alkyl groups, preferably with from 1 to about 50 carbon atoms, aryl groups, preferably with from 6 to about 50 carbon atoms, arylalkyl groups, preferably with from 7 to about 50 carbon atoms, or substituted alkyl, aryl, or arylalkyl groups, in the presence of a base such as sodium hydroxide in water and methylene chloride at temperatures typically from about 20° to about 60° C., to replace the hydroxy groups with the corresponding alkoxy groups.

In addition, oligomers can be reacted with coupling agents to generate polymers of the formulae indicated herein. The general reaction scheme, illustrated below wherein polymers of formula I are coupled to form polymers of formula III or IV, is as follows:

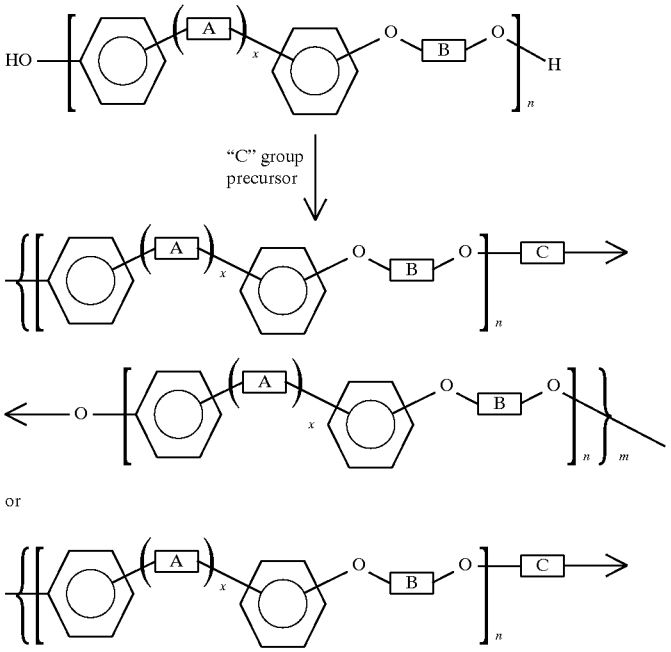

-continued

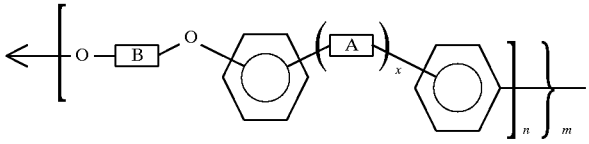

wherein m is an integer of at least 1 and represents the number of repeating units. The value of m is such that the resulting coupled polymer can be dissolved into a solvent and coated onto an imaging member. Preferably, m is such that the weight average molecular weight of the polymer is under about 300,000, and more preferably under about 150,000.

Examples of suitable "C" groups include those based on polycarbonates, wherein "C" is

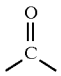

and the polymer thus contains a

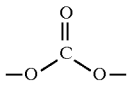

linkage, those based on polyurethanes and polyisocyanates, wherein "C" is of the general formula

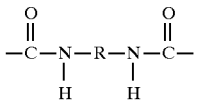

and the polymer thus contains a

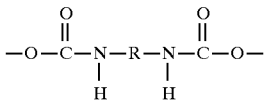

linkage, wherein R is an alkyl group, including cyclic and substituted alkyl groups, preferably with from 1 to about 30 carbon atoms, an aryl group, including substituted aryl groups, preferably with from 6 to about 30 carbon atoms, or an arylalkyl group, including substituted arylalkyl groups, preferably with from 7 to about 30 carbon atoms, or mixtures thereof, those based on polyesters, wherein "C" is of the general formula

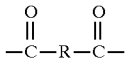

and the polymer thus contains a

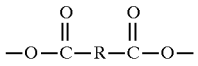

linkage, wherein R is an alkyl group, including cyclic and substituted alkyl groups, preferably with from 1 to about 30 carbon atoms, an aryl group, including substituted aryl groups, preferably with from 6 to about 30 carbon atoms, or an arylalkyl group, including substituted arylalkyl groups, preferably with from 7 to about 30 carbon atoms, or mixtures thereof, those based on dianhydrides, wherein "C" is of the general formula

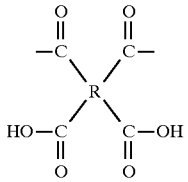

and the polymer thus contains a

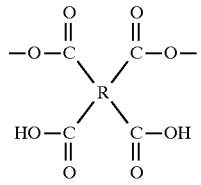

linkage, wherein R is an alkyl group, including cyclic and substituted alkyl groups, preferably with from 1 to about 30 carbon atoms, an aryl group, including substituted aryl groups, preferably with from 6 to about 30 carbon atoms, or an arylalkyl group, including substituted arylalkyl groups, preferably with from 7 to about 30 carbon atoms, or mixtures thereof, those based on diepoxies, wherein "C" is of the general formula

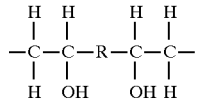

and the polymer thus contains a

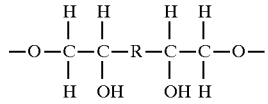

wherein R is an alkyl group, including cyclic and substituted alkyl groups and polymeric groups, preferably with from 1 to about 30 carbon atoms, an aryl group, including substituted aryl groups, preferably with from 6 to about 30 carbon atoms, or an arylalkyl group, including substituted arylalkyl groups, preferably with from 7 to about 30 carbon atoms, or mixtures thereof, and the like. For all of the above "R" groups, examples of suitable substituents include (but are not limited to) alkoxy groups, preferably with from 1 to about 6 carbon atoms, aryloxy groups, preferably with from 6 to about 24 carbon atoms, arylalkyloxy groups, preferably with from 7 to about 30 carbon atoms, hydroxy groups, halogen atoms, ammonium groups, cyano groups, pyridine groups, pyridinium groups, nitrile groups, mercapto groups, nitroso groups, nitro groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, sulfone groups, phosphine groups, phosphonium groups, phosphate groups, acyl groups, and the like, wherein two or more substituents can be joined together to form a ring.

For example, a hydroxy-terminated oligomer can be reacted with phosgene or the equivalent thereof (such as lithium hydride and diphenyl carbonate, or

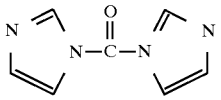

or

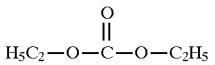

or

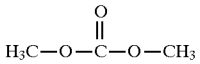

or the like) to couple the oligomers with polycarbonate groups, illustrated below wherein polymers of formula I are coupled to form polymers of formula III or IV as follows:

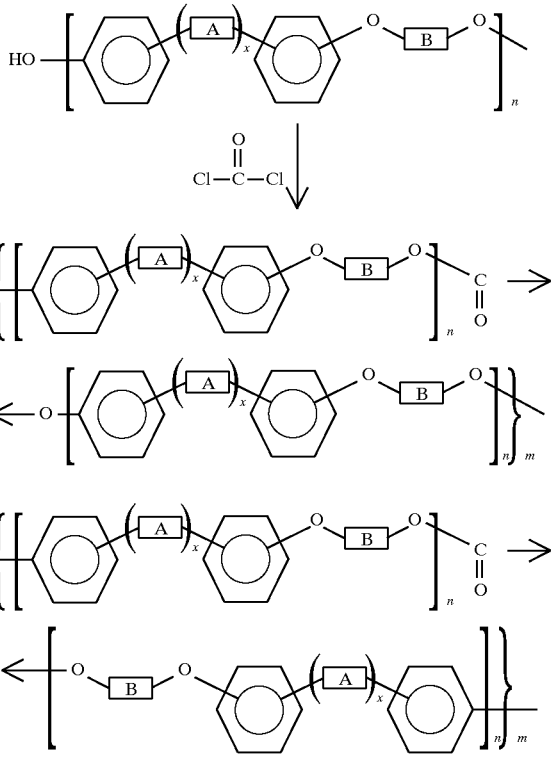

Conditions for this condensation reaction with a polymer of the specific formulae indicated herein are similar for those employed for the reaction of bis-phenol A with phosgene, as disclosed in, for example, W. R. Sorenson and T. W. Campbell, *Preparative Methods of Polymer Chemistry,* 2nd Edition, John Wiley & Sons (New York 1961, 1968), the disclosure of which is totally incorporated herein by reference, at, for example, pages 122, 123, 140, and 141.

In another example, a hydroxy-terminated oligomer can be reacted with a diisocyanate (one molar equivalent of isocyanate group per molar equivalent of hydroxy group) to couple the oligomers with isocyanate groups, illustrated below wherein polymers of formula I are coupled to form polymers of formula III or IV as follows:

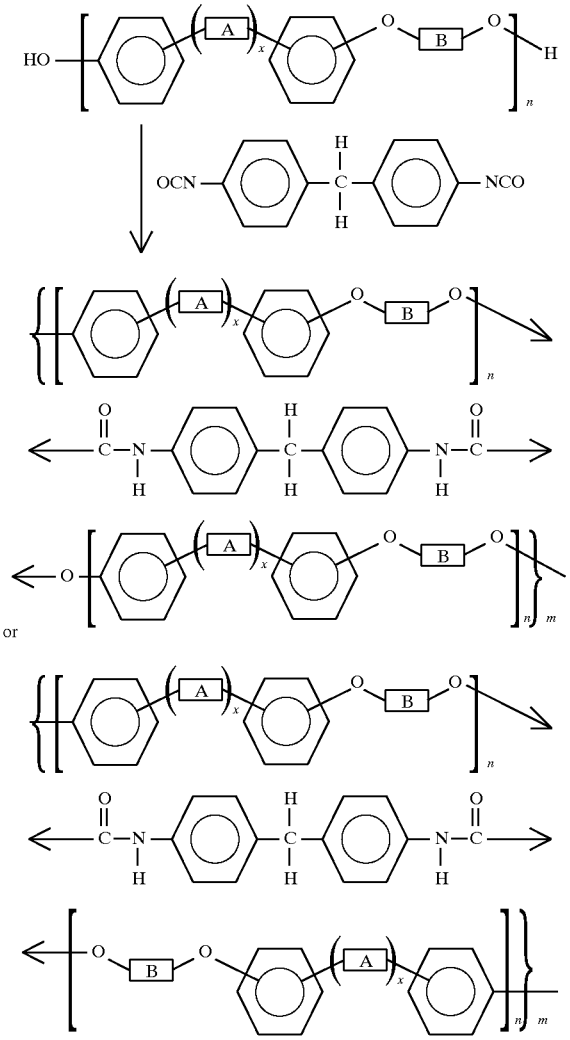

Other specific examples of suitable diisocyanate reactants (typically of the general formula

O=C=N—R—N=C=O wherein R is an alkyl group, including cyclic and substituted alkyl groups, preferably with from 1 to about 30 carbon atoms, an aryl group, including substituted aryl groups, preferably with from 6 to about 30 carbon atoms, or an arylalkyl group, including substituted arylalkyl groups, preferably with from 7 to about 30 carbon atoms, or mixtures thereof) include toluene diisocyanate, of the formula

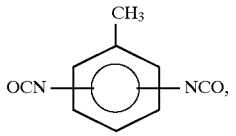

trimethylol propane toluene diisocyanate adducts, such as CB-75, commercially available from Mobay Chemical Co., Pittsburgh, Pa. of the formula

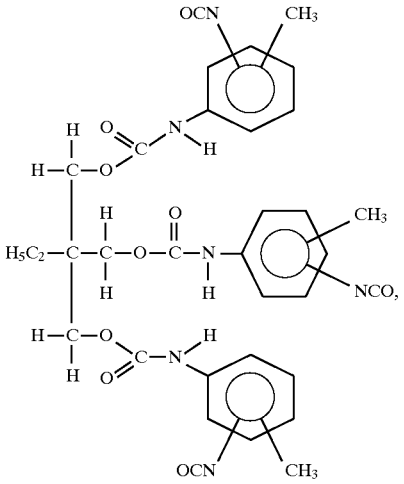

pentaerythritol toluene diisocyanate adducts, such as that of the formula commercially available from Hoechst-Celanese Corp., and the like. The di-isocyanate (1 equivalent of isocyanate groups) can be mixed with the hydroxy terminated oligomer (1 equivalent of hydroxy groups) in methylene chloride solution at 25° C., followed by coating the reaction mixture as rapidly as possible. The films chain-extend on standing. The films are then dried by heating to 90° C. to remove the solvent. Above this temperature, thermally reversing of the reaction may occur.

In another example, a hydroxy-terminated oligomer can be reacted with a diester, diacid chloride, or dianhydride (one molar equivalent of ester, acid chloride, or anhydride group per molar equivalent of hydroxy group) to couple the oligomers with ester, acid chloride, or anhydride groups, illustrated below wherein polymers of formula I are coupled to form polymers of formula II or IV as follows:

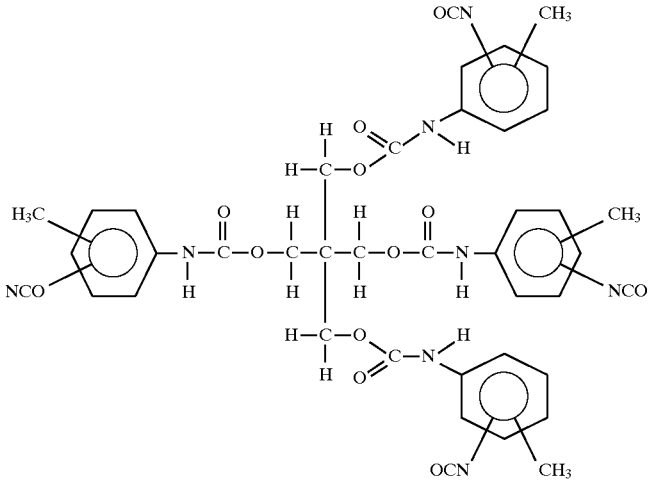

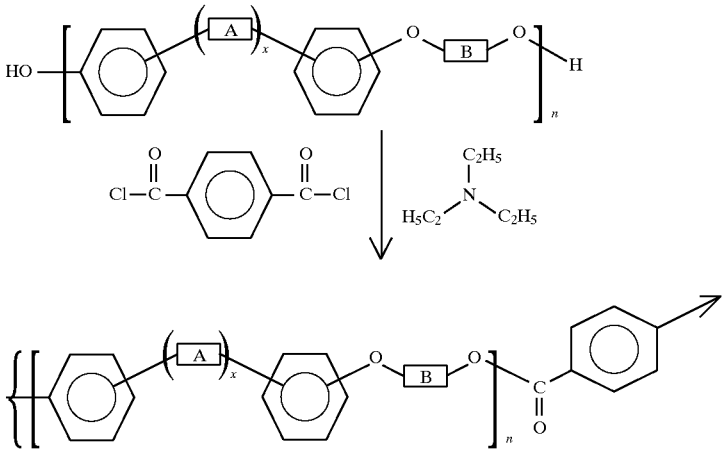

-continued

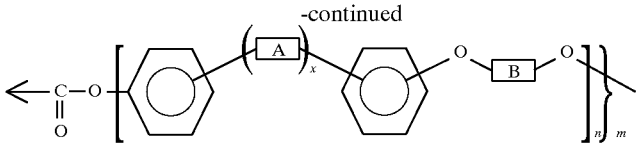

or

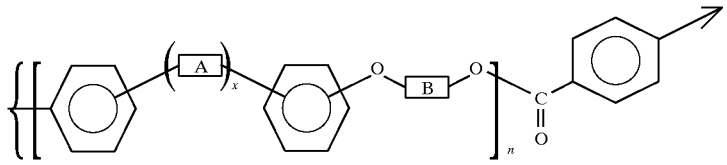

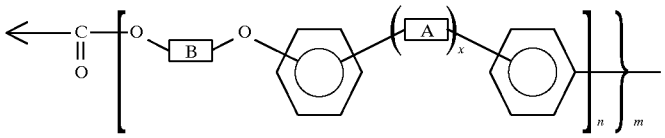

Typical diester and diacid chloride reactants are of the general formulae

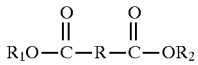

and

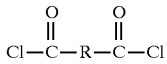

wherein R, $R_1$, and $R_2$ are each, independently from the others, alkyl groups, including cyclic and substituted alkyl groups, preferably with from 1 to about 30 carbon atoms, aryl groups, including substituted aryl groups, preferably with from 6 to about 30 carbon atoms, or arylalkyl groups, including substituted arylalkyl groups, preferably with from 7 to about 30 carbon atoms, or mixtures thereof. Typical dianhydride reactants are of the general formula

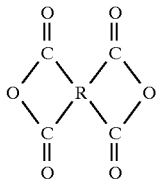

wherein R is an alkyl group, including cyclic and substituted alkyl groups, preferably with from 1 to about 30 carbon atoms, an aryl group, including substituted aryl groups, preferably with from 6 to about 30 carbon atoms, or an arylalkyl group, including substituted arylalkyl groups, preferably with from 7 to about 30 carbon atoms, or mixtures thereof. The hydroxy-terminated oligomer films are heated with the diester, diacid chloride, or dianhydride (phthalic acid diester or dianhydride, for example) up to 150° C. for about 30 minutes to chain-extend the polymer.

In another example, a hydroxy-terminated oligomer can be reacted with a diepoxy compound or a dianhydride to couple the oligomers with epoxy group derivatives, illustrated below wherein polymers of formula I are coupled to form polymers of formula III or IV as follows:

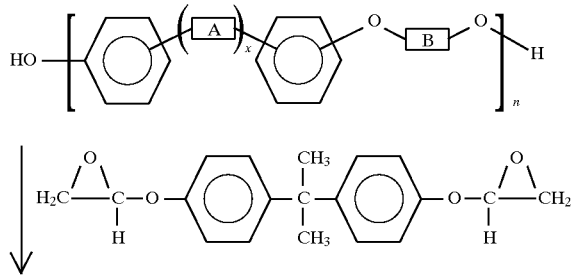

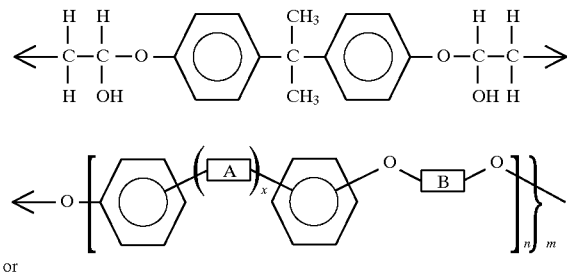

or

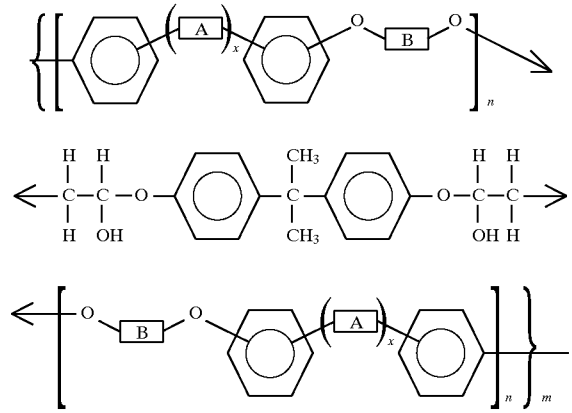

Typical diepoxy reactants are of the general formula

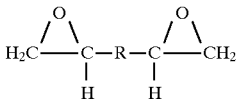

wherein R, $R_1$, and $R_2$ are each, independently from the others, alkyl groups, including cyclic and substituted alkyl groups, preferably with from 1 to about 30 carbon atoms, aryl groups, including substituted aryl groups, preferably with from 6 to about 30 carbon atoms, or arylalkyl groups, including substituted arylalkyl groups, preferably with from 7 to about 30 carbon atoms, or mixtures thereof. R can also be polymeric, and the resulting diepoxy can be a monomer or a polymer. Specific suitable diepoxy reactants include those where R is

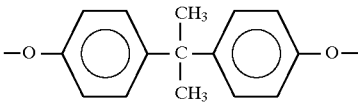

such as EPON® 828 resin, commercially available from Shell Oil Co., Houston, Tex., those where R is

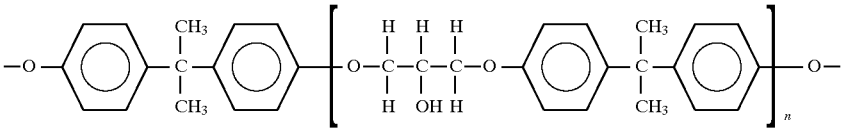

wherein n represents the number of repeat monomer units and typically is from about 1 to about 26, such as the other resins in the EPON® series, those where R is

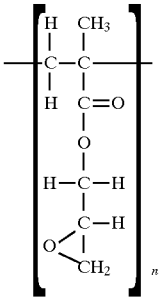

wherein n represents the number of repeat monomer units and typically is from about 1 to about 26, commercially available from Aldrich Chemical Co., Milwaukee, Wis., and the like. The hydroxy terminated oligomer films are heated with the epoxy resin (EPON 828) and a dianhydride or triethylamine (10 weight percent) to chain-extend the polymer at 135° C. for 30 minutes.

Polymers of the general formula

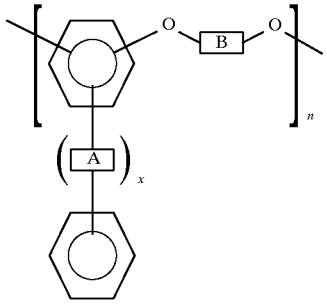

can also be coupled by these methods, and polymers of formulae IV, V, VI, VII, VIII, IX, and X can also be prepared by these methods.

Other layers, such as conventional electrically conductive ground strip along one edge of the belt in contact with the conductive layer, blocking layer, adhesive layer or charge generating layer to facilitate connection of the electrically conductive layer of the photoreceptor to ground or to an electrical bias, may also be included. Ground strips are well known and usually comprise conductive particles dispersed in a film forming binder.

Optionally, an overcoat layer may also be utilized to improve resistance to abrasion. In some cases an anti-curl back coating may be applied to the surface of the substrate opposite to that bearing the photoconductive layer to provide flatness and/or abrasion resistance. These overcoating and anti-curl back coating layers are well known in the art and may comprise thermoplastic organic polymers or inorganic polymers that are electrically insulating or slightly semi-conductive. Overcoatings are continuous and generally have a thickness of less than about 10 micrometers. The thickness of anti-curl backing layers should be sufficient to substantially balance the total forces of the layer or layers on the opposite side of the supporting substrate layer. The total forces are substantially balanced when the belt has no noticeable tendency to curl after all the layers are dried. For example, for an electrophotographic imaging member in which the bulk of the coating thickness on the photoreceptor side of the imaging member is a transport layer containing predominantly polycarbonate resin and having a thickness of about 24 microns on a Mylar substrate having a thickness of about 76 microns, sufficient balance of forces can be achieved with a 13.5 micrometers thick anti-curl layer containing about 99 percent by weight polycarbonate resin, about 1 percent by weight polyester and between about 5 and about 20 percent of coupling agent treated crystalline particles. An example of an anti-curl backing layer is described in U.S. Pat. No. 4,654,284 the disclosure of which is totally incorporated herein by reference. A thickness between about 70 and about 160 microns is a satisfactory range for flexible photoreceptors.

The present invention also encompasses a method of generating images with the photoconductive imaging members disclosed herein. The method comprises the steps of generating an electrostatic latent image on a photoconductive imaging member of the present invention, developing the latent image, and transferring the developed electrostatic image to a substrate. Optionally, the transferred image can be permanently affixed to the substrate. Development of the image may be achieved by a number of methods, such as cascade, touchdown, powder cloud, magnetic brush, and the like. Transfer of the developed image to a substrate may be by any method, including those making use of a corotron or a biased charging roll. The fixing step may be performed by means of any suitable method, such as radiant flash fusing, heat fusing, pressure fusing, vapor fusing, and the like. Any material used in xerographic copiers and printers may be used as a substrate, such as paper, transparency material, or the like.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

A

A polyarylene ether ketone of the formula

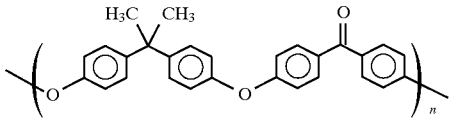

(hereinafter referred to as poly(4-CPK-BPA)) wherein n is between about 6 and about 30 and represents the number of repeating monomer units was prepared as follows. A 1 liter, 3-neck round-bottom flask equipped with a Dean-Stark (Barrett) trap, condenser, mechanical stirrer, argon inlet, and stopper was situated in a silicone oil bath. 4,4'-Dichlorobenzophenone (Aldrich 11,370, Aldrich Chemical Co., Milwaukee, Wis., 50 grams), bis-phenol A (Aldrich 23,965-8, 48.96 grams), potassium carbonate (65.56 grams), anhydrous N,N-dimethylacetamide (300 milliliters), and toluene (55 milliliters) were added to the flask and heated to 175° C. (oil bath temperature) while the volatile toluene component was collected and removed. After 24 hours of heating at 175° C. with continuous stirring, an aliquot of the reaction product that had been precipitated into methanol was analyzed by gel permeation chromatography (gpc) (elution solvent was tetrahydrofuran) with the following results: $M_n$ 4464, $M_{peak}$ 7583, $M_w$ 7927, $M_z$ 12,331, and $M_{z+1}$ 16,980. After 48 hours at 175° C. with continuous stirring, the reaction mixture was filtered to remove potassium carbonate and precipitated into methanol (2 gallons). The polymer (poly(4-CPK-BPA)) was isolated in 86% yield after filtration and drying in vacuo. GPC analysis was as follows: $M_n$ 5347, $M_{peak}$ 16,126, $M_w$ 15,596, $M_z$ 29,209, and $M_{z+1}$ 42,710. The glass transition temperature of the polymer was about 120°±10° C. as determined using differential scanning calorimetry at a heating rate of 20° C. per minute. Solution cast films from methylene chloride were clear, tough, and flexible. As a result of the stoichiometries used in the reaction, it is believed that this polymer had end groups derived from bis-phenol A.

B

A polyarylene ether ketone of the formula

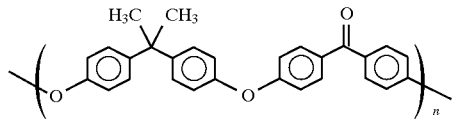

(hereinafter referred to as poly(4-FPK-BPA)) wherein n is about 123 and represents the number of repeating monomer units was prepared as follows. A 1 liter, 3-neck round-bottom flask equipped with a Dean-Stark (Barrett) trap, condenser, mechanical stirrer, argon inlet, and stopper was situated in a silicone oil bath. 4,4'-Difluorobenzophenone (Aldrich 11,549-5, Aldrich Chemical Co., Milwaukee, Wis., 21.82 grams), bis-phenol A (Aldrich 23,965-8, 22.64 grams), potassium carbonate (40.0 grams), anhydrous N,N-dimethylacetamide (300 milliliters), and toluene (52 milliliters) were added to the flask and heated to 175° C. (oil bath temperature) while the volatile toluene component was collected and removed. After 5 hours of heating at 175° C. with continuous stirring, phenol (5 grams) was added and heating at 170° C. with stirring was continued for 30 minutes more. After cooling to 25° C., the reaction mixture was stirred with 500 grams of methylene chloride and filtered to remove potassium carbonate. The filtrate was added to methanol (3 gallons). The precipitate was collected by filtration, washed with 2.5 gallons of water, and then washed with 1 gallon of methanol. The polymer (poly(4-FPK-BPA)) was isolated in 90 percent yield after filtration and drying in vacuo. GPC analysis was as follows: $M_n$ 30,000, $M_w$ 75,000. The glass transition temperature of the polymer was about 140° C. as determined using differential scanning calorimetry at a heating rate of 20° C. per minute. As a result of the stoichiometries used in the reaction, it is believed that this polymer had end groups derived from oxy-phenyl groups. The polymer dissolved in methylene chloride at 10 percent by weight solids was added to methanol (1 gallon) using a Waring blender to reprecipitate the polymer. The polymer was isolated by filtration and vacuum dried. This material was subsequently used as the transport layer in photoreceptors.

EXAMPLE II

A polymer of the formula

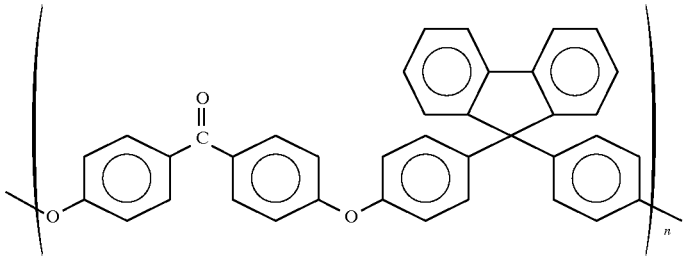

(hereinafter referred to as poly(4-FPK-FBPA)) wherein n is about 130 and represents the number of repeating monomer units was prepared as follows. A 1-liter, 3-neck round-bottom flask equipped with a Dean-Stark (Barrett) trap, condenser, mechanical stirrer, argon inlet, and stopper was situated in a silicone oil bath. 4,4'-Difluorobenzophenone (Aldrich Chemical Co., Milwaukee, Wis., 43.47 grams, 0.1992 mol), 9,9'-bis(4-hydroxyphenyl)fluorenone (Ken Seika, Rumson, N.J., 75.06 grams, 0.2145 mol), potassium carbonate (65.56 grams), anhydrous N,N-dimethylacetamide (300 milliliters), and toluene (52 milliliters) were added to the flask and heated to 175° C. (oil bath temperature) while the volatile toluene component was collected and removed. After 5 hours of heating at 175° C. with continuous stirring, the reaction mixture was allowed to cool to 25° C. The solidified mass was treated with acetic acid (vinegar) and extracted with methylene chloride, filtered, and added to methanol to precipitate the polymer, which was collected by filtration, washed with water, and then washed with methanol. The yield of vacuum dried product, poly(4-FPK-FBPA), was 71.7 grams. The polymer was analyzed by gel permeation chromatography (gpc) (elution solvent was tetrahydrofuran) with the following results: $M_n$ 59,100, $M_{peak}$ 144,000, $M_w$ 136,100, $M_z$ 211, 350, and $M_{z+1}$ 286,100. The reported glass transition temperature of the polymer was 240° C. as determined using differential scanning calorimetry at a heating rate of 20° C. per minute. Solution cast films from methylene chloride were clear, tough, and flexible. As a result of the stoichiometries used in the reaction, it is believed that this polymer had hydroxyl end-groups derived from fluorenone bisphenol.

EXAMPLE III

The polymers prepared in Examples IA and II (2.00 grams in each instance) were each roll milled in an amber glass bottle with methylene chloride (22.44 grams in each instance) and N,N'-diphenyl-N,N'-bis(3"-methylphenyl)-(1,1'-biphenyl)-4,4'-diamine (2.00 grams in each instance) (charge transport material, prepared as disclosed in U.S. Pat. No. 4,265,990, the disclosure of which is totally incorporated herein by reference). For comparison purposes, a third charge transport solution was prepared as disclosed except that instead of a polymer of the present invention, 2.00 grams of Makrolon® (polycarbonate resin with a molecular weight of from about 50,000 to about 100,000, obtained from Farbensabricken Bayer A. G.) The resulting solutions were each coated onto the photogenerating layers of imaging members comprising a 3 mil thick polyethylene terephthalate substrate, a vacuum deposited titanium oxide coating about 200 Angstroms thick, a 3-aminopropyltriethoxysilane charge blocking layer 300 Angstroms thick, a 49 micron thick polyester adhesive layer (49,000, obtained from E. I. du Pont de Nemours & Co., Wilmington, Del.) about 400 Angstroms thick, and a 2.5 micron thick photogenerating layer containing 7.5 percent by volume trigonal selenium, 25 percent by volume N,N'-diphenyl-N,N'-bis(3"-methylphenyl)-(1,1'-biphenyl)-4,4'-diamine, and a polyvinylcarbazole binder (67.5 percent by volume) (obtained from BASF, Mt. Olive, N.J.). The photogenerating layer in each instance was prepared by introducing 8 grams of polyvinyl carbazole and 140 milliliters of a 1:1 volume ratio of a mixture of tetrahydrofuran and toluene into a 20 ounce amber bottle. To this solution was added 8 grams of trigonal selenium and 1,000 grams of ⅛ inch (3.2 milliliter) diameter stainless steel shot. This mixture was then placed on a ball mill for 96 hours. Subsequently, 50 grams of the resulting slurry were added to a solution of 3.6 grams of polyvinyl carbazole and 20 grams of N,N'-diphenyl-N,N'-bis(3"-methylphenyl)-(1,1'-biphenyl)-4,4'-diamine dissolved in 75 milliliters of 1:1 volume ratio of tetrahydrofuran/toluene. This slurry was then placed on a shaker for 10 minutes. The resulting slurry was thereafter applied to the adhesive interface by extrusion coating to form a layer having a wet thickness of 0.5 mil (12.7 microns). This photogenerating layer was dried at 135° C. for 5 minutes in a forced air oven to form a dry thickness of 2.0 microns. (This process for preparing a photogenerating layer is also disclosed in U.S. Pat. No. 5,308,725, the disclosure of which is totally incorporated herein by reference).

Charge transport layers were then applied to the photogenerating layers thus prepared. Charge transport solutions were prepared in each instance by introducing into an amber glass bottle 2.00 grams of N,N'-diphenyl-N,N'-bis(3"-methylphenyl)-(1,1'-biphenyl)-4,4'-diamine, 2.00 grams of the same polymer used as the binder in the photogenerating layer (i.e., one with the polymer of Example IA, one with the polymer of Example II, and one with the polycarbonate), and 22.44 grams of methylene chloride and admixing the contents to prepare the solution. The charge transport solutions were applied to the photogenerator layers with a 8 mil gap Bird applicator to form a coating which was heated from 40° to 100° C. over 30 minutes to dry the layer. The charge transport layers thus applied to the imaging members had dry coating thicknesses of about 25 microns.

The electrical properties of the three imaging members thus prepared were measured with a xerographic testing scanner comprising a cylindrical aluminum drum having a diameter of 242.6 millimeters (9.55 inches) to evaluate photoelectrical integrity. The test samples were taped onto the drum. When rotated, the drum carrying the samples produced a constant surface speed of 76.3 centimeters (30 inches) per second. A direct current pin corotron, exposure light, erase light, and five electrometer probes were mounted around the periphery of the mounted photoreceptor samples. The sample charging time was 33 milliseconds. Both expose and erase lights were broad band white light (400–700 nanometer) outputs, each supplied by a 300 Watt output xenon arc lamp. The relative locations of the probes and lights are indicated in the table below:

| Element | Angle (degrees) | Position (mm) | Distance from Photoreceptor (mm) |
|---|---|---|---|
| Charge | 0.0 | 0.0 | 18 (pins)<br>12 (shield) |
| Probe 1 | 22.50 | 47.9 | 3.17 |
| Expose | 56.25 | 118.8 | N.A. |
| Probe 2 | 78.75 | 166.8 | 3.17 |
| Probe 3 | 168.75 | 356.0 | 3.17 |
| Probe 4 | 236.25 | 489.0 | 3.17 |
| Erase | 258.75 | 548.0 | 125.00 |
| Probe 5 | 303.75 | 642.9 | 317 |

The test samples were first rested in the dark for at least 60 minutes to ensure achievement of equilibrium with the testing conditions of 21.1° C. and 40.0 percent relative humidity. Each sample was then negatively charged in the dark to a development potential of about 900 volts. The charge acceptance of each sample and its residual potential after discharge by front erase exposure to 400 ergs per square centimeter were recorded. The test procedure was repeated to determine the photoinduced discharge characteristic of each sample (PIDC) by different light energies of up to 20 ergs per square centimeter. Process speed was 60.0 imaging cycles per minute. The residual electrical voltages of the imaging members with charge transport layers containing the polymer binders of the present invention were slightly higher after flood exposure than that of the imaging member with the charge transport layer containing the polycarbonate binder, but the residual voltages of the imaging members containing the polymer of the present invention gradually decreased during subsequent tests and aging. It is believed that replacing the terminal hydroxyl groups on the polymers of the present invention with other terminal groups, such as oxy-phenyl groups or the like, would further reduce these initial residual voltages. More specifically, the residual voltage for the imaging member containing the compound prepared in Example H was 68 volts after 420 imaging cycles and 15 volts after 10,402 imaging cycles, and the residual voltage for the imaging member containing the polycarbonate binder was 38 volts after 420 imaging cycles and 33 volts after 10,402 imaging cycles. Film peel strength and mechanical properties of the layers containing the polymers of the present invention were good as determined by manual manipulations.

EXAMPLE IV

A polyarylene ether ketone of the formula

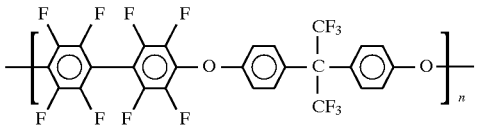

wherein n is about 120 (hereinafter referred to as poly(4-DFBP-HFBPA)) was prepared as follows. A 500-milliliter, 3-neck round-bottom flask equipped with a Dean-Stark (Barrett) trap, condenser, mechanical stirrer, argon inlet, and stopper was situated in a silicone oil bath. Decafluorobiphenyl (Aldrich D22-7, Aldrich Chemical Co., Milwaukee, Wis., 5 grams), 4,4'-(hexafluoroisopropylidene)diphenol (Aldrich 25,759-1, 5.08 grams), potassium carbonate (12.3 grams), toluene (10 milliliters) and anhydrous N,N-dimethylacetamide (75 milliliters) were added to the flask and heated at 135° C. (oil bath temperature) for 30 minutes with continuous stirring. The reaction mixture was thereafter allowed to cool to 25° C. The reaction mixture was subsequently stirred with 250 grams of tetrahydrofuran, filtered to remove potassium carbonate, concentrated using a rotary evaporator, and then precipitated into methanol (1 gallon). The precipitate was collected by filtration, washed with 2.5 gallons of water, and then washed with 1 gallon of methanol. The polymer (poly(4-FPK-HFBPA) was isolated in 90 percent yield after filtration and drying in vocuo. As a result of the stoichiometries used in the reaction, it is believed that this polymer had end groups derived from HFBPA groups. The polymer dissolved in tetrahydrofuran at 10 percent solids was added to methanol (1 gallon) using a Waring blender to reprecipitate the polymer. The polymer was then isolated by filtration and vacuum dried. This material was used as the transport layer in photoreceptors and evaluated as described in Example VIII.

EXAMPLE V

Binder Generator Layer Preparation

Several generator layers containing hydroxygallium phthalocyanine pigment particles were prepared by forming coatings using conventional coating techniques on a substrate comprising a vacuum deposited titanium layer on a polyethylene terephthalate film (Melinex®, obtained from ICI). The first coating was a siloxane barrier layer formed from hydrolyzed gammaaminopropyltriethoxysilane having a thickness of 0.005 micron (50 Angstroms). This film was coated as follows: 3-aminopropyltriethoxysilane (obtained from PCR Research Chemicals, Florida) was mixed in ethanol in a 1:50 volume ratio. A film of the resulting solution was applied to the substrate in a wet thickness of 0.5 mil by a multiple clearance film applicator. The layer was then allowed to dry for 5 minutes at room temperature, followed by curing for 10 minutes at 110° C. in a forced air oven. The second coating was an adhesive layer of polyester resin (49,000, obtained from E. I. duPont de Nemours and Co.) having a thickness of 0.005 micron (50 Angstroms) and was coated as follows: 0.5 grams of 49,000 polyester resin was dissolved in 70 grams of tetrahydrofuran and 29.5 grams of cyclohexanone. A film of the resulting solution was coated onto the barrier layer by a 0.5 mil bar and cured in a forced air oven for 10 minutes. The adhesive interface layer was thereafter coated with a photogenerating layer containing 40 percent by volume hydroxygallium phthalocyanine and 60 percent by volume of a block copolymer of styrene (82 percent)/4-vinyl pyridine (18 percent) having a $M_w$ of 11,900. This photogenerating coating composition was prepared by dissolving 1.5 grams of the block copolymer of styrene/4-vinyl pyridine in 42 milliliters of toluene. To this solution was added 1.33 grams of hydroxygallium phthalocyanine and 300 grams of ⅛ inch diameter stainless steel shot. This mixture was then placed on a roll (ball) mill for 20 hours. The resulting slurry was thereafter applied to the adhesive layer with a Bird bar applicator to form a layer having a wet thickness of 0.25 mil. This photogenerating layer was dried at 135° C. for 5 minutes in a forced air oven to form a layer having a dry thickness of 0.4 micron.

EXAMPLE VI

Makrolon® Control Transport Layer Preparation

A charge transport layer was coated onto the hydroxygallium phthalocyanine generator layer of an imaging member prepared as described in Example V. The transport layer was formed by using a Bird coating applicator to apply a solution containing one gram of N,N'-diphenyl-N,N'-bis(3-methyl-phenyl)-(1,1'-biphenyl)-4,4'-diamine and one gram of polycarbonate resin [poly(4,4'-isopropylidene-diphenylene carbonate (available as Makrolon® from Farbenfabricken Bayer A. G.)] dissolved in 11.5 grams of methylene chloride solvent. The N,N'-diphenyl-N,N'-bis(3-methyl-phenyl)-(1,1'-biphenyl)-4,4'-diamine is an electrically active aromatic diamine charge transport small molecule, and the polycarbonate resin is an electrically inactive film-forming binder. The coated device was dried at 80° C. for half an hour in a forced air oven to form a dry 25 micron thick charge transport layer.

EXAMPLE VII

Charge Transport Layer Preparation With Example I and Example II Polymers

A charge transport layer was coated onto the hydroxygallium phthalocyanine generator layer of an imaging member prepared as described in Example V. The transport layer was formed by using a Bird coating applicator to apply a solution of one gram of N,N'-diphenyl-N,N'-bis(3-methyl-phenyl)-(1,1'-biphenyl)-4,4'-diamine and one gram of the binder of Example II in 11.22 grams of methylene chloride. The N,N'-diphenyl-N,N'-bis(3-methyl-phenyl)-(1,1'-biphenyl)-4,4'-diamine is an electrically active aromatic diamine charge transport small molecule and the binder resin of Example II is an electrically inactive film forming binder. The coated device was dried at 80° C. for 0.5 hour in a forced air oven to form a dry 25 micron thick charge transport layer. By the same process, a device was made with the polymer of Example IA and IB.

EXAMPLE VIII

Imaging members prepared as described in Examples VI and VII and containing the binder resins of Examples IA, IB, and II and the control MAKROLON® polycarbonate binder resin were mounted on a cylindrical aluminum drum which was rotated on a shaft. The films were charged by a corotron mounted along the circumference of the drum. The surface potentials were measured as a function of time by several capacitively coupled probes placed at different locations around the shaft. The probes were calibrated by applying known potentials to the drum substrate. The films on the drum were then exposed and erased by light sources located at appropriate positions around the drum. The measurement consisted of charging the photoconductor devices in a constant current or voltage mode. As the drum rotated, the initial charging potential was measured by probe 1. Further rotation led to the exposure station, where the photoconductor devices were exposed to monochromatic radiation of known intensity. The surface potential after exposure was measured by probes 2 and 3. The devices were finally exposed to an erase lamp of appropriate intensity and any residual potential was measured by probe 4. The process was repeated with the magnitude of the exposure automatically changed during the next cycle. A photo-induced discharge characteristics curve was obtained by plotting the potentials at probes 2 and 3 as a function of exposure. The initial slope of the discharge curve is termed S in units of (volts×cm$^2$/ergs) and the residual potential after the erase step is termed Vr. The devices were cycled continuously for 10,000 cycles of charge, expose and erase steps to determine the cyclic stability. Charge trapping in the transport layer results in a build up of residual potential known as cycle-up. The sensitivity data and the residual cycle-up for the four samples is shown in the table below. S represents the initial slope of the Photo-Induced Discharge Characteristics (PIDC) and is a measure of the sensitivity of the device. Cycle-up is the increase in residual potential in 10,000 cycles of continuous operation. The negative numbers of the residual cycle-up resulted from an increase in sensitivity of the pigment in the generator layer as the device was cycled. The numbers indicate that the transport layers of N,N'-diphenyl-N,N'-bis(3-methyl-phenyl)-(1,1'-biphenyl)-4,4'-diamine dispersed in the binders of the present invention were trap free. The absence of traps suggest that the diamine dispersed very well in all three of these binders.

| Binder Polymer | S volts · cm$^2$/ergs | PIDC, Vr | 1 sec Dark Decay (volt/sec) | Cyclic Characteristics (10K Cycle-up) |
|---|---|---|---|---|
| Example IA | 298 | 182 | 53 | −14 |
| Example IB | 302 | 69 | 72 | −13 |
| Example II | 303 | 31 | 80 | −9 |
| Control | 322 | 24 | 71 | −2 |

Other embodiments and modifications of the present invention may occur to those skilled in the art subsequent to a review of the information presented herein; these embodiments and modifications, as well as equivalents thereof, are also included within the scope of this invention.

What is claimed is:

1. An imaging member which comprises a conductive substrate, a photogenerating material, and a binder comprising a polymer selected from (a) those of the formulae

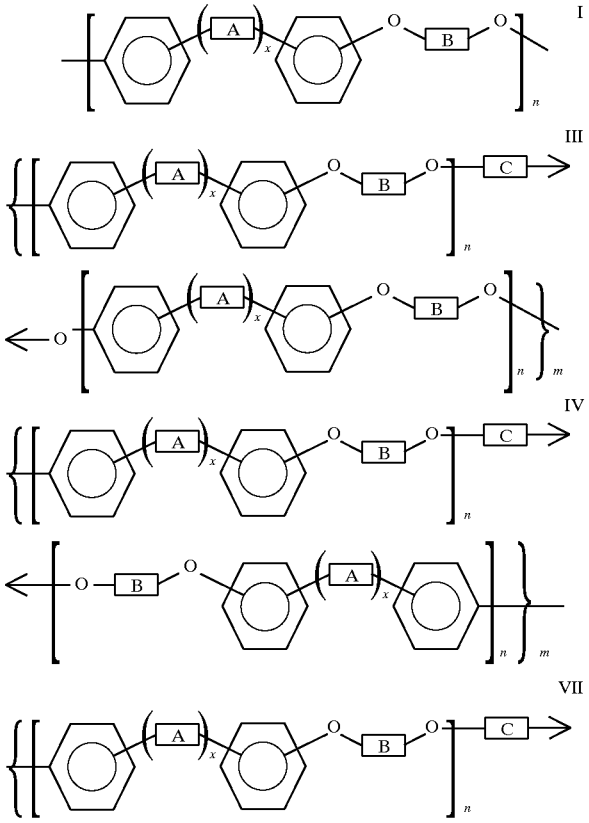

-continued
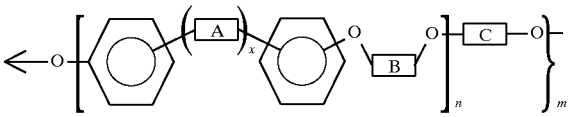
or
VIII
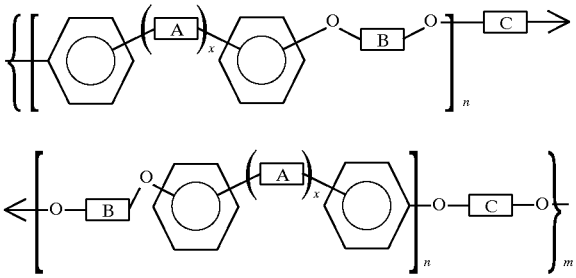
wherein x is an integer of 0 or 1, A is
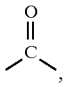
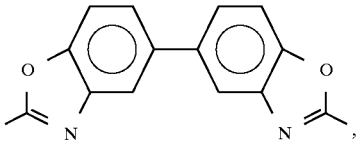
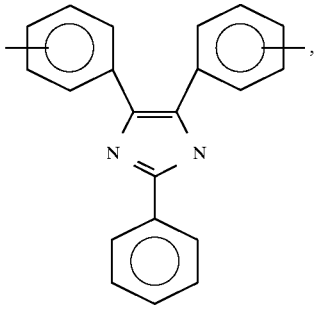
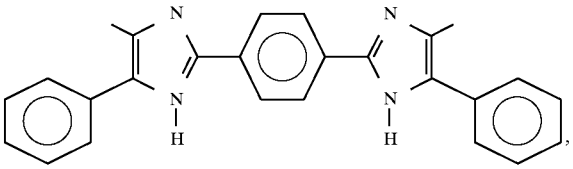
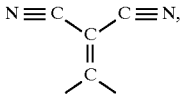
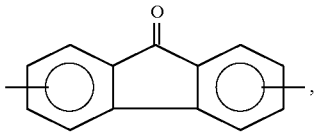
-continued
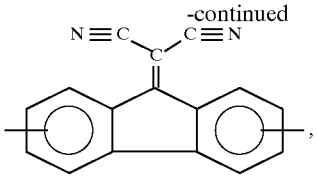
or mixtures thereof, B is
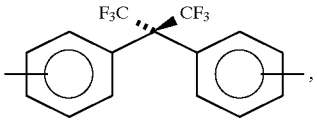
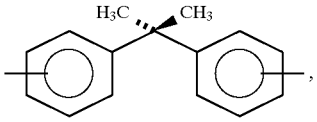
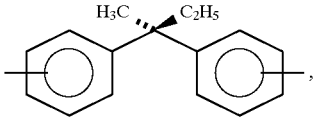
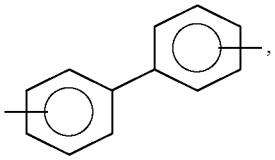
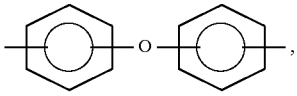
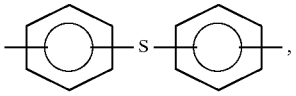
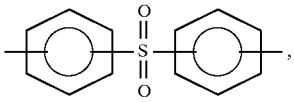
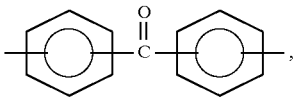
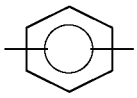
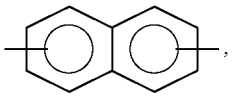
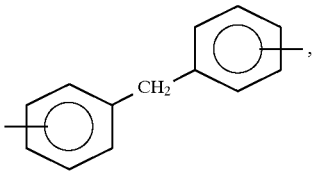

-continued
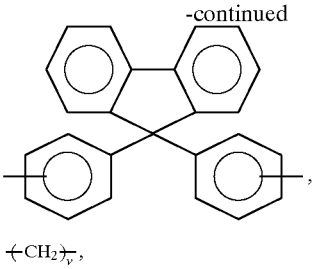
wherein v is an integer of from 1 to about 20,
$-(CH_2O)_t-$
wherein t is an integer of from 1 to about 20,
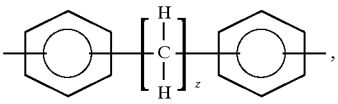
wherein z is an integer of from 2 to about 20,
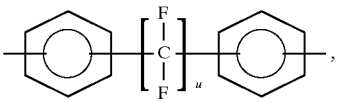
wherein u is an integer of from 1 to about 20,
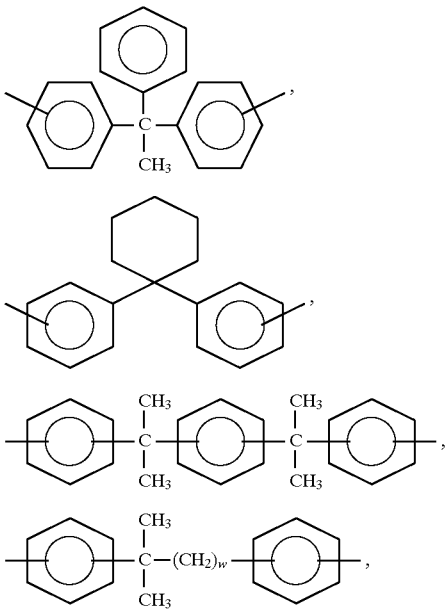
wherein w is an integer of from 1 to about 20,
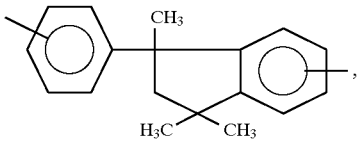
-continued
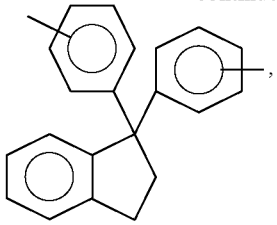
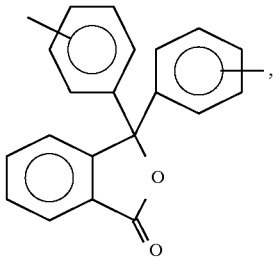
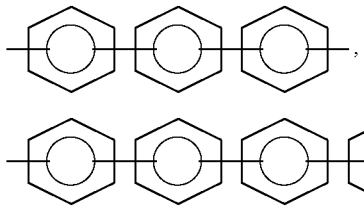
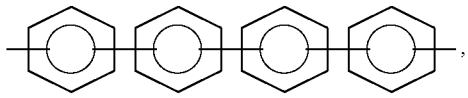
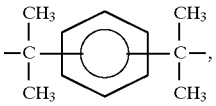
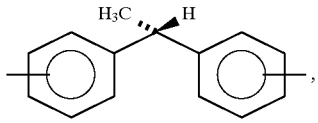
or mixtures thereof, C is
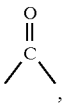
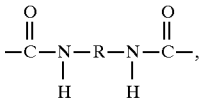
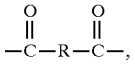
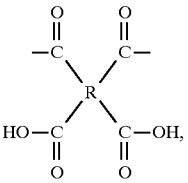
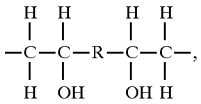

or mixtures thereof, wherein R is an alkyl group, an aryl group, an arylalkyl group, or mixtures thereof, and m and n are integers representing the number of repeating units; (b) those of the formulae
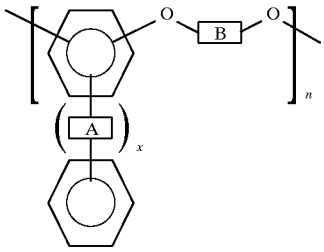
II
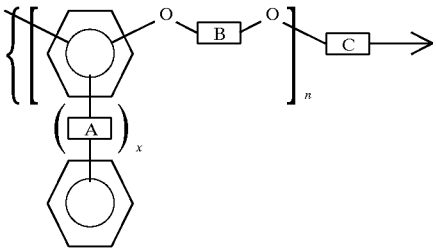
V
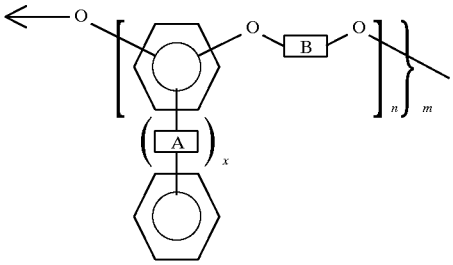
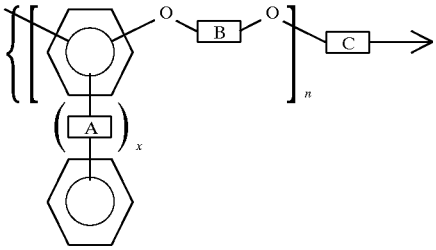
VI
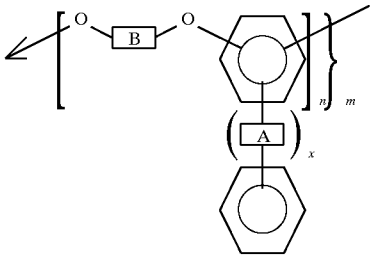
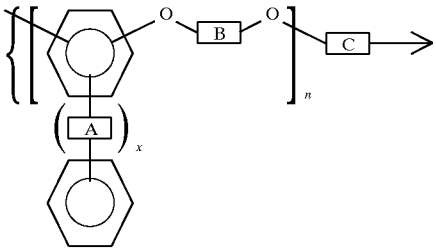
IX
-continued
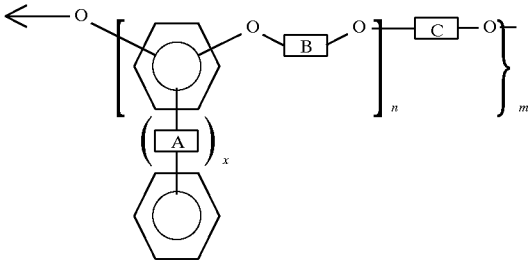
or
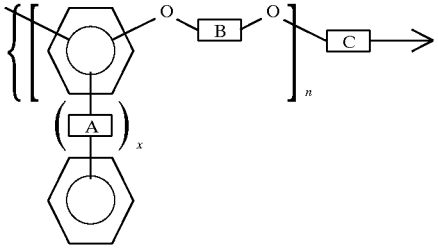
X
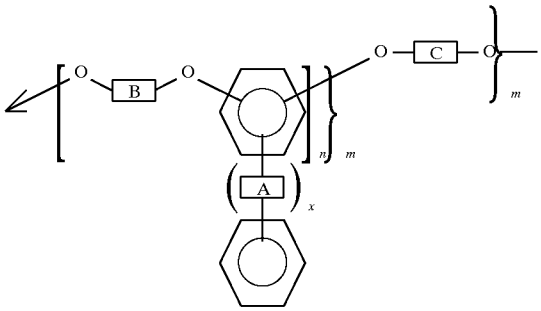
wherein x is an integer of 0 or 1, A is
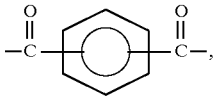
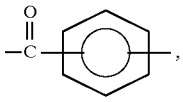
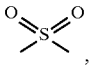
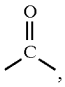
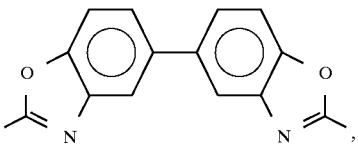

-continued
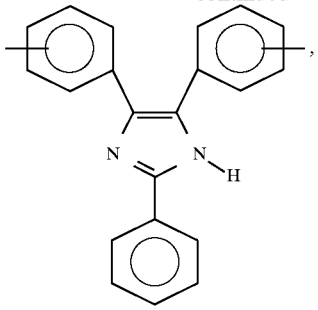
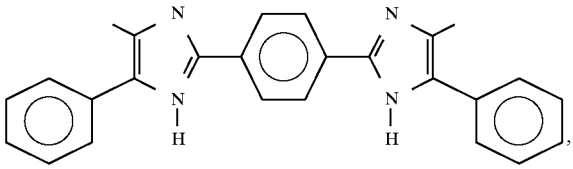
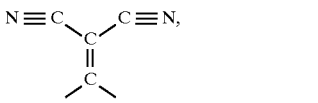
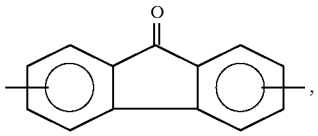
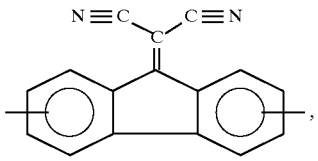
or mixtures thereof, B is
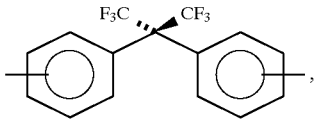
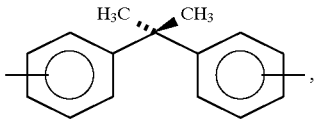
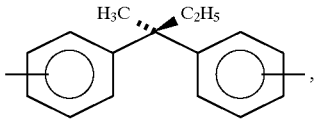
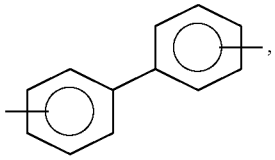
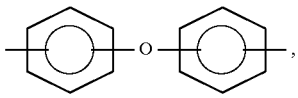
-continued
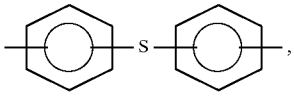
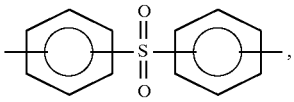
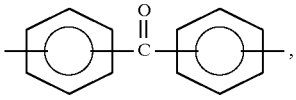
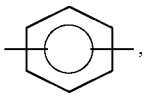
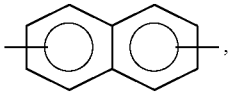
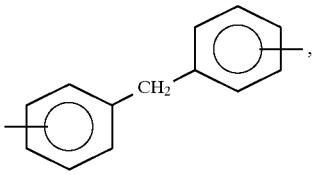
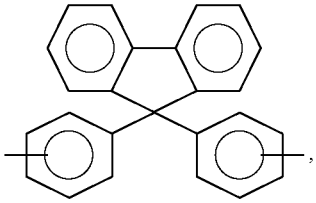
$\text{-}(CH_2)_v\text{-}$,
wherein v is an integer of from 1 to about 20,
$—(CH_2O)_t—$
wherein t is an integer of from 1 to about 20,
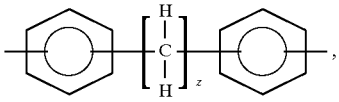
wherein z is an integer of from 2 to about 20,
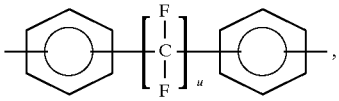
wherein u is an integer of from 1 to about 20,
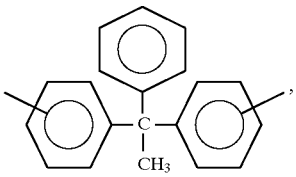

-continued
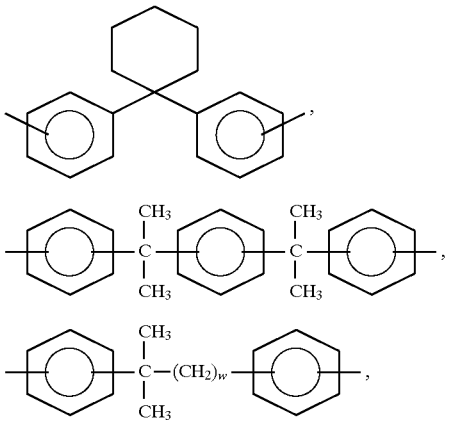
wherein w is an integer of from 1 to about 20,
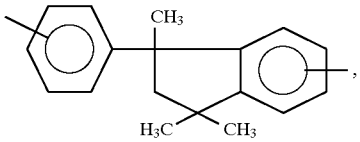
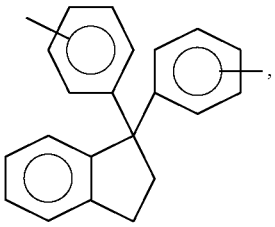
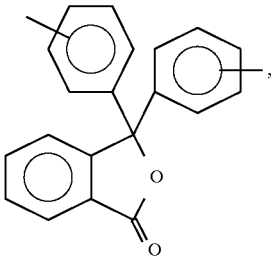
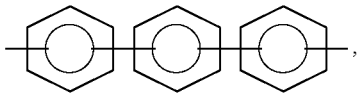
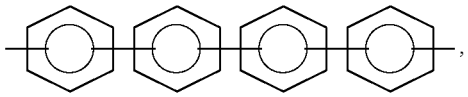
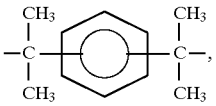
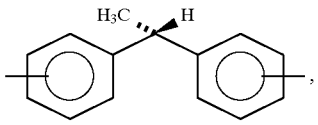
or mixtures thereof, C is
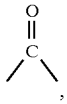
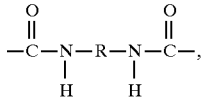
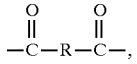
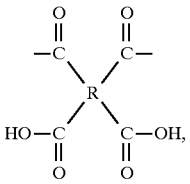
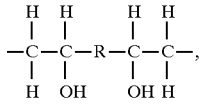
or mixtures thereof, wherein R is an alkyl group, an aryl group, an arylalkyl group, or mixtures thereof, and m and n are integers representing the number of repeating units; (c) those of formulae I, III, IV, VII, or VIII wherein x is an integer of 0 or 1, A is
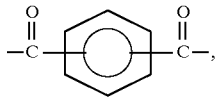
B is
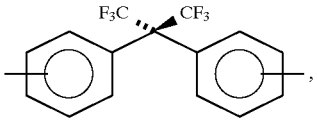
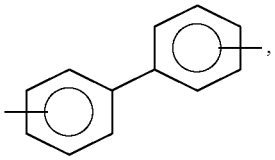
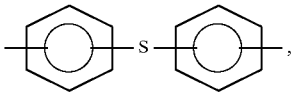
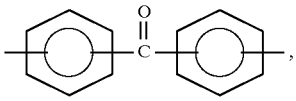
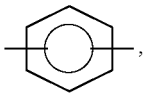

-continued

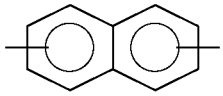

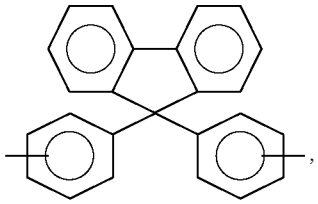

$\leftarrow CH_2 \rightarrow_v$, wherein v is an integer of from 1 to about 20, $—(CH_2O)_t—$ wherein t is an integer of from 1 to about 20,

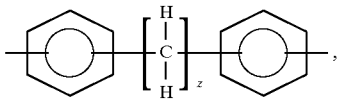

wherein z is an integer of from 2 to about 20,

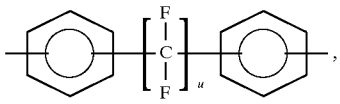

wherein u is an integer of from 1 to about 20,

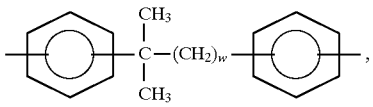

wherein w is an integer of from 1 to about 20,

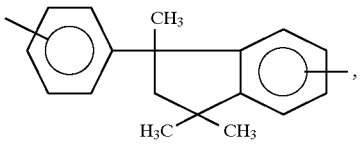

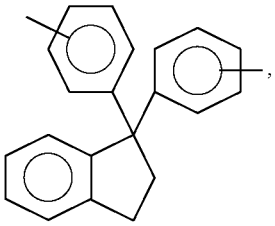

-continued

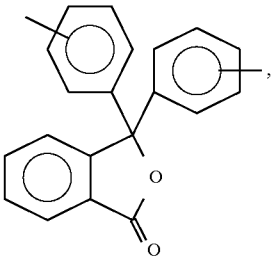

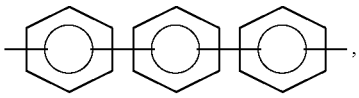

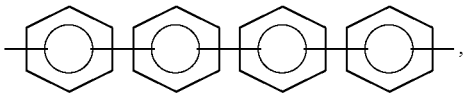

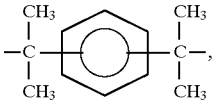

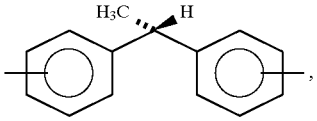

or mixtures thereof, C is

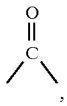

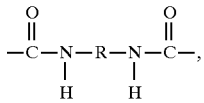

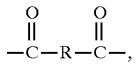

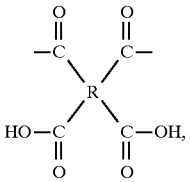

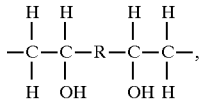

or mixtures thereof, wherein R is an alkyl group, an aryl group, an arylalkyl group, or mixtures thereof, and m and n are integers representing the number of repeating units; (d) those of formulae I, III, IV, VII, and VIII wherein x is an integer of 0 or 1, A is

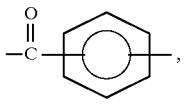
B is
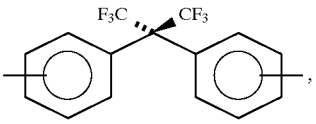
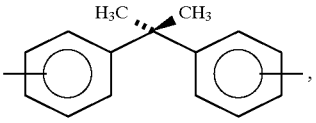
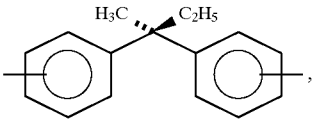
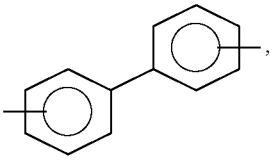
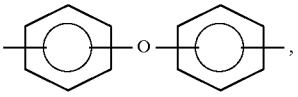
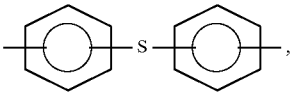
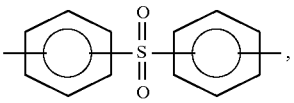
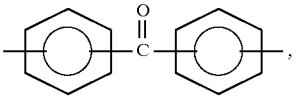
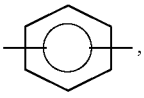
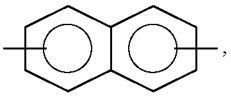
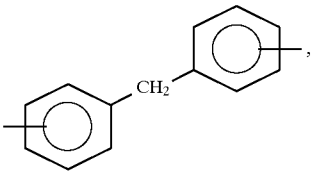
-continued
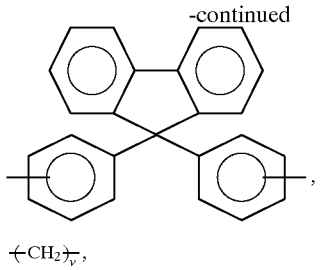
wherein v is an integer of from 1 to about 20,
$—(CH_2O)_t—$
wherein t is an integer of from 1 to about 20,
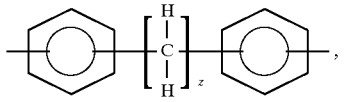
wherein z is an integer of from 2 to about 20,
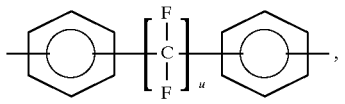
wherein u is an integer of from 1 to about 20,
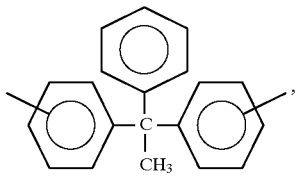
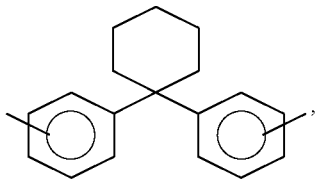
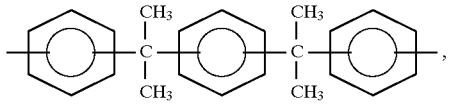
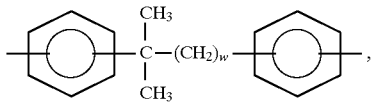
wherein w is an integer of from 1 to about 20,
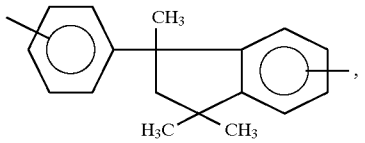

-continued
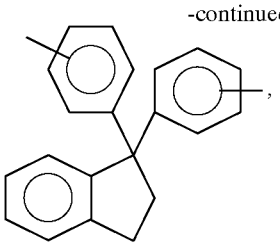
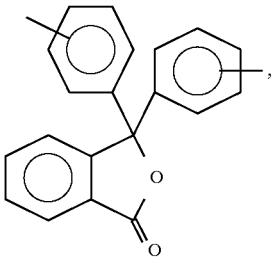
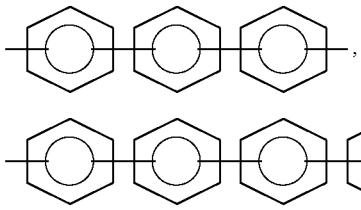
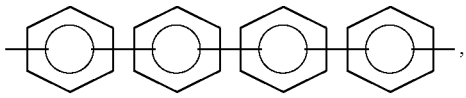
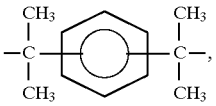
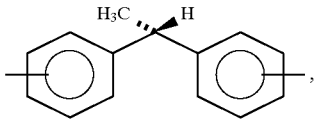
or mixtures thereof, C is
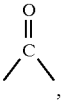
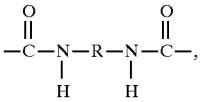
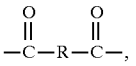
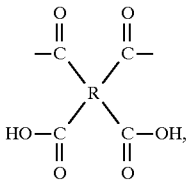
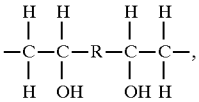
or mixtures thereof, wherein R is an alkyl group, an aryl group, an arylalkyl group, or mixtures thereof, and m and n are integers representing the number of repeating units; or (e) those of formulae I, III, IV, VII, and VIII wherein x is an integer of 0 or 1, A is
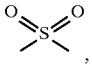
B is
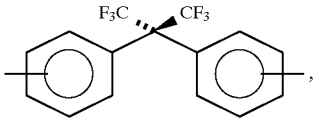
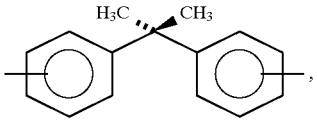
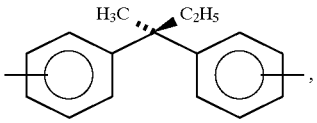
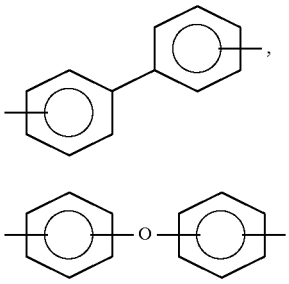
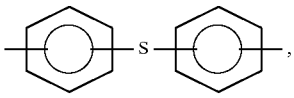
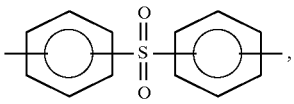
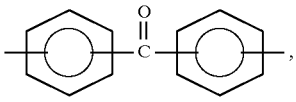
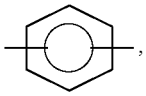
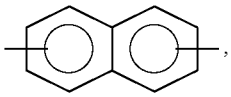

-continued
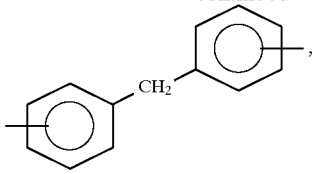
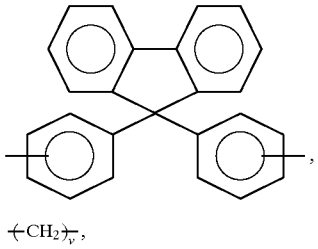
wherein v is an integer of from 1 to about 20,
$—(CH_2O)_t—$
wherein t is an integer of from 1 to about 20,
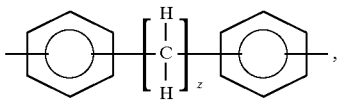
wherein z is an integer of from 2 to about 20,
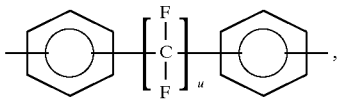
wherein u is an integer of from 1 to about 20,
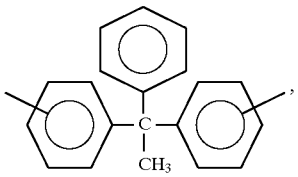
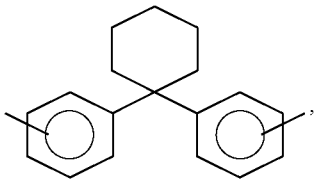
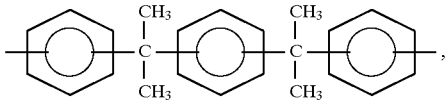
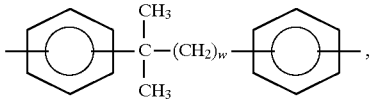
wherein w is an integer of from 1 to about 20,
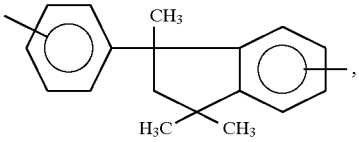
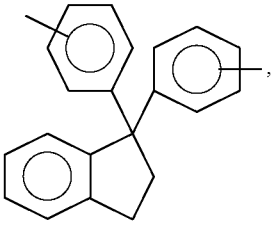
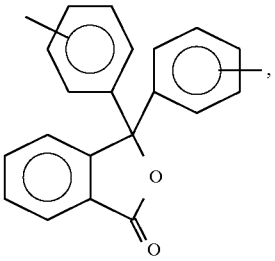
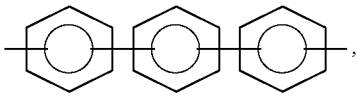
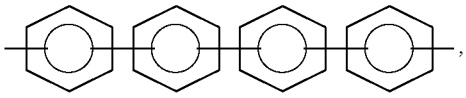
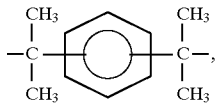
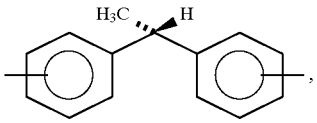
or mixtures thereof, C is
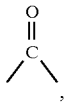
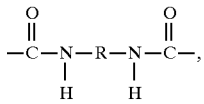
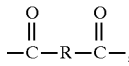

-continued

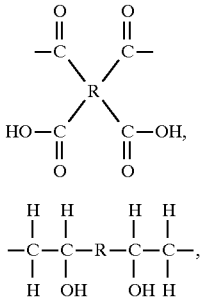

or mixtures thereof, wherein R is an alkyl group, an aryl group, an arylalkyl group, or mixtures thereof, and m and n are integers representing the number of repeating units.

2. An imaging member according to claim 1 wherein the imaging member comprises a photogenerating layer comprising from about 5 to about 80 percent by weight of the photogenerating material and from about 20 to about 95 percent by weight of the binder.

3. An imaging member according to claim 1 wherein the imaging member comprises a photogenerating layer and a charge transport layer, said charge transport layer comprising from about 5 to about 90 percent by weight of a charge transport material and from about 10 to about 95 percent by weight of the polymeric binder.

4. An imaging member according to claim 1 wherein the imaging member comprises a photogenerating layer and a charge transport layer, wherein the charge transport material is present in the charge transport layer in an amount of at least about 60 percent by weight.

5. An imaging member according to claim 1 wherein the polymer has a glass transition temperature of from about 50° to about 350° C.

6. An imaging member according to claim 1 wherein the polymer has a weight average molecular weight of from about 20,000 to about 350,000.

7. An imaging member according to claim 1 wherein the polymer has a number average molecular weight of from about 10,000 to about 100,000.

8. An imaging member according to claim 1 wherein the polymer is

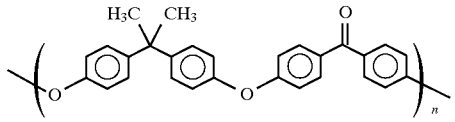

wherein n is an integer representing the number of repeating monomer units.

9. An imaging member according to claim 1 wherein the polymer is

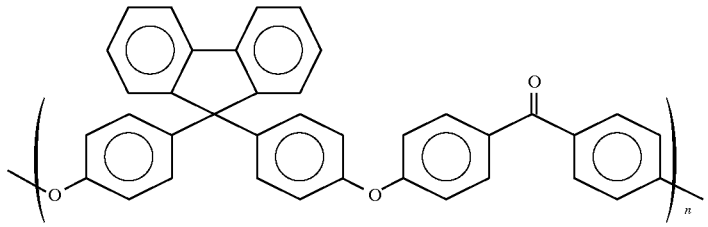

wherein n is an integer representing the number of repeating monomer units.

10. An imaging member according to claim 1 wherein the polymer is

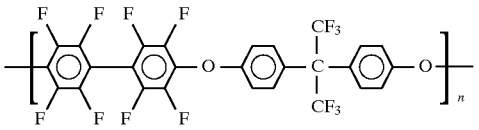

wherein n is an integer representing the number of repeating monomer units.

11. An imaging member according to claim 1 wherein the polymer is selected from

I

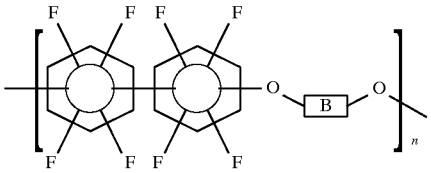

II

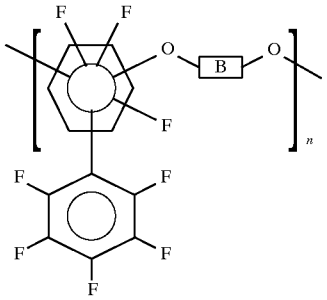

III

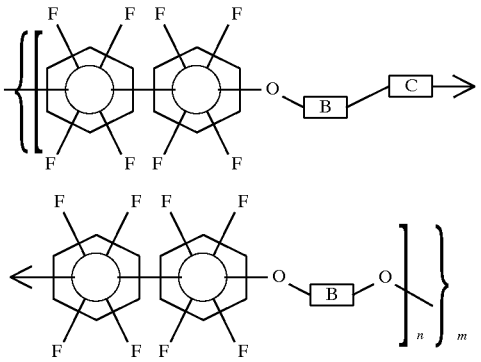

-continued
IV
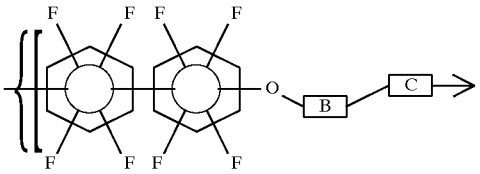
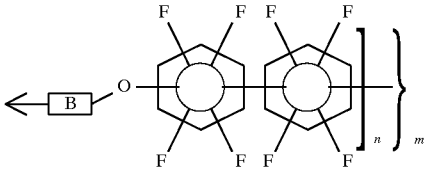
V
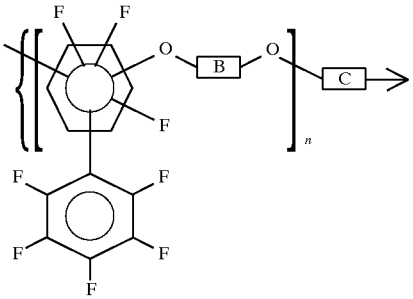
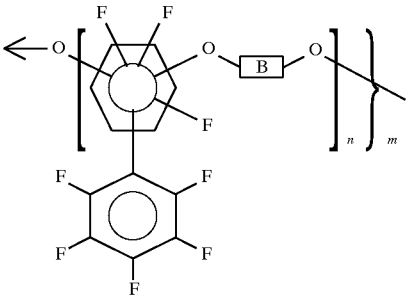
VI
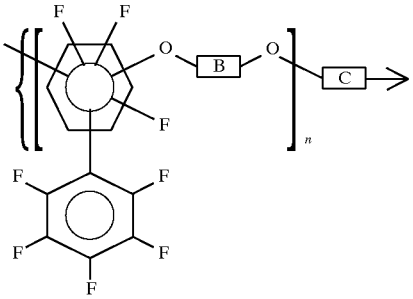
or
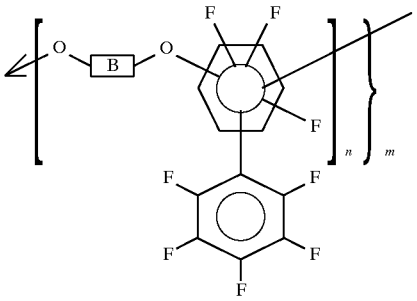
-continued
VII
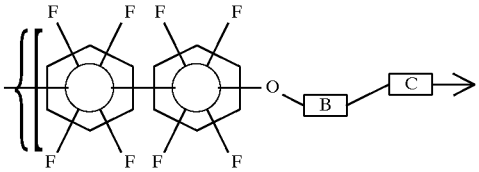
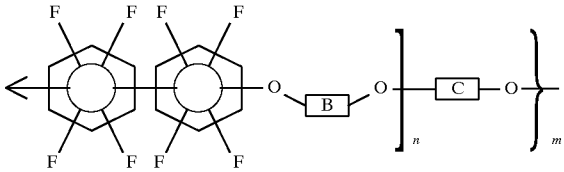
VIII
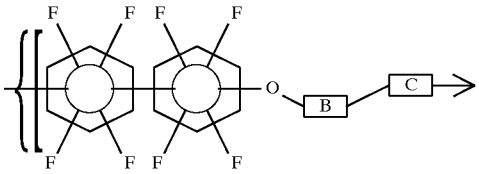
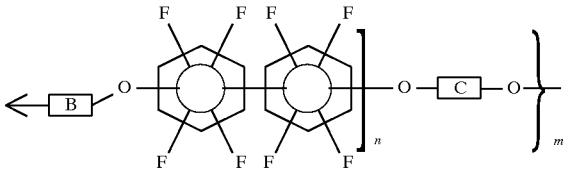
IX
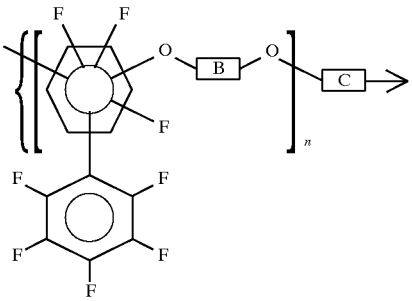
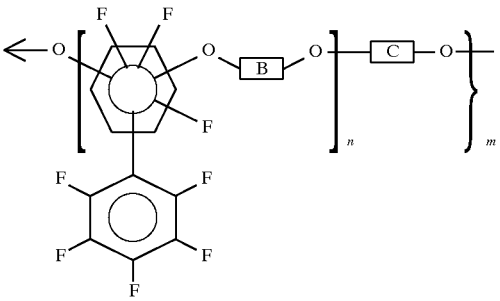
X
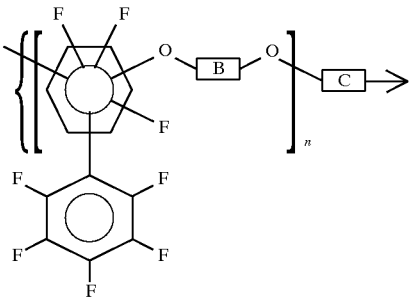

-continued
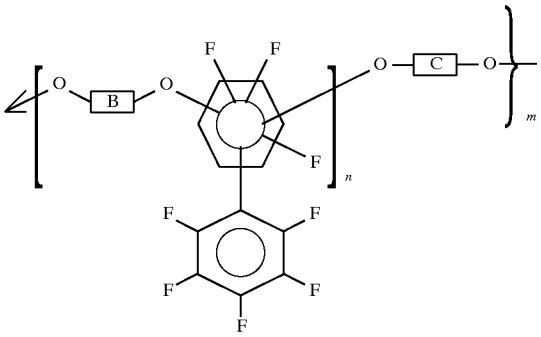
wherein x is an integer of 0 or 1, A is
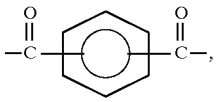
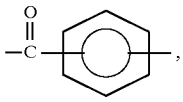
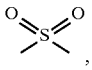
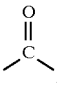
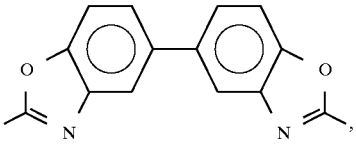
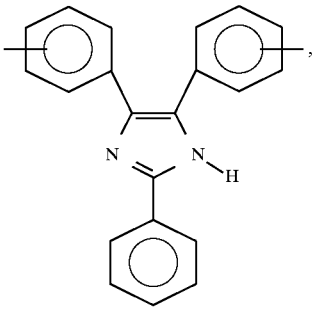
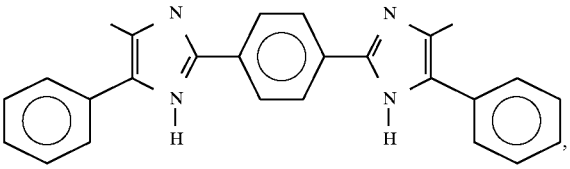
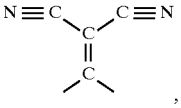
-continued
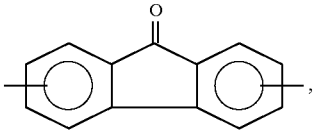
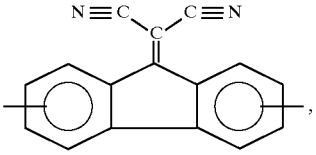
or mixtures thereof, B is
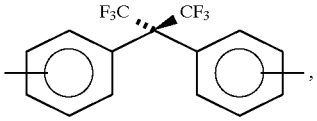
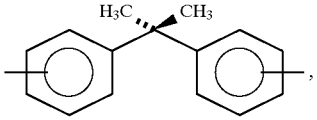
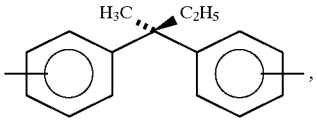
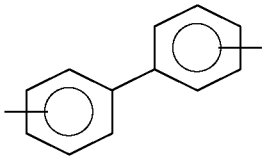
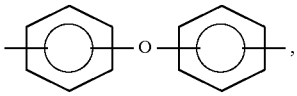
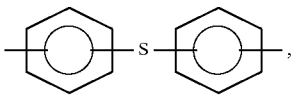
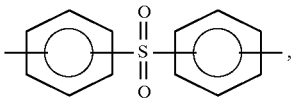
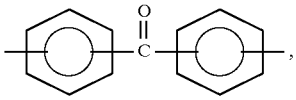
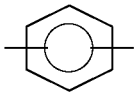
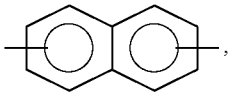

-continued
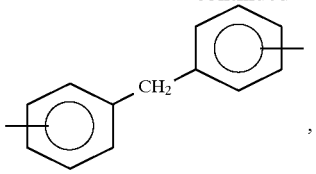
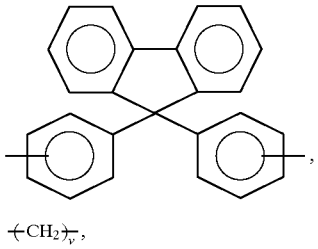
wherein v is an integer of from 1 to about 20,
$—(CH_2O)_t—$
wherein t is an integer of from 1 to about 20,
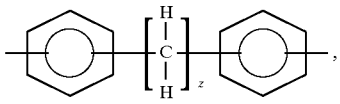
wherein z is an integer of from 2 to about 20,
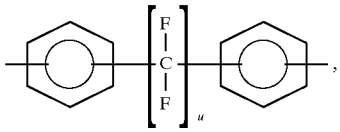
wherein u is an integer of from 1 to about 20,
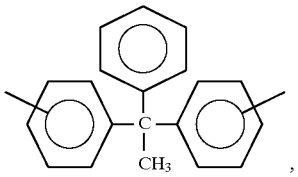
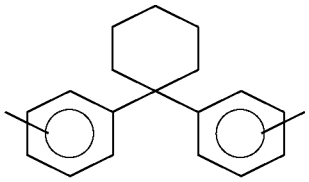
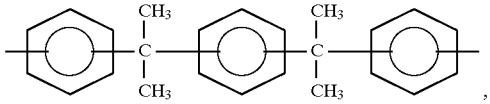
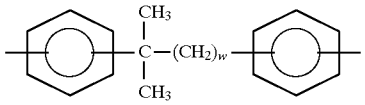
wherein w is an integer of from 1 to about 20,
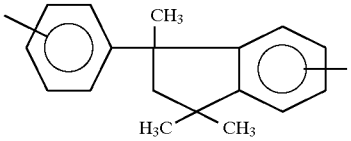
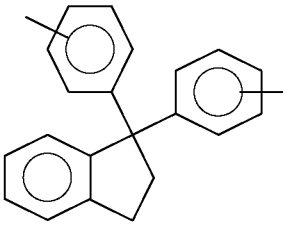
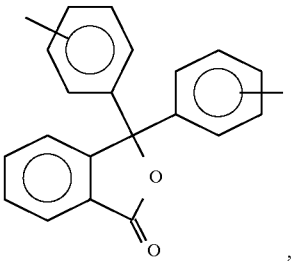
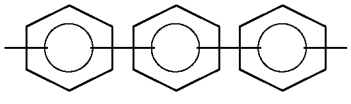
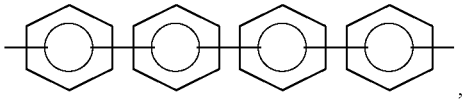
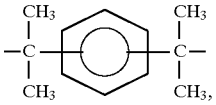
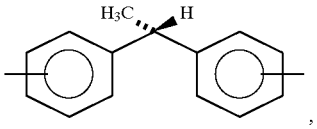
or mixtures thereof, C is
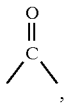
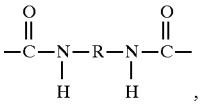
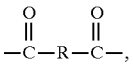

-continued
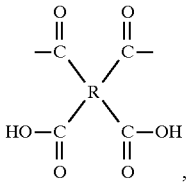
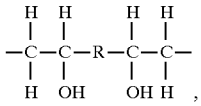
or mixtures thereof, wherein R is an alkyl group, an aryl group, an arylalkyl group, or mixtures thereof, and m and n are integers representing the number of repeating units.
12. An imaging member according to claim 1 wherein the polymer is selected from
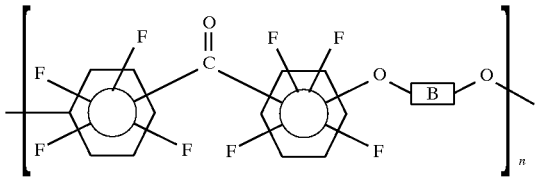
I
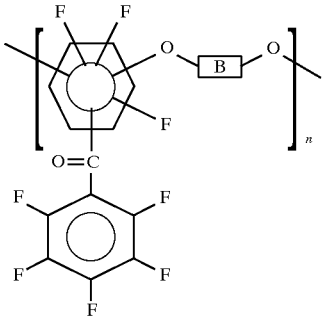
II
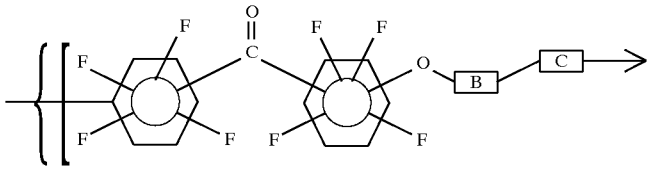
III
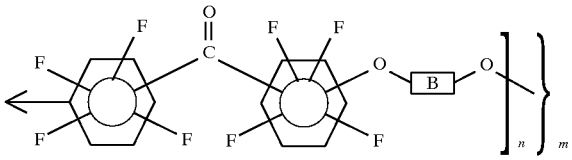
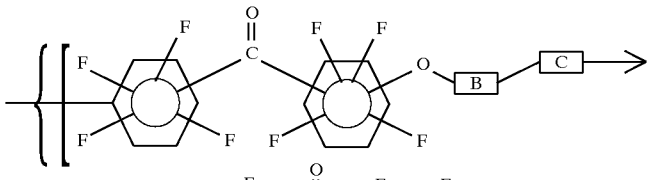
IV
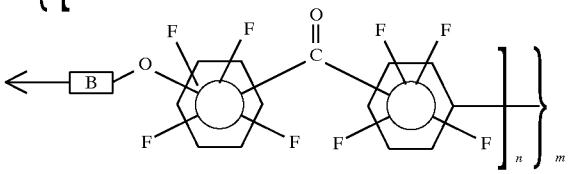

-continued
V
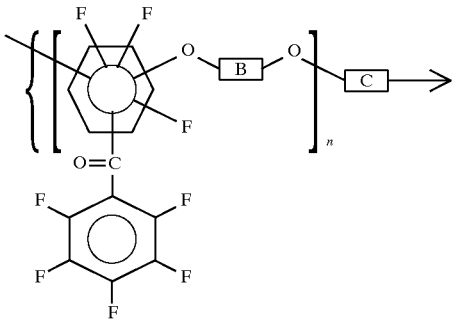
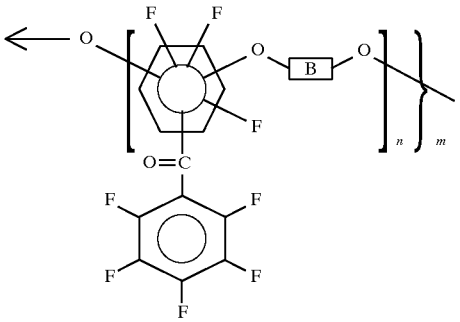
VI
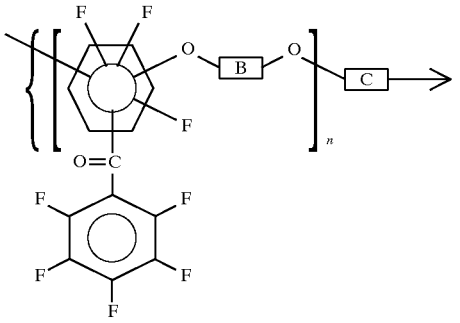
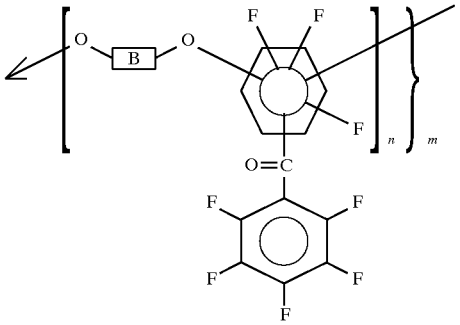
VII
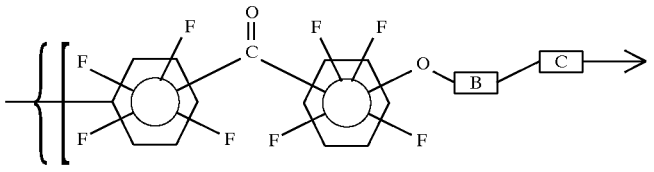
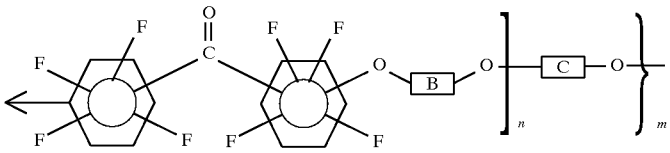

-continued
VIII
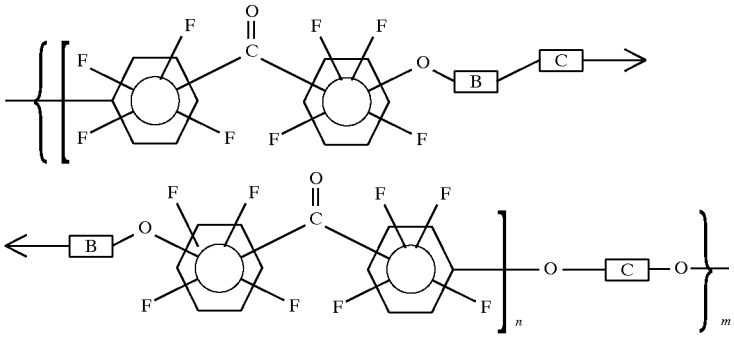
IX
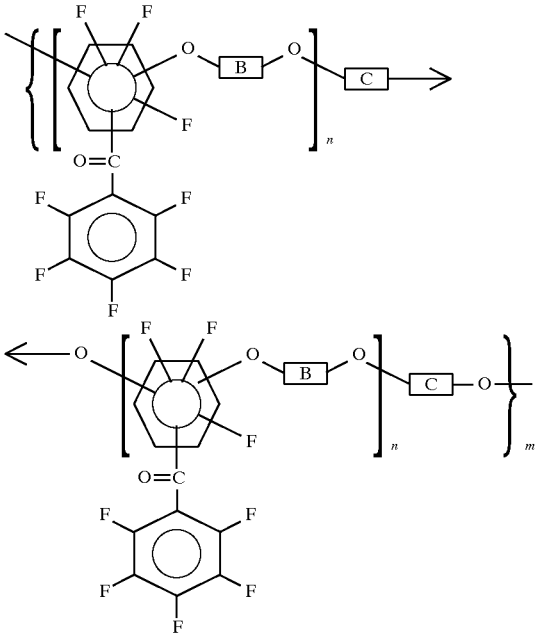
or
X
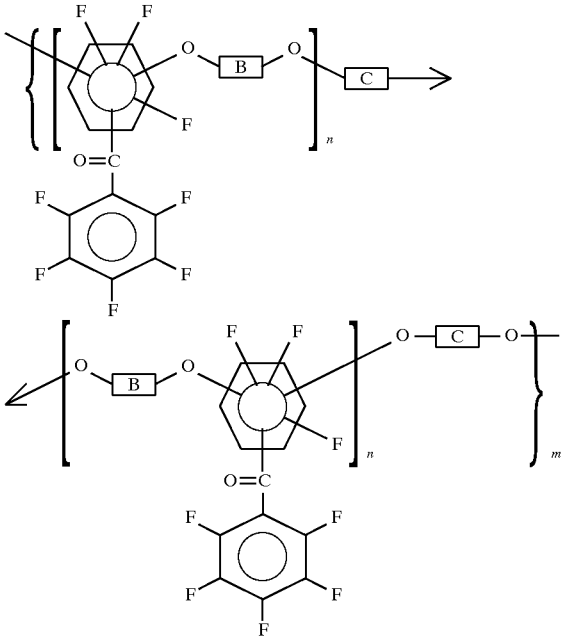

wherein x is an integer of 0 or 1, A is
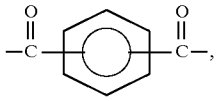
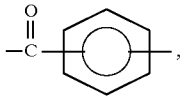
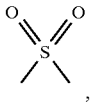
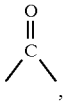
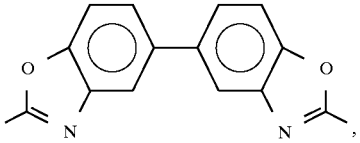
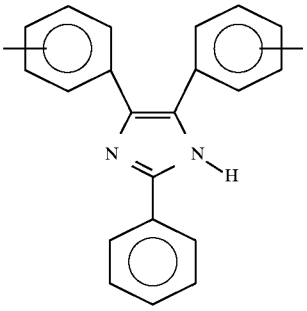
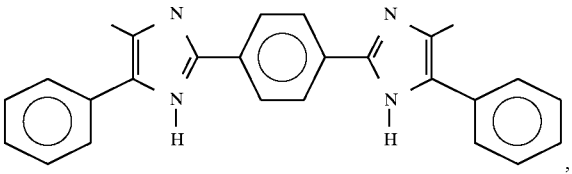
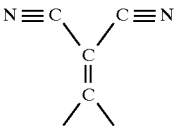
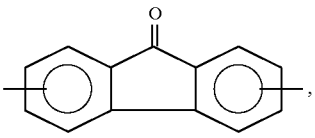
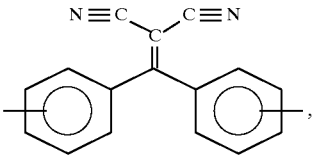
or mixtures thereof, B is
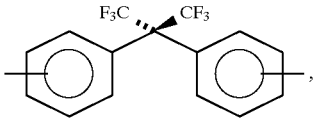
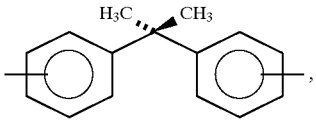
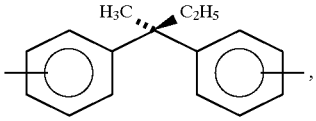
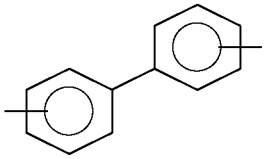
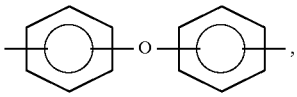
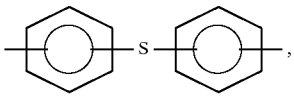
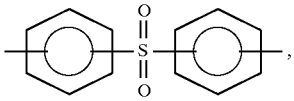
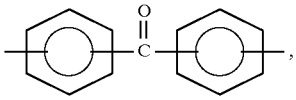
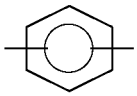
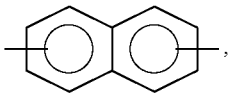
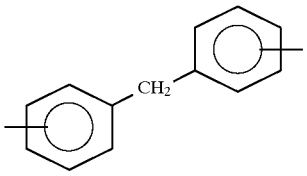
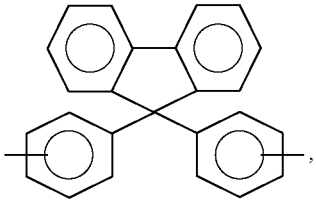

-continued $-(CH_2)_v-$, wherein v is an integer of from 1 to about 20, $-(CH_2O)_t-$ wherein t is an integer of from 1 to about 20,

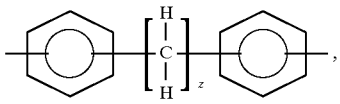

wherein z is an integer of from 2 to about 20,

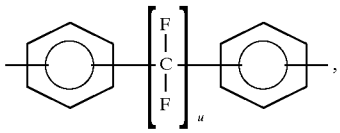

wherein u is an integer of from 1 to about 20,

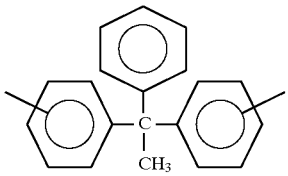

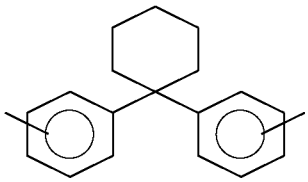

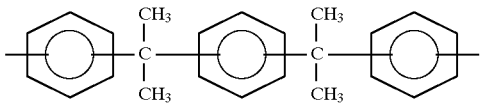

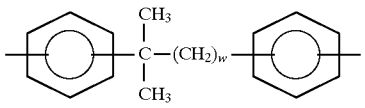

wherein w is an integer of from 1 to about 20,

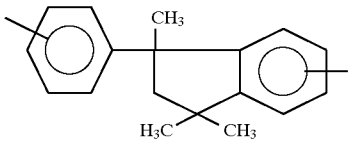

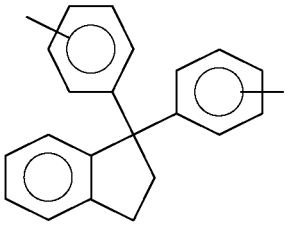

-continued

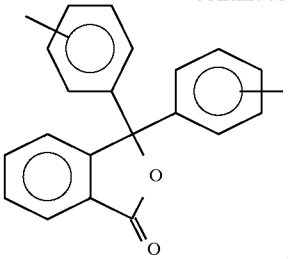

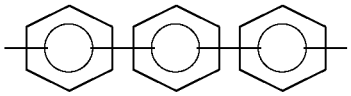

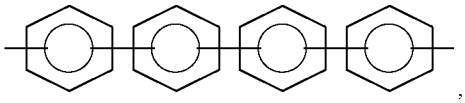

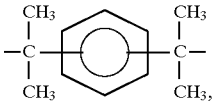

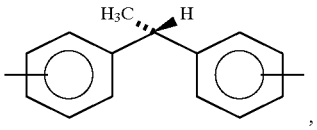

or mixtures thereof, C is

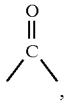

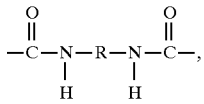

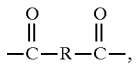

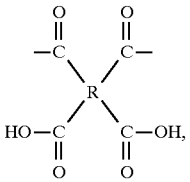

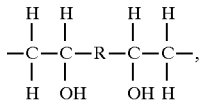

or mixtures thereof, wherein R is an alkyl group, an aryl group, an arylalkyl group, or mixtures thereof, and m and n are integers representing the number of repeating units.

13. An imaging member according to claim 1 wherein the polymer is of the formula I
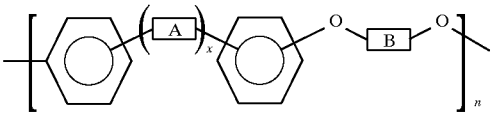
III
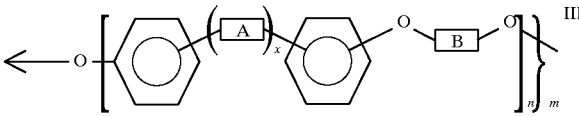
IV
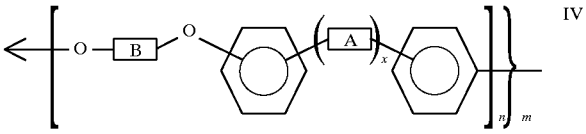
VII
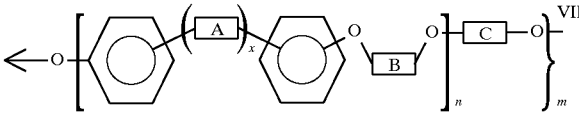
or
VIII
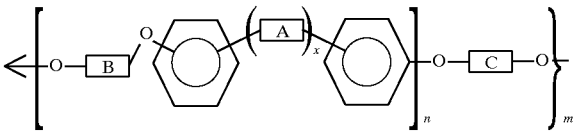
wherein x is an integer of 0 or 1, A is
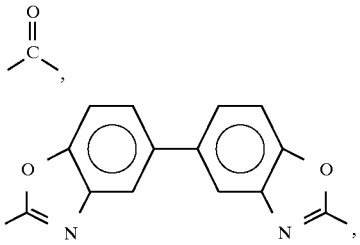
-continued
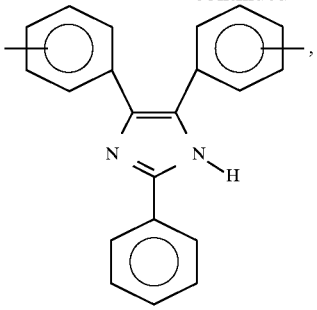
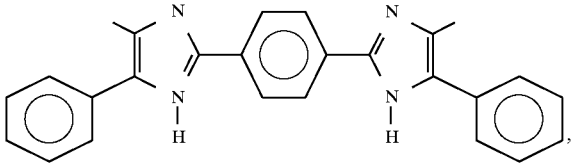
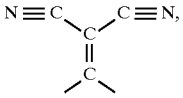
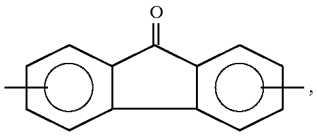
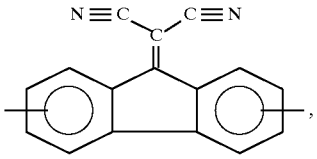
or mixtures thereof, B is
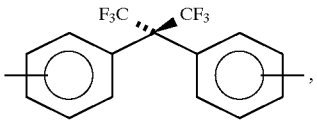
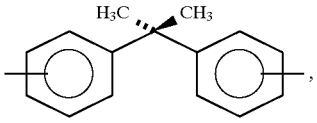
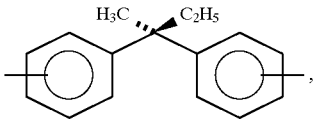
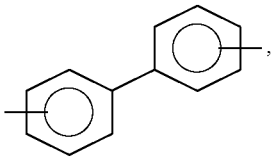
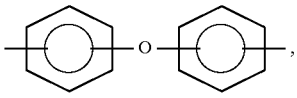

-continued
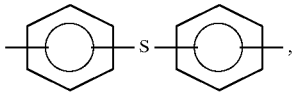
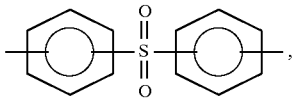
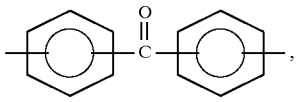
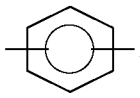
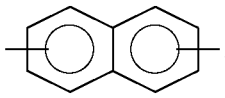
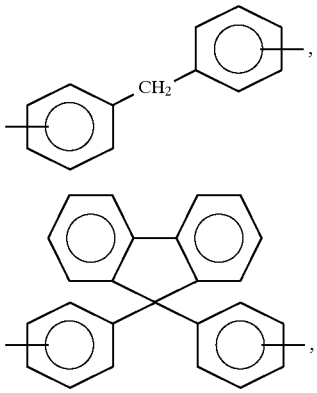
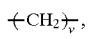
wherein v is an integer of from 1 to about 20,
$—(CH_2O)_t—$
wherein t is an integer of from 1 to about 20,
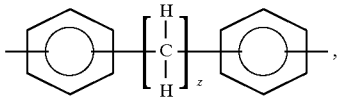
wherein z is an integer of from 2 to about 20,
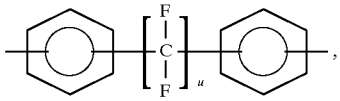
wherein u is an integer of from 1 to about 20,
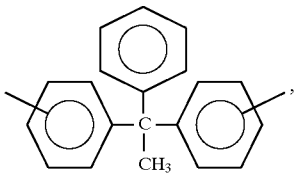
-continued
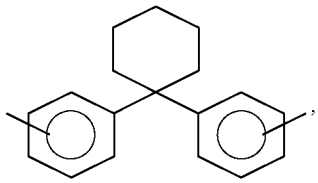
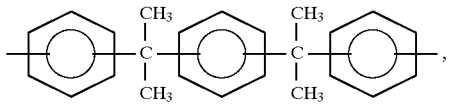
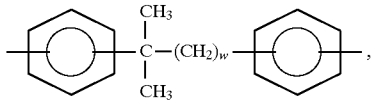
wherein w is an integer of from 1 to about 20,
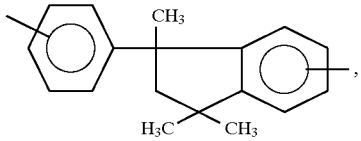
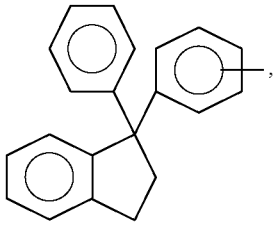
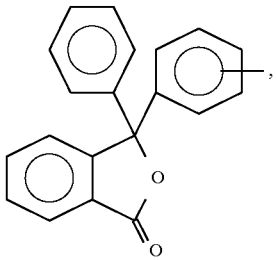
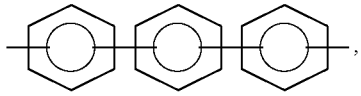
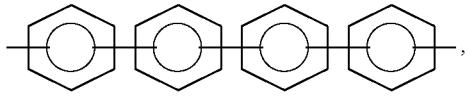
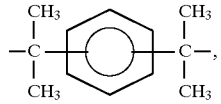
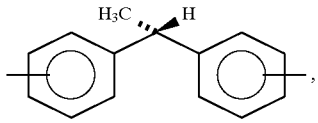

or mixtures thereof, C is
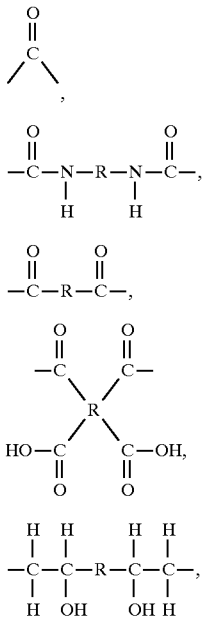
or mixtures thereof, wherein R is an alkyl group, an aryl group, an arylalkyl group, or mixtures thereof, and m and n are integers representing the number of repeating units.
14. An imaging member according to claim 1 wherein the polymer is of the formula
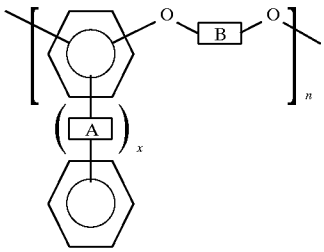
II
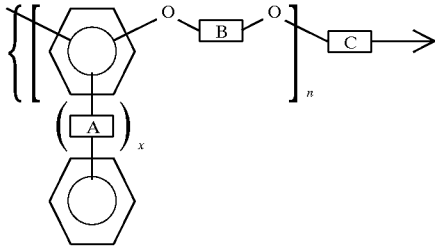
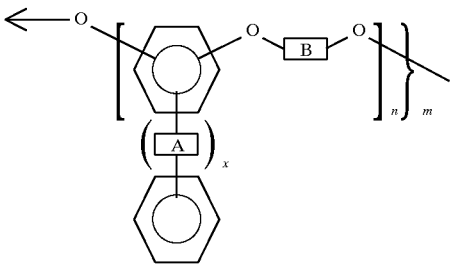
V
-continued
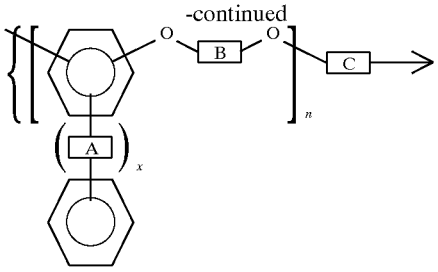
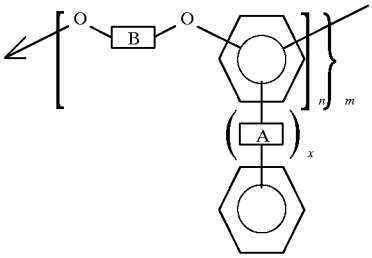
VI
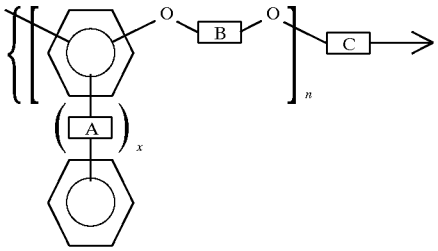
IX
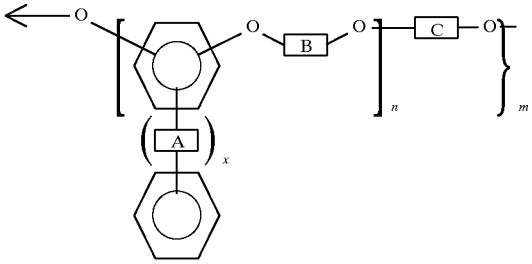
or
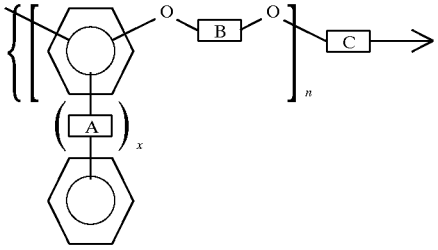
X
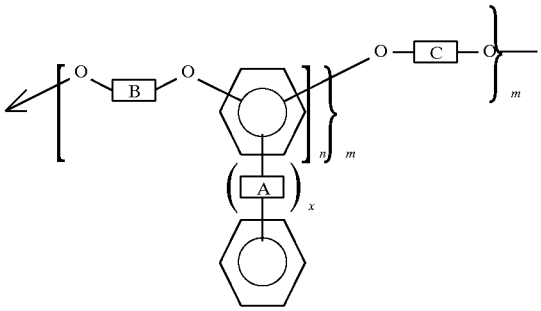

wherein x is an integer of 0 or 1, A is
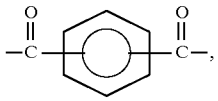
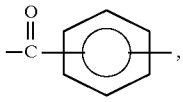
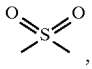
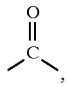
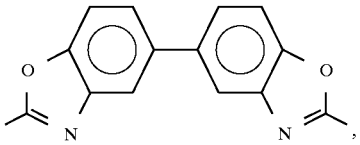
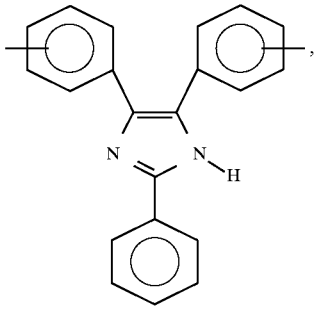
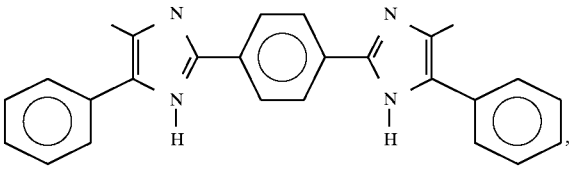
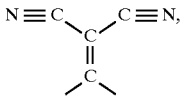
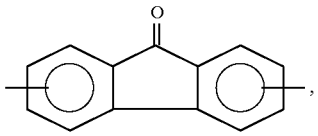
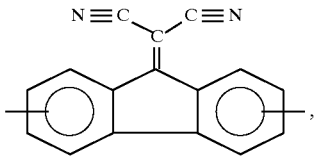
or mixtures thereof, B is
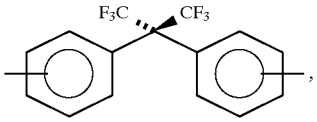
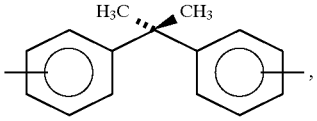
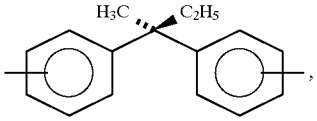
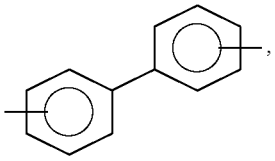
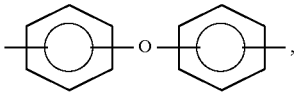
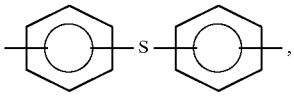
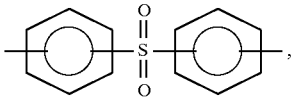
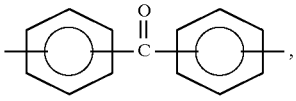
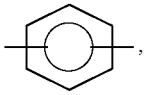
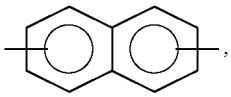
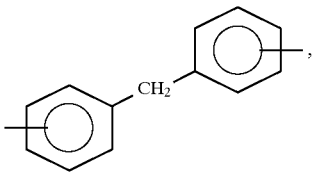
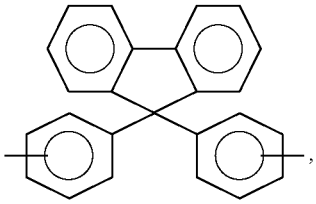

-continued $-(CH_2)_v-$, wherein v is an integer of from 1 to about 20, $-(CH_2O)_t-$ wherein t is an integer of from 1 to about 20,

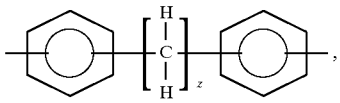

wherein z is an integer of from 2 to about 20,

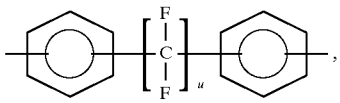

wherein u is an integer of from 1 to about 20,

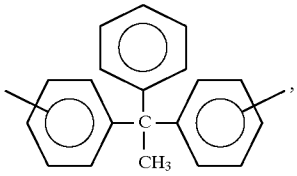

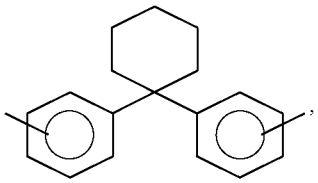

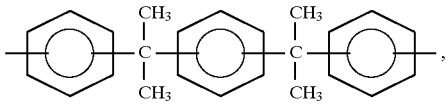

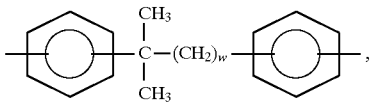

wherein w is an integer of from 1 to about 20,

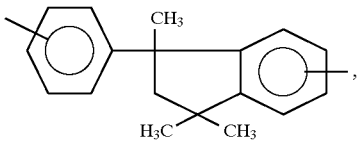

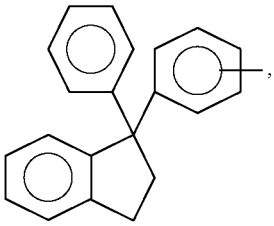

-continued

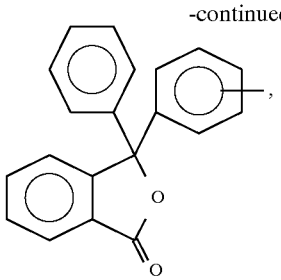

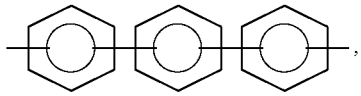

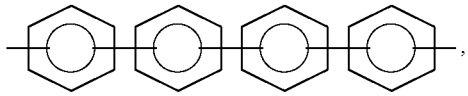

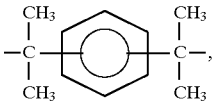

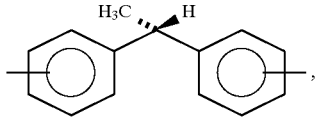

or mixtures thereof, C is

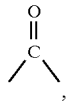

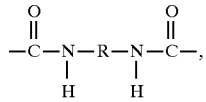

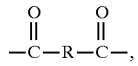

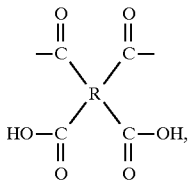

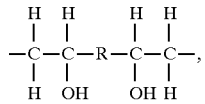

or mixtures thereof, wherein R is an alkyl group, an aryl group, an arylalkyl group, or mixtures thereof, and m and n are integers representing the number of repeating units.

15. An imaging member according to claim 1 wherein the polymer is of the formulae I, III, IV, VII, or VIII wherein x is an integer of 0 or 1, A is

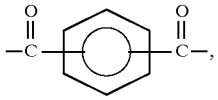
B is
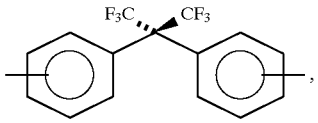
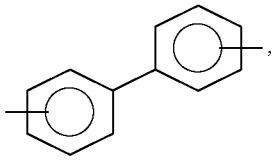
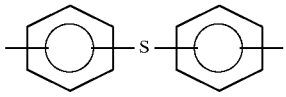
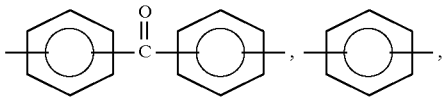
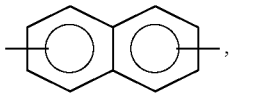
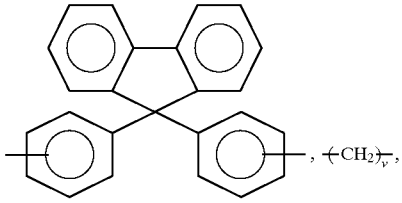
wherein v is an integer of from 1 to about 20,
$$—(CH_2O)_t—$$
wherein t is an integer of from 1 to about 20,
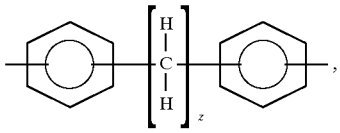
wherein z is an integer of from 2 to about 20,
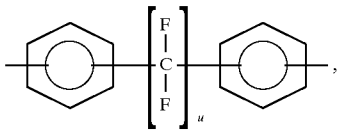
wherein u is an integer of from 1 to about 20,
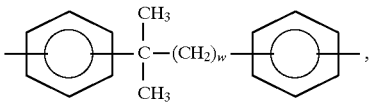
wherein w is an integer of from 1 to about 20,
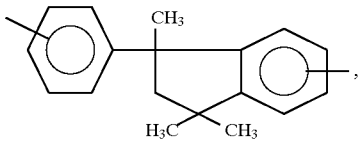
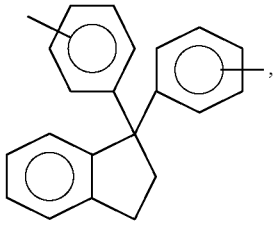
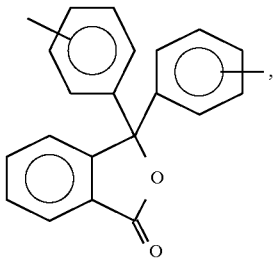
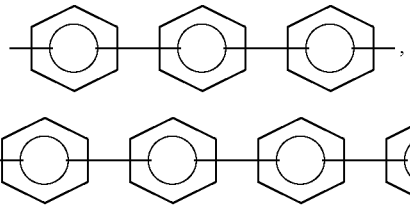
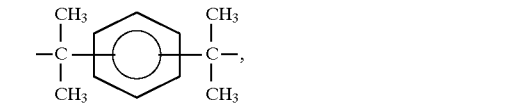
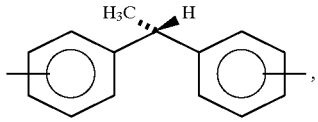
or mixtures thereof, C is
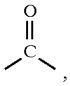
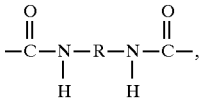
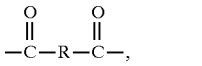

-continued

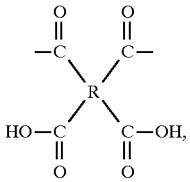

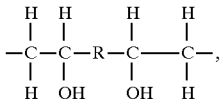

or mixtures thereof, wherein R is an alkyl group, an aryl group, an arylalkyl group, or mixtures thereof, and m and n are integers representing the number of repeating units.

16. An imaging member according to claim 1 wherein the polymer is of the formulae I, III, IV, VII, and VIII wherein x is an integer of 0 or 1, A is

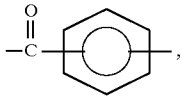

B is

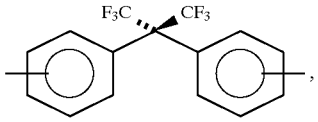

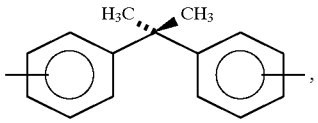

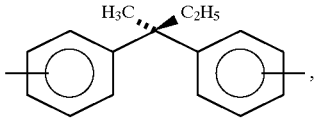

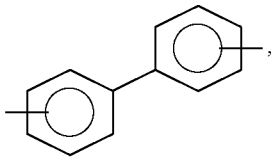

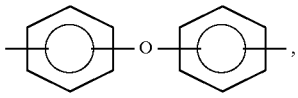

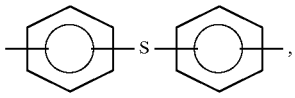

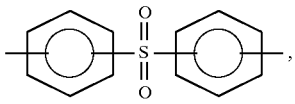

-continued

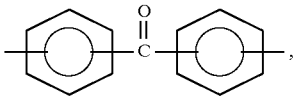

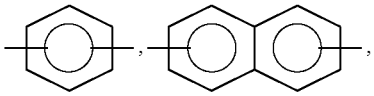

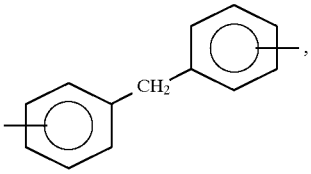

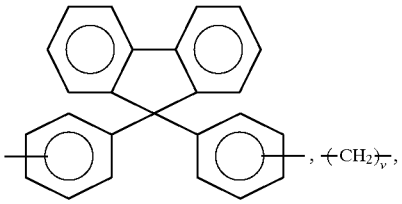

wherein v is an integer of from 1 to about 20, $—(CH_2O)_t—$ wherein t is an integer of from 1 to about 20,

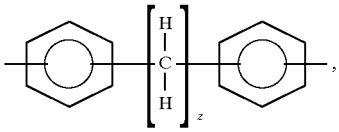

wherein z is an integer of from 2 to about 20,

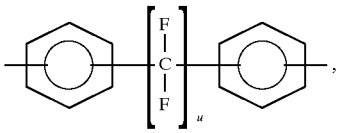

wherein u is an integer of from 1 to about 20,

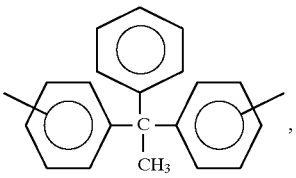

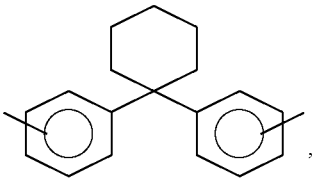

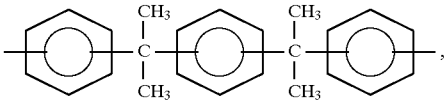

-continued

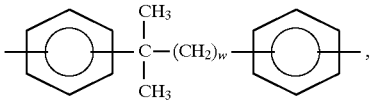

wherein w is an integer of from 1 to about 20,

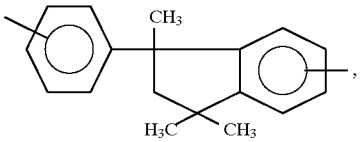

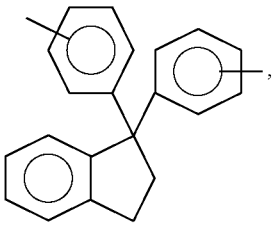

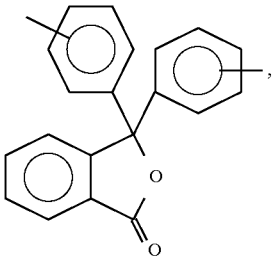

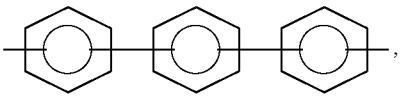

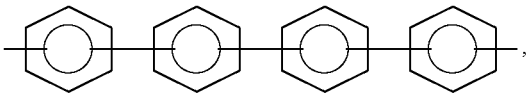

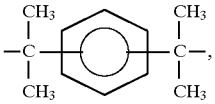

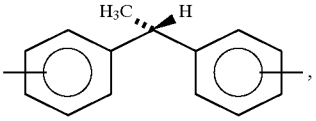

or mixtures thereof, C is

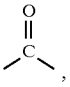

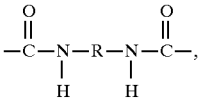

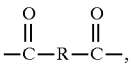

-continued

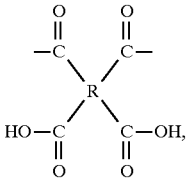

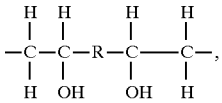

or mixtures thereof, wherein R is an alkyl group, an aryl group, an arylalkyl group, or mixtures thereof, and m and n are integers representing the number of repeating units.

17. An imaging member according to claim 1 wherein the polymer is of the formulae I, III, IV, VII, and VIII wherein x is an integer of 0 or 1, A is

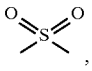

B is

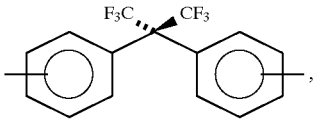

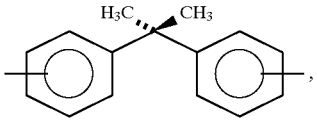

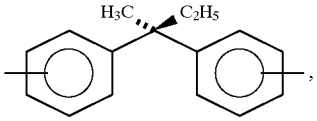

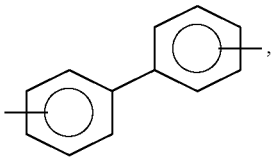

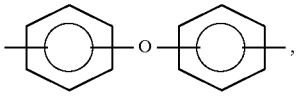

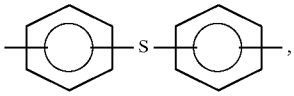

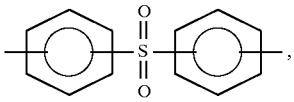

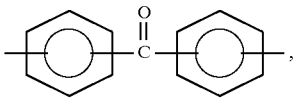

-continued
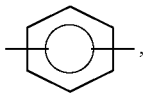
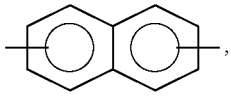
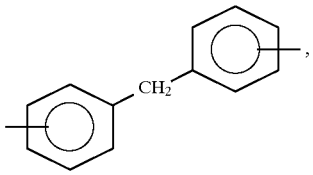
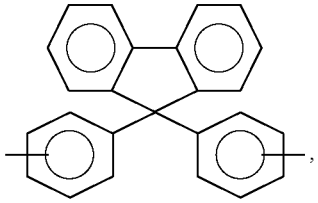
$\leftarrow CH_2 \rightarrow_v$,
wherein v is an integer of from 1 to about 20,
$—(CH_2O)_t—$
wherein t is an integer of from 1 to about 20,
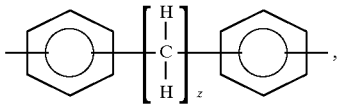
wherein z is an integer of from 2 to about 20,
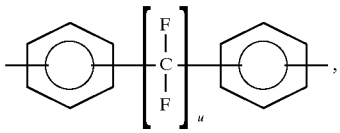
wherein u is an integer of from 1 to about 20,
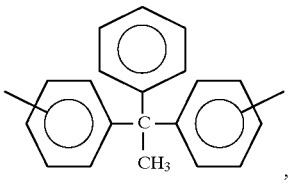
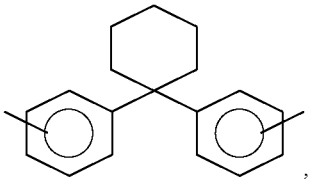
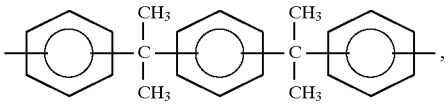
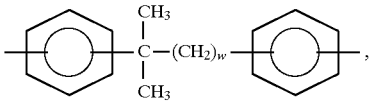
wherein w is an integer of from 1 to about 20,
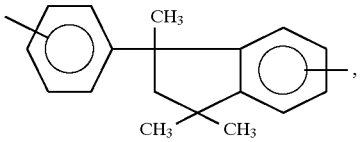
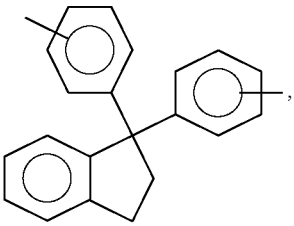
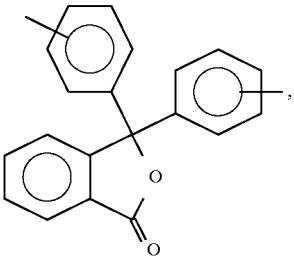
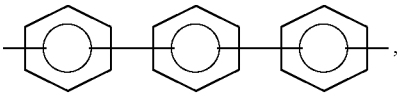
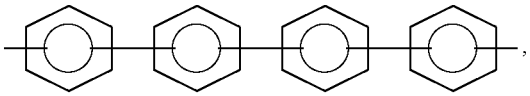
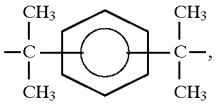

-continued
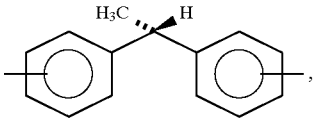
or mixtures thereof, C is
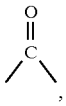
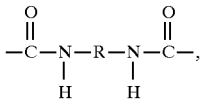
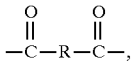
-continued
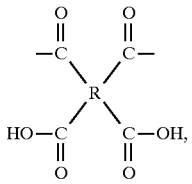
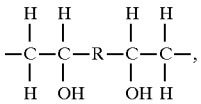
or mixtures thereof, wherein R is an alkyl group, an aryl group, an arylalkyl group, or mixtures thereof, and m and n are integers representing the number of repeating units.
* * * * *